US011721465B2

(12) United States Patent
Tresso et al.

(10) Patent No.: US 11,721,465 B2
(45) Date of Patent: Aug. 8, 2023

(54) SOLENOID APPARATUS AND METHODS OF ASSEMBLY

(71) Applicant: Rain Bird Corporation, Azusa, CA (US)

(72) Inventors: Riccardo Tresso, Oro Valley, AZ (US); Kevin James Markley, Tucson, AZ (US); Michael Joseph Millius, Tucson, AZ (US)

(73) Assignee: Rain Bird Corporation, Azusa, CA (US)

( * ) Notice: Subject to any disclaimer, the term of this patent is extended or adjusted under 35 U.S.C. 154(b) by 32 days.

(21) Appl. No.: 17/238,660

(22) Filed: Apr. 23, 2021

(65) Prior Publication Data

US 2021/0335530 A1 Oct. 28, 2021

Related U.S. Application Data

(60) Provisional application No. 63/015,300, filed on Apr. 24, 2020.

(51) Int. Cl.

| | |
|---|---|
| ***H01F 3/00*** | (2006.01) |
| ***H01F 7/124*** | (2006.01) |
| ***H01F 7/13*** | (2006.01) |
| ***H01F 7/08*** | (2006.01) |
| ***H01F 7/16*** | (2006.01) |

(52) U.S. Cl.

CPC ..... *H01F 7/124* (2013.01); *H01F 7/081* (2013.01); *H01F 7/13* (2013.01); *H01F 7/1623* (2013.01); *H01F 2007/083* (2013.01)

(58) Field of Classification Search

CPC . H01F 7/124; H01F 7/081; H01F 7/13; H01F 7/1623; H01F 2007/083; H01F 5/04; H01F 7/12; H01F 7/127; H01F 7/128; H01F 7/1607; H01F 2007/062

USPC ..... 335/257

See application file for complete search history.

(56) References Cited

U.S. PATENT DOCUMENTS

| | | | |
|---|---|---|---|
| 211,820 | A | 1/1879 | White |
| 306,972 | A | 10/1884 | Stiles |
| 674,917 | A | 5/1901 | Halbert |
| 766,420 | A | 8/1904 | Calley |

(Continued)

FOREIGN PATENT DOCUMENTS

| | | |
|---|---|---|
| CN | 85205374 U | 11/1986 |
| CN | 1345531 | 4/2002 |

(Continued)

OTHER PUBLICATIONS

'PureSense on-line help', https://www.pserm.com/IrrigationManagerHelp/PureSense_Irrigation_Manager.htm, Mar. 24, 2010.

(Continued)

*Primary Examiner* — Shawki S Ismail
*Assistant Examiner* — Lisa N Homza
(74) *Attorney, Agent, or Firm* — Fitch, Even, Tabin & Flannery, LLP

(57) ABSTRACT

In one aspect, there is disclosed a solenoid having a bobbin with a core wire positioned about the bobbin to form a coil. A power supply wire is connected an end of the core wire and a frame is connected to the bobbin. An overmolded housing surrounds the core wire, the frame and a portion of the power supply wire.

12 Claims, 24 Drawing Sheets

(56) References Cited

U.S. PATENT DOCUMENTS 1,001,593 A 8/1911 Hertzberg
1,566,375 A 12/1925 Coatalen
1,764,712 A 6/1930 Brackett
2,259,990 A 10/1941 Baumann
2,342,347 A 2/1944 Jacobsen
2,477,587 A 8/1949 Doutt
2,504,057 A 4/1950 Trefil
2,638,109 A 5/1953 Wahlmark
2,746,471 A 5/1956 Cobb
2,860,015 A 11/1958 Matterson
2,940,474 A 6/1960 Webster
2,953,248 A 9/1960 Troland
3,082,359 A 3/1963 Seybold
3,203,447 A 8/1965 Bremner
3,262,027 A 7/1966 Churchill
3,279,749 A 10/1966 Fleckenstein
3,339,583 A 9/1967 Fleckenstein
3,379,214 A 4/1968 Weinberg
3,411,745 A 11/1968 Austin, Jr.
3,420,492 A 1/1969 Ray
3,448,960 A 6/1969 Medley
3,458,769 A 7/1969 Stampfli
3,477,693 A 11/1969 Bezanis
3,481,578 A 12/1969 Baldi
3,504,315 A 3/1970 Stanwell
3,511,472 A 5/1970 Zimmerman
3,547,154 A 12/1970 Benham
3,598,145 A 8/1971 Wolfson
3,598,360 A 8/1971 Merriner
3,633,869 A 1/1972 Lehmann
3,729,710 A 4/1973 Sherwin
3,743,898 A 7/1973 Sturman
3,747,620 A 7/1973 Kah, Jr.
3,757,263 A 9/1973 Merriner
3,941,348 A 3/1976 Mott
3,977,436 A 8/1976 Larner
3,989,066 A 11/1976 Sturman
4,004,258 A 1/1977 Arnold
4,007,458 A 2/1977 Hollabaugh
4,010,390 A 3/1977 Stampfli
4,022,244 A 5/1977 Oman
4,029,295 A 6/1977 Wassmer
4,056,255 A 11/1977 Lace
4,065,722 A 12/1977 Francis
4,074,699 A 2/1978 Stampfli
4,082,116 A 4/1978 Stampfli
4,099,701 A 7/1978 Berger
4,111,230 A 9/1978 Stampfli
4,114,184 A 9/1978 Stampfli
4,121,114 A 10/1978 Ruggles
4,131,882 A 12/1978 Hollabaugh
4,165,532 A 8/1979 Kendall
4,176,395 A 11/1979 Evelyn-Veere
4,241,375 A 12/1980 Ruggles
4,251,053 A 2/1981 Wurzer
4,257,573 A 3/1981 Stampfli
D266,863 S 11/1982 Mason
4,383,234 A 5/1983 Yatsushiro
4,419,643 A 12/1983 Ojima
4,423,484 A 12/1983 Hamilton
4,445,788 A 5/1984 Twersky
4,470,030 A 9/1984 Myers
4,506,701 A 3/1985 Masaki
4,535,401 A 8/1985 Penn
4,537,387 A 8/1985 Danby
4,540,154 A 9/1985 Kolchinsky
4,548,225 A 10/1985 Busalacchi
4,556,864 A 12/1985 Roy
4,562,506 A 12/1985 Moran
4,590,962 A 5/1986 Tespa
4,596,266 A 6/1986 Kinghorn
4,637,548 A 1/1987 Ray
4,643,393 A 2/1987 Kosugi
4,645,882 A 2/1987 Nakayama
4,662,399 A 5/1987 Buchner
4,679,767 A 7/1987 Vollmer
4,697,786 A 10/1987 Kennedy
4,716,490 A 12/1987 Alexanian
4,718,454 A 1/1988 Appleby
4,720,078 A 1/1988 Nakamura
4,733,212 A 3/1988 Goodwin
4,751,487 A 6/1988 Green, Jr.
4,758,811 A 7/1988 Slavin
4,777,556 A 10/1988 Imran
4,781,213 A 11/1988 Kilayko
4,790,351 A 12/1988 Kervagoret
4,794,890 A 1/1989 Richeson, Jr.
4,801,910 A 1/1989 Ayers
4,811,221 A 3/1989 Sturman
4,829,947 A 5/1989 Lequesne
4,852,802 A 8/1989 Iggulden
4,893,645 A 1/1990 Augustinas
4,954,799 A 9/1990 Kumar
4,967,996 A 11/1990 Sonoda
4,994,776 A 2/1991 Juncu
5,008,664 A 4/1991 More
5,010,911 A 4/1991 Grant
5,021,939 A 6/1991 Pulgiese
5,023,787 A 6/1991 Evelyn-Veere
5,048,755 A 9/1991 Dodds
5,050,800 A 9/1991 Lamar
5,064,166 A 11/1991 Schechter
5,067,688 A 11/1991 Tanimoto
5,071,267 A 12/1991 Aldefeld
5,079,667 A 1/1992 Kasano
5,085,402 A 2/1992 O'Dell
5,097,861 A 3/1992 Hopkins
5,100,056 A 3/1992 Theodorsen
5,125,432 A 6/1992 Fujii
5,139,226 A 8/1992 Baldwin
5,145,148 A 9/1992 Laurent
5,153,550 A 10/1992 Sugiura
5,186,433 A 2/1993 Pausch
5,199,462 A 4/1993 Baker
5,213,303 A 5/1993 Walker
5,229,649 A 7/1993 Nielsen
5,229,937 A 7/1993 Evelyn-Veere
5,251,153 A 10/1993 Nielsen
5,311,162 A 5/1994 Sjoquist
5,333,785 A 8/1994 Dodds
5,347,421 A 9/1994 Alexanian
5,365,210 A 11/1994 Hines
5,375,811 A 12/1994 Reinicke
5,402,303 A 3/1995 Luck
5,441,233 A 8/1995 Asou
5,479,339 A 12/1995 Miller
5,482,080 A 1/1996 Bergmann
5,485,400 A 1/1996 Warrior
5,497,135 A 3/1996 Wisskirchen
5,546,063 A 8/1996 Hoffman
5,566,921 A 10/1996 Yokota
5,584,465 A 12/1996 Ochsenreiter
5,621,669 A 4/1997 Bjornsson
5,622,351 A 4/1997 Kim
5,638,847 A 6/1997 Hoch
5,645,264 A 7/1997 Kah
5,649,818 A 7/1997 Day
5,655,561 A 8/1997 Wendel
5,655,747 A 8/1997 Pasut
5,661,349 A 8/1997 Luck
5,687,759 A 11/1997 Tan
5,696,671 A 12/1997 Oliver
5,730,423 A 3/1998 Wu
5,740,031 A 4/1998 Gagnon
5,760,706 A 6/1998 Kiss
5,780,938 A 7/1998 Edwards
5,785,298 A 7/1998 Kumar
5,813,606 A 9/1998 Ziff
5,825,664 A 10/1998 Warrior
5,826,619 A 10/1998 Roman
5,839,658 A 11/1998 Sarver
5,848,609 A 12/1998 Marchesseault
5,848,780 A 12/1998 Miller
5,851,004 A 12/1998 Wu

(56) References Cited

U.S. PATENT DOCUMENTS 5,871,156 A 2/1999 Lawson
5,895,026 A 4/1999 Linkner, Jr.
5,914,847 A 6/1999 Alexanian
5,915,665 A 6/1999 Paese
5,927,607 A 7/1999 Scott
5,938,172 A 8/1999 Ohtsuka
D413,650 S 9/1999 Sato
5,961,045 A 10/1999 Doldren
5,967,424 A 10/1999 Bonnah, II
5,971,025 A 10/1999 Backlund
5,979,482 A 11/1999 Scott
5,996,608 A 12/1999 Hunter
6,012,700 A 1/2000 Johnson
6,021,038 A 2/2000 Hanchett
6,040,752 A 3/2000 Fisher
6,047,907 A 4/2000 Hornby
6,047,947 A 4/2000 Kumar
6,061,603 A 5/2000 Papadopoulos
6,073,904 A 6/2000 Diller
6,076,550 A 6/2000 Hiraishi
6,076,801 A 6/2000 Duhack
6,076,803 A 6/2000 Johnson
6,079,433 A 6/2000 Saarem
6,086,042 A * 7/2000 Scott ..... F16K 31/0658 335/282
D430,268 S 8/2000 Hiramatsu
6,095,496 A 8/2000 Rydin
6,098,898 A 8/2000 Storch
6,124,775 A 9/2000 Linkner, Jr.
6,126,141 A 10/2000 Geiger
6,154,354 A 11/2000 Alexanian
6,163,239 A 12/2000 Ozawa
6,164,331 A 12/2000 Sugita
6,179,268 B1 1/2001 Seid
6,186,413 B1 2/2001 Lawson
6,199,587 B1 3/2001 Shlomi
6,218,921 B1 4/2001 Eberts
6,219,903 B1 4/2001 Osterhart
6,220,275 B1 4/2001 Nishinosono
6,220,299 B1 4/2001 Arvidsson
D443,030 S 5/2001 Kaneko
6,224,033 B1 5/2001 Kumar
6,227,455 B1 5/2001 Scott
6,236,293 B1 5/2001 Forster
6,244,298 B1 6/2001 Sugita
6,263,901 B1 7/2001 Lohde
6,283,139 B1 9/2001 Symonds
6,293,516 B1 9/2001 Parsons
6,305,662 B1 10/2001 Parsons
6,314,340 B1 11/2001 Mecham
6,335,855 B1 1/2002 Alexanian
6,336,621 B1 1/2002 Ii
6,337,635 B1 1/2002 Ericksen
6,341,759 B1 1/2002 Noller
6,351,366 B1 2/2002 Alexanian
6,366,189 B1 4/2002 Bergvall
6,374,814 B1 4/2002 Cook
6,378,838 B1 4/2002 Brundisini
6,382,532 B1 5/2002 French
6,386,221 B1 5/2002 Knoll
6,386,505 B2 5/2002 Schoeb
6,394,126 B2 5/2002 Lohde
6,394,413 B2 5/2002 Lohde
D459,441 S 6/2002 Hayashi
6,402,057 B1 6/2002 Kimmel
6,405,752 B1 6/2002 Fritsch
6,409,144 B1 6/2002 Inami
D460,148 S 7/2002 Hayashi
6,422,488 B1 7/2002 Fochtman
6,424,243 B1 7/2002 Forster
6,446,885 B1 9/2002 Sims, Jr.
6,450,478 B2 9/2002 Parsons
6,452,499 B1 9/2002 Runge
6,460,563 B2 10/2002 Olson
6,480,497 B1 11/2002 Flammer, III
6,481,646 B1 11/2002 Hornby
6,491,235 B1 12/2002 Scott
6,492,751 B1 12/2002 Ineson
6,498,558 B1 12/2002 Linkner, Jr.
6,499,677 B2 12/2002 Dallmeyer
6,501,359 B2 12/2002 Matsusaka
6,502,770 B2 1/2003 Dallmeyer
6,508,272 B1 1/2003 Parsons
6,529,589 B1 3/2003 Nelson
6,536,681 B2 3/2003 Dallmeyer
6,542,059 B2 4/2003 Sato
6,543,744 B2 4/2003 Carrillo
6,546,945 B2 4/2003 Ishigaki
6,550,690 B2 4/2003 Dallmeyer
6,553,336 B1 4/2003 Johnson
6,557,580 B2 5/2003 Lohde
6,568,080 B2 5/2003 Kimmel
6,568,609 B2 5/2003 Dallmeyer
6,598,852 B2 7/2003 Tomoda
6,600,971 B1 7/2003 Smith
6,601,300 B2 8/2003 Hasegawa
6,604,726 B2 8/2003 Kumar
6,609,698 B1 8/2003 Parsons
6,616,120 B2 9/2003 Barzuza
6,616,249 B2 9/2003 Han
6,619,320 B2 9/2003 Parsons
6,619,614 B2 9/2003 Parsons
6,627,077 B2 9/2003 Fritsch
6,651,628 B2 11/2003 Nally
6,652,188 B1 11/2003 Albright
6,655,609 B2 12/2003 Dallmeyer
6,671,586 B2 12/2003 Davis
6,676,044 B2 1/2004 Dallmeyer
6,685,112 B1 2/2004 Hornby
6,685,158 B2 2/2004 Parsons
6,687,997 B2 2/2004 Dallmeyer
6,691,740 B2 2/2004 Yoshida
6,691,979 B2 2/2004 Parsons
6,694,223 B1 2/2004 Goldberg
6,695,281 B2 2/2004 Williams
6,707,174 B2 3/2004 Lin
6,708,084 B2 3/2004 Battistutto
6,715,732 B2 4/2004 Kumar
6,720,853 B1 4/2004 Callis
6,721,630 B1 4/2004 Woytowitz
6,722,628 B1 4/2004 Seil
6,745,457 B2 6/2004 Noller
6,747,557 B1 6/2004 Petite
6,748,976 B2 6/2004 Sato
6,749,136 B1 6/2004 Wilson
6,749,175 B2 6/2004 Sato
6,752,371 B2 6/2004 Herbert
6,756,871 B1 6/2004 Suzuki
6,763,287 B2 7/2004 Brundisini
6,766,221 B1 7/2004 Christiansen
6,766,825 B2 7/2004 Antunez
6,769,176 B2 8/2004 Hornby
6,778,099 B1 8/2004 Meyer
6,782,310 B2 8/2004 Bailey
6,782,311 B2 8/2004 Barlow
6,783,287 B2 8/2004 Kudo
6,791,442 B1 9/2004 Schmidt
6,792,323 B2 9/2004 Krzyzanowski
6,793,162 B2 9/2004 Dallmeyer
6,812,826 B2 11/2004 Buhler
6,823,239 B2 11/2004 Sieminski
6,830,232 B2 12/2004 Burrola
6,840,460 B2 1/2005 Clark
6,842,667 B2 1/2005 Beutler
6,848,632 B2 2/2005 Clark
6,851,622 B2 2/2005 Demere
6,851,631 B2 2/2005 Dallmeyer
6,853,883 B2 2/2005 Kreikemeier
6,854,706 B2 2/2005 Sato
6,862,498 B2 3/2005 Davis
6,874,535 B2 4/2005 Parsons
6,874,707 B2 4/2005 Skinner
6,877,526 B2 4/2005 Burrola
6,877,714 B2 4/2005 Hall

(56) References Cited

U.S. PATENT DOCUMENTS 6,877,717 B2 4/2005 Collins
6,891,838 B1 5/2005 Petite
6,892,114 B1 5/2005 Addink
6,895,987 B2 5/2005 Addink
6,898,467 B1 5/2005 Smith
6,903,647 B2 6/2005 Linkner, Jr
6,904,668 B2 6/2005 Dallmeyer
6,914,893 B2 7/2005 Petite
6,932,316 B2 8/2005 Herbert
6,932,320 B2 8/2005 Fukano
6,938,834 B2 9/2005 Harris
6,944,523 B2 9/2005 Addink
6,947,810 B2 9/2005 Skinner
6,947,854 B2 9/2005 Swarztrauber
6,948,697 B2 9/2005 Herbert
6,950,728 B1 9/2005 Addink
6,955,334 B2 10/2005 Parsons
6,955,337 B2 10/2005 Weber
6,959,904 B2 11/2005 Beraldo
6,963,808 B1 11/2005 Addink
6,971,684 B2 12/2005 Ferrari
6,978,794 B2 12/2005 Dukes
6,985,060 B2 1/2006 Parker
6,991,214 B2 1/2006 Richter
6,993,416 B2 1/2006 Christiansen
6,997,642 B2 2/2006 Bishop
7,000,890 B2 2/2006 Bell
7,003,357 B1 2/2006 Kreikemeier
7,004,450 B2 2/2006 Yoshimura
7,010,395 B1 3/2006 Goldberg
7,010,396 B2 3/2006 Ware
7,012,394 B2 3/2006 Moore
7,012,546 B1 3/2006 Zigdon
7,017,605 B2 3/2006 Stroud
7,021,750 B2 4/2006 Shibata
7,024,256 B2 4/2006 Krzyzanowski
7,050,887 B2 5/2006 Alvarez
7,058,478 B2 6/2006 Alexanian
7,058,479 B2 6/2006 Miller
7,059,548 B2 6/2006 Reiter
7,063,270 B2 6/2006 Bowers
7,069,115 B1 6/2006 Woytowitz
D524,910 S 7/2006 Matsumoto
7,069,941 B2 7/2006 Parsons
D527,073 S 8/2006 Yajima
7,084,741 B2 8/2006 Plummer
7,086,383 B2 8/2006 Ivens
7,093,362 B2 8/2006 Dallmeyer
7,103,511 B2 9/2006 Petite
7,106,158 B2 9/2006 Forsythe
7,123,993 B1 10/2006 Freeman
7,133,749 B2 11/2006 Goldberg
7,146,225 B2 12/2006 Guenst
7,146,254 B1 12/2006 Howard
7,146,255 B2 12/2006 Christiansen
7,156,363 B2 1/2007 Parsons
7,168,638 B2 1/2007 Saito
7,172,366 B1 2/2007 Bishop
7,181,319 B1 2/2007 Woytowtiz
7,182,272 B1 2/2007 Marian
7,182,311 B2 2/2007 Kimble
7,184,848 B2 2/2007 Krzyzanowski
7,187,262 B1 3/2007 Henry
7,187,285 B2 3/2007 Staples
7,188,822 B2 3/2007 Marcichow
7,196,602 B2 3/2007 Adams
7,206,669 B2 4/2007 Christiansen
D541,905 S 5/2007 Yajima
7,225,057 B2 5/2007 Froman
7,227,439 B2 6/2007 Kelly
7,240,740 B2 7/2007 Reilly
7,245,991 B1 7/2007 Woytowitz
7,246,787 B2 7/2007 Kumar
7,248,945 B2 7/2007 Woytowitz
7,249,749 B2 7/2007 Niwa
7,250,860 B2 7/2007 Smith
D549,077 S 8/2007 Yajima
D549,241 S 8/2007 Giddens
7,257,465 B2 8/2007 Perez
7,263,073 B2 8/2007 Petite
7,266,428 B2 9/2007 Alexanian
7,270,093 B2 9/2007 Luercho
7,273,206 B2 9/2007 Sato
7,280,019 B2 10/2007 Kolb
7,286,904 B2 10/2007 Graham
7,289,862 B2 10/2007 Britton
7,293,757 B2 11/2007 Akabane
7,295,128 B2 11/2007 Petite
7,303,147 B1 12/2007 Danner
7,305,280 B2 12/2007 Marian
7,309,033 B2 12/2007 Dallmeyer
7,317,972 B2 1/2008 Addink
7,325,564 B2 2/2008 Ryuen
7,325,781 B2 2/2008 Parsons
7,328,089 B2 2/2008 Curren
7,330,796 B2 2/2008 Addink
D563,507 S 3/2008 Kato
7,339,957 B2 3/2008 Hitt
7,346,463 B2 3/2008 Petite
7,347,383 B2 3/2008 Dallmeyer
7,358,626 B2 4/2008 Gardner
7,359,769 B2 4/2008 Bailey
7,378,768 B2 5/2008 Ohkawa
7,383,721 B2 6/2008 Parsons
7,383,851 B2 6/2008 Jacobsen
7,389,952 B2 6/2008 Dallmeyer
7,392,053 B1 6/2008 Conner
7,396,000 B2 7/2008 Parsons
7,398,139 B1 7/2008 Woytowitz
7,400,944 B2 7/2008 Bailey
7,403,840 B2 7/2008 Moore
7,406,363 B2 7/2008 Doering
7,412,245 B2 8/2008 Guo
7,412,303 B1 8/2008 Porter
7,412,317 B2 8/2008 Takamatsu
7,414,502 B2 8/2008 Tackes
7,421,317 B2 9/2008 Christiansen
7,422,160 B2 9/2008 Dallmeyer
7,423,985 B1 9/2008 Hill
7,429,006 B2 9/2008 Dallmeyer
7,437,778 B2 10/2008 Parsons
7,444,207 B2 10/2008 Nickerson
7,458,521 B2 12/2008 Ivans
7,472,883 B2 1/2009 Murao
7,474,024 B2 1/2009 Nakanishi
7,475,863 B2 1/2009 Donovan
7,480,501 B2 1/2009 Petite
7,487,798 B2 2/2009 Furuta
7,487,925 B2 2/2009 Skinner
7,503,346 B1 3/2009 Clark
7,503,347 B2 3/2009 Ryuen
7,520,449 B2 4/2009 Matsuo
7,526,365 B1 4/2009 Frerich
7,530,506 B2 5/2009 Kato
7,532,100 B2 5/2009 Henry
7,546,181 B2 6/2009 Vidovich
7,556,537 B2 7/2009 Schenk
7,562,399 B2 7/2009 Parsons
7,564,842 B2 7/2009 Callaway, Jr.
7,567,858 B1 7/2009 Dunlap
7,574,284 B2 8/2009 Goldberg
7,574,285 B2 8/2009 Kah
7,584,023 B1 9/2009 Palmer
7,596,429 B2 9/2009 Cardinal
D603,015 S 10/2009 Matsumura
7,613,547 B1 11/2009 Woytowitz
7,637,475 B2 12/2009 Adams
7,640,079 B2 12/2009 Nickerson
7,643,823 B2 1/2010 Shamoon
7,650,425 B2 1/2010 Davis
7,665,713 B1 2/2010 Clark
7,668,532 B2 2/2010 Shamoon
7,668,990 B2 2/2010 Krzyzanowski
7,690,623 B2 4/2010 Parsons

(56) References Cited

U.S. PATENT DOCUMENTS

| | | | |
|---|---|---|---|
| 7,694,934 | B2 | 4/2010 | Irwin |
| 7,697,248 | B2 | 4/2010 | Tomimbang |
| 7,701,314 | B2 | 4/2010 | Hazzard |
| 7,703,707 | B2 | 4/2010 | Yasukawa |
| 7,703,709 | B2 | 4/2010 | Akabane |
| 7,707,125 | B2 | 4/2010 | Haji-Valizadeh |
| D615,618 | S | 5/2010 | Someya |
| 7,710,226 | B2 | 5/2010 | Nelson |
| 7,711,454 | B2 | 5/2010 | Addink |
| 7,711,796 | B2 | 5/2010 | Gutt |
| 7,719,394 | B2 | 5/2010 | Nelson |
| 7,719,432 | B1 | 5/2010 | Hill |
| 7,726,630 | B2 | 6/2010 | Cripps |
| 7,731,154 | B2 | 6/2010 | Parsons |
| 7,735,513 | B2 | 6/2010 | Bush |
| 7,738,999 | B2 | 6/2010 | Petite |
| 7,762,523 | B2 | 7/2010 | Smith |
| D622,226 | S | 8/2010 | Crist |
| D622,709 | S | 8/2010 | Hern |
| 7,772,726 | B1 | 8/2010 | Porter |
| 7,792,612 | B2 | 9/2010 | Kah |
| 7,806,382 | B1 | 10/2010 | Palumbo |
| 7,826,931 | B2 | 11/2010 | Lorenz |
| 7,830,231 | B2 | 11/2010 | Carlino |
| 7,844,368 | B2 | 11/2010 | Alexanian |
| 7,844,369 | B2 | 11/2010 | Nickerson |
| 7,857,282 | B2 | 12/2010 | Goossens |
| 7,870,080 | B2 | 1/2011 | Budike, Jr. |
| 7,877,168 | B1 | 1/2011 | Porter |
| RE42,084 | E | 2/2011 | Baecklund |
| D633,180 | S | 2/2011 | Duong |
| 7,883,027 | B2 | 2/2011 | Fekete |
| 7,895,993 | B2 | 3/2011 | Weisz |
| 7,899,580 | B2 | 3/2011 | Cardinal |
| 7,899,581 | B1 | 3/2011 | Woytowitz |
| 7,911,341 | B2 | 3/2011 | Raji |
| D636,278 | S | 4/2011 | Franchini |
| 7,921,480 | B2 | 4/2011 | Parsons |
| 7,922,150 | B2 | 4/2011 | Cripps |
| 7,930,069 | B2 | 4/2011 | Savelle |
| 7,933,945 | B2 | 4/2011 | Krzyzanowski |
| 7,938,340 | B2 | 5/2011 | Anderson |
| 7,950,416 | B2 | 5/2011 | Nakai |
| 7,953,517 | B1 | 5/2011 | Porter |
| 7,959,129 | B2 | 6/2011 | Matsumoto |
| 7,962,101 | B2 | 6/2011 | Vaswani |
| 7,962,244 | B2 | 6/2011 | Alexanian |
| 7,973,627 | B2 | 7/2011 | Yamagata |
| 7,981,386 | B2 | 7/2011 | Mcavoy |
| 7,982,564 | B2 | 7/2011 | Farrar |
| 7,982,565 | B2 | 7/2011 | Bradfield |
| 7,983,574 | B2 | 7/2011 | Kolb |
| 7,996,115 | B2 | 8/2011 | Nickerson |
| 8,006,719 | B2 | 8/2011 | Nordstrom |
| 8,006,951 | B2 | 8/2011 | Guggenmos |
| 8,010,238 | B2 | 8/2011 | Ensworth |
| 8,019,482 | B2 | 9/2011 | Sutardja |
| 8,024,075 | B2 | 9/2011 | Fekete |
| 8,026,781 | B2 | 9/2011 | Freakes |
| 8,028,970 | B2 | 10/2011 | Fukano |
| 8,037,853 | B2 | 10/2011 | Luercho |
| 8,037,901 | B2 | 10/2011 | Matsumoto |
| 8,042,049 | B2 | 10/2011 | Killian |
| 8,042,202 | B2 | 10/2011 | Parsons |
| D648,000 | S | 11/2011 | Shimura |
| 8,055,389 | B2 | 11/2011 | Holindrake |
| 8,061,685 | B2 | 11/2011 | Ueda |
| 8,064,412 | B2 | 11/2011 | Petite |
| 8,064,935 | B2 | 11/2011 | Shamoon |
| 8,070,129 | B2 | 12/2011 | Makino |
| 8,081,053 | B2 | 12/2011 | Yamagata |
| 8,104,993 | B2 | 1/2012 | Hitt |
| 8,108,078 | B2 | 1/2012 | Lorenz |
| 8,116,889 | B2 | 2/2012 | Krzyzanowski |
| 8,127,746 | B2 | 3/2012 | Escandell |
| 8,127,790 | B2 | 3/2012 | Van Weelden |
| 8,127,791 | B2 | 3/2012 | Najmolhoda |
| 8,128,059 | B2 | 3/2012 | Uechi |
| 8,141,585 | B2 | 3/2012 | Tschurtz |
| 8,145,360 | B2 | 3/2012 | Brundisini |
| 8,160,750 | B2 | 4/2012 | Weiler |
| 8,170,721 | B2 | 5/2012 | Nickerson |
| 8,171,136 | B2 | 5/2012 | Petite |
| 8,186,378 | B2 | 5/2012 | Nordstrom |
| 8,188,821 | B2 | 5/2012 | Nelson |
| 8,196,064 | B2 | 6/2012 | Krzyzanowski |
| 8,200,368 | B2 | 6/2012 | Nickerson |
| 8,209,061 | B2 | 6/2012 | Palmer |
| 8,214,496 | B2 | 7/2012 | Gutt |
| 8,215,327 | B2 | 7/2012 | Bush |
| 8,215,610 | B2 | 7/2012 | Shiao |
| 8,219,254 | B2 | 7/2012 | O'Connor |
| 8,219,935 | B2 | 7/2012 | Hunts |
| 8,220,776 | B2 | 7/2012 | Tagata |
| 8,224,493 | B2 | 7/2012 | Walker |
| 8,225,810 | B2 | 7/2012 | Blanchard |
| 8,235,352 | B2 | 8/2012 | Irwin |
| 8,244,404 | B2 | 8/2012 | Nickerson |
| 8,245,402 | B2 | 8/2012 | Seitter |
| 8,246,004 | B2 | 8/2012 | Kratzer |
| 8,260,465 | B2 | 9/2012 | Crist |
| 8,261,770 | B2 | 9/2012 | Bush |
| 8,264,312 | B2 | 9/2012 | Hamaoka |
| 8,264,313 | B2 | 9/2012 | Sasao |
| 8,265,797 | B2 | 9/2012 | Nickerson |
| 8,274,171 | B2 | 9/2012 | Korol |
| 8,274,348 | B2 | 9/2012 | Kolb |
| 8,276,878 | B2 | 10/2012 | Parsons |
| 8,295,985 | B2 | 10/2012 | Crist |
| 8,297,314 | B2 | 10/2012 | Clark |
| 8,297,589 | B2 | 10/2012 | Dourdeville |
| 8,301,309 | B1 | 10/2012 | Woytoxitz |
| 8,305,168 | B2 | 11/2012 | Cotic |
| 8,310,322 | B2 | 11/2012 | Tomimbang |
| 8,326,440 | B2 | 12/2012 | Christfort |
| 8,335,304 | B2 | 12/2012 | Petite |
| 8,335,842 | B2 | 12/2012 | Raji |
| 8,347,918 | B2 | 1/2013 | Shimizu |
| 8,348,230 | B2 | 1/2013 | Michl |
| 8,348,231 | B2 | 1/2013 | Czimmek |
| 8,371,331 | B2 | 2/2013 | Najmolhoda |
| 8,374,726 | B2 | 2/2013 | Holindrake |
| 8,382,064 | B2 | 2/2013 | Nisinosono |
| 8,387,653 | B2 | 3/2013 | Bush |
| 8,396,606 | B2 | 3/2013 | Forbes, Jr. |
| 8,401,705 | B2 | 3/2013 | Alexanian |
| 8,410,931 | B2 | 4/2013 | Petite |
| 8,412,382 | B2 | 4/2013 | Imes |
| 8,416,041 | B2 | 4/2013 | Freakes |
| 8,417,390 | B2 | 4/2013 | Nickerson |
| 8,421,566 | B2 | 4/2013 | Sasao |
| 8,425,020 | B2 | 4/2013 | Borra |
| 8,430,376 | B1 | 4/2013 | Danner |
| 8,432,242 | B2 | 4/2013 | Irwin |
| 8,433,448 | B2 | 4/2013 | Walker |
| 8,436,704 | B1 | 5/2013 | Venkataraghavan |
| 8,437,879 | B2 | 5/2013 | Anderson |
| 8,443,829 | B2 | 5/2013 | Czimmek |
| 8,447,843 | B2 | 5/2013 | Johnson |
| 8,448,916 | B2 | 5/2013 | Kratzer |
| 8,457,798 | B2 | 6/2013 | Hackett |
| 8,465,131 | B2 | 6/2013 | Hibbard |
| 8,469,334 | B2 | 6/2013 | Yamagata |
| 8,474,787 | B2 | 7/2013 | Fink |
| 8,478,871 | B2 | 7/2013 | Gutt |
| 8,485,619 | B2 | 7/2013 | Borra |
| 8,490,646 | B2 | 7/2013 | Bush |
| 8,494,683 | B2 | 7/2013 | Piper |
| 8,496,025 | B2 | 7/2013 | Parsons |
| 8,500,226 | B2 | 8/2013 | Hibbard |
| 8,505,566 | B2 | 8/2013 | Nguyen |
| 8,505,573 | B2 | 8/2013 | Herbert |
| 8,516,087 | B2 | 8/2013 | Wilson |
| 8,527,549 | B2 | 9/2013 | Cidon |

(56) References Cited

U.S. PATENT DOCUMENTS

| | | | |
|---|---|---|---|
| 8,528,834 | B2 | 9/2013 | Skinner |
| 8,529,028 | B2 | 9/2013 | Borra |
| 8,532,831 | B2 | 9/2013 | Crist |
| 8,534,641 | B2 | 9/2013 | Schalowski |
| 8,538,592 | B2 | 9/2013 | Alexanian |
| 8,540,353 | B2 | 9/2013 | Mallory |
| 8,548,632 | B1 | 10/2013 | Porter |
| 8,550,427 | B2 | 10/2013 | Yoshida |
| 8,556,227 | B2 | 10/2013 | Buestgens |
| 8,556,228 | B2 | 10/2013 | Marcichow |
| 8,556,232 | B2 | 10/2013 | Oikawa |
| 8,556,393 | B2 | 10/2013 | Mallory |
| 8,558,653 | B2 | 10/2013 | Wo |
| 8,565,904 | B2 | 10/2013 | Kantor |
| 8,567,755 | B2 | 10/2013 | Najmolhoda |
| 8,573,255 | B2 | 11/2013 | Pifer |
| 8,576,032 | B2 | 11/2013 | Herbert |
| 8,579,251 | B2 | 11/2013 | Ambrosi |
| 8,581,682 | B2 | 11/2013 | Patino |
| 8,584,704 | B2 | 11/2013 | Pifer |
| 8,596,774 | B2 | 12/2013 | Borra |
| 8,600,569 | B2 | 12/2013 | Woytowitz |
| 8,606,415 | B1 | 12/2013 | Woytowitz |
| 8,613,420 | B2 | 12/2013 | Linortner |
| 8,620,480 | B2 | 12/2013 | Alexanian |
| 8,620,481 | B2 | 12/2013 | Holindrake |
| 8,630,743 | B2 | 1/2014 | Marsters |
| 8,632,050 | B2 | 1/2014 | Stoeckel |
| 8,635,350 | B2 | 1/2014 | Gutt |
| 8,636,346 | B2 | 1/2014 | Borra |
| 8,641,177 | B2 | 2/2014 | Borra |
| 8,649,907 | B2 | 2/2014 | Ersavas |
| 8,650,069 | B2 | 2/2014 | Mason, Sr. |
| 8,650,898 | B2 | 2/2014 | Ma |
| 8,651,453 | B2 | 2/2014 | Heyer |
| 8,659,183 | B2 | 2/2014 | Crist |
| 8,659,372 | B2 | 2/2014 | Morimura |
| 8,660,705 | B2 | 2/2014 | Woytowitz |
| 8,662,471 | B2 | 3/2014 | Ohmi |
| 8,662,647 | B2 | 3/2014 | Rosati |
| 8,669,836 | B2 | 3/2014 | Kulke |
| 8,678,343 | B2 | 3/2014 | Czimmek |
| 8,690,118 | B2 | 4/2014 | Bunni |
| 8,695,620 | B2 | 4/2014 | Bush |
| 8,700,222 | B1 | 4/2014 | Woytowitz |
| 8,708,466 | B2 | 4/2014 | Mallory |
| 8,712,592 | B2 | 4/2014 | Carlson |
| 8,714,519 | B2 | 5/2014 | Voss |
| 8,717,133 | B2 | 5/2014 | Ooishi |
| 8,720,400 | B2 | 5/2014 | Dinkel |
| 8,727,511 | B2 | 5/2014 | Mallory |
| 8,733,393 | B2 | 5/2014 | Najmolhoda |
| 8,733,395 | B2 | 5/2014 | Najmolhoda |
| 8,733,908 | B2 | 5/2014 | Borra |
| 8,736,409 | B2 | 5/2014 | Mita |
| 8,738,188 | B2 | 5/2014 | Nickerson |
| 8,738,189 | B2 | 5/2014 | Alexanian |
| D706,389 | S | 6/2014 | Mclauchlan |
| D706,390 | S | 6/2014 | Mclauchlan |
| 8,739,830 | B2 | 6/2014 | Bradbury |
| 8,740,113 | B2 | 6/2014 | Roessle |
| 8,740,177 | B2 | 6/2014 | Walker |
| 8,751,052 | B1 | 6/2014 | Campbell |
| 8,757,209 | B2 | 6/2014 | Morgan |
| 8,757,584 | B2 | 6/2014 | Bill |
| 8,757,586 | B2 | 6/2014 | Gruen |
| 8,757,587 | B2 | 6/2014 | Miura |
| 8,777,388 | B2 | 7/2014 | Borra |
| 8,783,653 | B2 | 7/2014 | Jamison |
| 8,793,024 | B1 | 7/2014 | Woytowitz |
| 8,793,025 | B2 | 7/2014 | Lorenz |
| 8,794,748 | B2 | 8/2014 | Borra |
| 8,807,725 | B2 | 8/2014 | Borra |
| 8,812,007 | B2 | 8/2014 | Hitt |
| 8,817,431 | B2 | 8/2014 | Tomimbang |
| 8,827,236 | B2 | 9/2014 | Mangiafico |
| 8,839,135 | B2 | 9/2014 | Vander Griend |
| 8,840,084 | B2 | 9/2014 | Crist |
| 8,847,716 | B2 | 9/2014 | Fonville |
| 8,849,461 | B2 | 9/2014 | Ersavas |
| 8,851,447 | B2 | 10/2014 | Crist |
| 8,854,165 | B2 | 10/2014 | Irwin |
| 8,862,277 | B1 | 10/2014 | Campbell |
| 8,879,218 | B2 | 11/2014 | Tomimbang |
| 8,880,204 | B2 | 11/2014 | Frei |
| 8,882,247 | B2 | 11/2014 | Borra |
| 8,890,505 | B2 | 11/2014 | Forbes, Jr. |
| 8,909,381 | B2 | 12/2014 | Crist |
| 8,911,621 | B2 | 12/2014 | Lippert |
| 8,924,587 | B2 | 12/2014 | Petite |
| 8,924,891 | B2 | 12/2014 | Hunts |
| 8,930,032 | B2 | 1/2015 | Shupe |
| 8,931,758 | B2 | 1/2015 | Kasagi |
| 8,936,041 | B2 | 1/2015 | Yun |
| 8,944,100 | B2 | 2/2015 | Pifer |
| 8,944,101 | B2 | 2/2015 | Pifer |
| 8,948,921 | B2 | 2/2015 | Halahan |
| 8,955,822 | B2 | 2/2015 | Parsons |
| 8,957,748 | B2 | 2/2015 | Tomimbang |
| 8,960,233 | B2 | 2/2015 | Nishinosono et al. |
| 8,967,746 | B2 | 3/2015 | Borra |
| 8,973,895 | B2 | 3/2015 | Thomas |
| 8,977,400 | B1 | 3/2015 | Porter |
| 8,985,550 | B2 | 3/2015 | Miura |
| 8,991,955 | B2 | 3/2015 | Borra |
| 8,995,098 | B2 | 3/2015 | Tomimbang |
| 8,996,183 | B2 | 3/2015 | Forbes, Jr. |
| 8,998,114 | B2 | 4/2015 | Olivier |
| D728,746 | S | 5/2015 | Mclauchlan |
| D728,747 | S | 5/2015 | Mclauchlan |
| 9,032,998 | B2 | 5/2015 | O'Brien |
| 9,043,036 | B2 | 5/2015 | Fekete |
| 9,049,821 | B1 | 6/2015 | Hanna |
| 9,068,663 | B2 | 6/2015 | Zhang |
| 9,069,337 | B2 | 6/2015 | Forbes, Jr. |
| 9,074,699 | B2 | 7/2015 | Jamison |
| 9,114,365 | B2 | 8/2015 | Schmitt |
| 9,117,577 | B2 | 8/2015 | Zurke |
| 9,127,780 | B2 | 9/2015 | Schnelker |
| 9,130,402 | B2 | 9/2015 | Forbes, Jr. |
| 9,131,642 | B2 | 9/2015 | Groeneveld |
| 9,140,378 | B2 | 9/2015 | Da Pont |
| 9,149,013 | B2 | 10/2015 | Andrews |
| 9,157,545 | B2 | 10/2015 | Czimmek |
| 9,161,499 | B2 | 10/2015 | Bailey |
| 9,169,626 | B2 | 10/2015 | Guler |
| 9,169,941 | B2 | 10/2015 | Lee |
| 9,183,163 | B2 | 11/2015 | Frei |
| 9,184,524 | B2 | 11/2015 | Tomita |
| 9,185,365 | B2 | 11/2015 | Hong |
| 9,192,110 | B2 | 11/2015 | Standerfer |
| 9,201,815 | B2 | 12/2015 | Frei |
| 9,208,676 | B2 | 12/2015 | Fadell |
| 9,222,593 | B1 | 12/2015 | Clark |
| D747,784 | S | 1/2016 | Mclauchlan |
| 9,241,451 | B2 | 1/2016 | Ersavas |
| 9,249,895 | B2 | 2/2016 | Hettinger |
| 9,258,952 | B2 | 2/2016 | Walker |
| D750,746 | S | 3/2016 | Mclauchlan |
| 9,279,756 | B2 | 3/2016 | Bush |
| 9,288,102 | B2 | 3/2016 | Sobhy |
| 9,301,460 | B2 | 4/2016 | Runge |
| 9,305,694 | B2 | 4/2016 | Shimizu |
| 9,343,853 | B2 | 5/2016 | Okada |
| 9,348,338 | B2 | 5/2016 | Nickerson |
| 9,366,351 | B2 | 6/2016 | Engler |
| 9,371,803 | B2 | 6/2016 | Pifer |
| 9,377,123 | B2 | 6/2016 | Kibune |
| 9,389,157 | B2 | 7/2016 | Bush |
| 9,395,010 | B2 | 7/2016 | Jamison |
| 9,416,883 | B2 | 8/2016 | Van Den Bijgaart |
| 9,425,978 | B2 | 8/2016 | Frei |
| 9,435,460 | B2 | 9/2016 | Herbert |
| 9,470,332 | B2 | 10/2016 | Miura |

(56) References Cited

U.S. PATENT DOCUMENTS 9,488,097 B2 11/2016 Steinman
9,493,936 B2 11/2016 Bush
9,500,291 B2 11/2016 Lee
9,528,626 B2 12/2016 Holmes
9,551,427 B2 1/2017 Van Den Bijgaart
9,583,248 B2 2/2017 Toda
9,598,847 B2 3/2017 Marcichow
9,602,655 B2 3/2017 Shamoon
9,627,121 B2 4/2017 Peterson
9,631,736 B2 4/2017 Kus
9,665,106 B2 5/2017 Lorenz
9,678,485 B2 6/2017 Malaugh
9,679,690 B2 6/2017 Nila
9,681,610 B2 6/2017 Crist
9,683,472 B2 6/2017 Thomas
9,703,275 B2 7/2017 Ersavas
9,704,122 B2 7/2017 Jung
9,733,274 B2 8/2017 Pietrowicz
9,746,097 B1 8/2017 Ishii
9,756,797 B2 9/2017 Sarver
9,763,393 B2 9/2017 Parsons
9,766,609 B2 9/2017 Kah, Jr.
9,781,887 B2 10/2017 Woytowitz
9,800,463 B2 10/2017 Imes
9,814,190 B1 11/2017 Stange
9,822,514 B2 11/2017 Parsons
9,829,869 B2 11/2017 Ersavas
9,832,939 B2 12/2017 Russell
9,872,445 B2 1/2018 Cline
9,890,747 B2 2/2018 Williams
9,927,045 B2 3/2018 Morgan
9,945,492 B2 4/2018 Timmermans
9,970,566 B2 5/2018 Rovera
9,978,553 B2 5/2018 Tomimbang
10,006,412 B2 6/2018 Park
10,024,448 B2 7/2018 Watanabe
10,041,396 B2 8/2018 Lenk
10,041,401 B2 8/2018 Lenk
10,058,042 B2 8/2018 Crist
D829,304 S 9/2018 Mclauchlan
10,070,596 B2 9/2018 Crist
10,082,219 B2 9/2018 Birkelund
10,125,890 B2 11/2018 Bähr
10,139,006 B2 11/2018 Muraoka
10,151,399 B2 12/2018 Muraoka
10,188,050 B2 1/2019 Walker
10,190,555 B2 1/2019 Takaoku
10,208,726 B2 2/2019 Oikawa
10,208,871 B2 2/2019 Chiapasco
10,214,191 B2 2/2019 Dreyer
10,221,957 B2 3/2019 Ohta
10,233,884 B2 3/2019 Tamura
10,253,682 B2 4/2019 Lenk
10,253,902 B2 4/2019 Warashina
10,260,644 B2 4/2019 Bonanno
10,267,283 B2 4/2019 Yasukawa
10,273,868 B2 4/2019 Komuro
10,283,245 B2 5/2019 Nagasaka
10,288,188 B2 5/2019 Schieweck
10,302,054 B2 5/2019 Kaneta
10,352,471 B2 7/2019 Kus
10,362,739 B2 7/2019 Ersavas
10,388,446 B2 8/2019 Ott
10,390,502 B2 8/2019 Lorenz
10,400,725 B2 9/2019 Schulz
10,424,869 B2 9/2019 Lee
10,473,229 B2 11/2019 Landacre
10,502,337 B2 12/2019 Koyama
10,508,964 B2 12/2019 Ambrose
10,533,678 B2 1/2020 Levien
10,563,788 B2 2/2020 Fluehs
10,584,802 B2 3/2020 Chen
10,641,409 B2 5/2020 Fukuzawa
10,690,097 B2 6/2020 Sugaya
10,716,269 B2 7/2020 Ersavas
10,753,503 B2 8/2020 Ramler
10,787,160 B2 9/2020 Kurz
10,851,907 B2 12/2020 Wardle
10,871,242 B2 12/2020 Markley
10,876,648 B2 12/2020 Kus
10,907,740 B2 2/2021 Layne
10,962,136 B2 3/2021 Tolentino
10,978,233 B2 4/2021 Uemura
11,060,629 B2 7/2021 Murata
11,108,317 B2 8/2021 Chalvignac
11,193,606 B2 12/2021 Lan
11,201,005 B2 12/2021 Deland
2001/0049563 A1 12/2001 Addink
2002/0013679 A1 1/2002 Petite
2002/0031101 A1 3/2002 Petite
2002/0035414 A1 3/2002 Morikawa
2002/0088875 A1 7/2002 Sirkin
2002/0091452 A1 7/2002 Addink
2002/0096655 A1 7/2002 Balsdon
2002/0130287 A1 9/2002 Smith
2002/0138969 A1 10/2002 Dallmeyer
2002/0145125 A1 10/2002 Tomoda
2002/0166986 A1 11/2002 Remby
2002/0169643 A1 11/2002 Petite
2003/0036810 A1 2/2003 Petite
2003/0042451 A1 3/2003 Bendzinski
2003/0051759 A1 3/2003 Schmidt
2003/0102453 A1 6/2003 Fukano
2003/0179102 A1 9/2003 Barnes
2003/0201675 A1 10/2003 Alexanian
2004/0020538 A1 2/2004 Antunez
2004/0046137 A1 3/2004 Herbert
2004/0051069 A1 3/2004 Miyazoe
2004/0070302 A1 4/2004 Parker
2004/0086053 A1 5/2004 Anderson
2004/0090329 A1 5/2004 Hitt
2004/0100394 A1 5/2004 Hitt
2005/0000579 A1 1/2005 Burrola
2005/0055106 A1 3/2005 Beutler
2005/0090936 A1 4/2005 Hitt
2005/0098752 A1 5/2005 Burrola
2005/0150560 A1 7/2005 Amato
2005/0156067 A1 7/2005 Ivans
2005/0156068 A1 7/2005 Ivans
2005/0192710 A1 9/2005 Thornton
2005/0225418 A1* 10/2005 Tran-Ngoc ..... H01F 7/06
336/198
2006/0029060 A1 2/2006 Pister
2006/0029061 A1 2/2006 Pister
2006/0049271 A1 3/2006 Hitt
2006/0076527 A1 4/2006 Bush
2006/0108552 A1 5/2006 Herbert
2006/0178847 A1 8/2006 Glancy
2006/0184285 A1 8/2006 Evelyn-Veere
2006/0185654 A1 8/2006 Modien
2006/0271297 A1 11/2006 Repelli
2006/0272830 A1 12/2006 Fima
2006/0282467 A1 12/2006 Peterson
2007/0010915 A1 1/2007 Burson
2007/0016334 A1 1/2007 Smith
2007/0057217 A1 3/2007 Kamidate
2007/0088462 A1 4/2007 Peleg
2007/0140274 A1 6/2007 Battistutto
2007/0191991 A1 8/2007 Addink
2007/0203860 A1 8/2007 Golden
2007/0221750 A1 9/2007 Roberts
2007/0222581 A1 9/2007 Hawkins
2007/0239317 A1 10/2007 Bogolea
2007/0257757 A1 11/2007 Kolb
2007/0261245 A1 11/2007 Hayashi
2007/0291689 A1 12/2007 Kapur
2008/0001595 A1 1/2008 Ha
2008/0027586 A1 1/2008 Hern
2008/0027587 A1 1/2008 Nickerson
2008/0033775 A1 2/2008 Dawson
2008/0040509 A1 2/2008 Werb
2008/0097653 A1 4/2008 Kaprielian
2008/0119948 A1 5/2008 O'Connor
2008/0129495 A1 6/2008 Hitt

(56) References Cited

U.S. PATENT DOCUMENTS

| | | | |
|---|---|---|---|
| 2008/0136620 | A1 | 6/2008 | Lee |
| 2008/0147205 | A1 | 6/2008 | Ollis |
| 2008/0148725 | A1 | 6/2008 | Jacobsen |
| 2008/0157995 | A1 | 7/2008 | Crist |
| 2008/0183842 | A1 | 7/2008 | Raji |
| 2008/0199359 | A1 | 8/2008 | Davis |
| 2008/0204176 | A1 | 8/2008 | Sriraksat |
| 2008/0253327 | A1 | 10/2008 | Kohvakka |
| 2008/0272208 | A1 | 11/2008 | Anderson |
| 2008/0288116 | A1 | 11/2008 | Nickerson |
| 2008/0289693 | A1 | 11/2008 | Irwin |
| 2008/0297288 | A1 | 12/2008 | Irwin |
| 2008/0302172 | A1 | 12/2008 | Kates |
| 2008/0309441 | A1 | 12/2008 | Anderson |
| 2009/0007706 | A1 | 1/2009 | Hitt |
| 2009/0008471 | A1 | 1/2009 | Wilson |
| 2009/0008472 | A1 | 1/2009 | Wilson |
| 2009/0043427 | A1 | 2/2009 | Addink |
| 2009/0094097 | A1 | 4/2009 | Gardenswartz |
| 2009/0099701 | A1 | 4/2009 | Li |
| 2009/0101855 | A1 | 4/2009 | Nguyen |
| 2009/0120521 | A1 | 5/2009 | Clark |
| 2009/0121049 | A1 | 5/2009 | Flynn |
| 2009/0138105 | A1 | 5/2009 | Crawford |
| 2009/0138131 | A1 | 5/2009 | Uy |
| 2009/0145974 | A1 | 6/2009 | Fekete |
| 2009/0150001 | A1 | 6/2009 | Fekete |
| 2009/0150002 | A1 | 6/2009 | Fekete |
| 2009/0168678 | A1 | 7/2009 | Han |
| 2009/0177330 | A1 | 7/2009 | Kah |
| 2009/0211096 | A1 | 8/2009 | Seitter |
| 2009/0212248 | A1 | 8/2009 | Kozak |
| 2009/0217189 | A1 | 8/2009 | Martin |
| 2009/0217194 | A1 | 8/2009 | Martin |
| 2009/0222140 | A1 | 9/2009 | Christiansen |
| 2009/0223128 | A1 | 9/2009 | Kuschak |
| 2009/0267008 | A1 | 10/2009 | Lucas |
| 2009/0276102 | A1 | 11/2009 | Smith |
| 2009/0281672 | A1 | 11/2009 | Pourzia |
| 2009/0291575 | A1 | 11/2009 | Henry |
| 2009/0302870 | A1 | 12/2009 | Paterson |
| 2009/0308460 | A1 | 12/2009 | Tschurtz |
| 2009/0309755 | A1 | 12/2009 | Williamson |
| 2009/0328176 | A1 | 12/2009 | Martin |
| 2010/0001223 | A1 | 1/2010 | Tschurtz |
| 2010/0004789 | A1 | 1/2010 | Savelle |
| 2010/0019181 | A1 | 1/2010 | Herbert |
| 2010/0038440 | A1 | 2/2010 | Ersavas |
| 2010/0049563 | A1 | 2/2010 | Lopez Seco |
| 2010/0059698 | A1 | 3/2010 | Guggenmos |
| 2010/0078584 | A1 | 4/2010 | Van Den Bijgaart |
| 2010/0082169 | A1 | 4/2010 | Crist |
| 2010/0082744 | A1 | 4/2010 | Raji |
| 2010/0084591 | A1 | 4/2010 | Shiao |
| 2010/0094923 | A1 | 4/2010 | Martinez |
| 2010/0097733 | A1 | 4/2010 | E. |
| 2010/0109685 | A1 | 5/2010 | Morton |
| 2010/0111727 | A1 | 5/2010 | Yamagata |
| 2010/0122733 | A1 | 5/2010 | Grygus |
| 2010/0123535 | A1 | 5/2010 | Yamagata |
| 2010/0131119 | A1 | 5/2010 | Brundisini |
| 2010/0155638 | A1 | 6/2010 | Zurke |
| 2010/0161144 | A1 | 6/2010 | Crist |
| 2010/0179701 | A1 | 7/2010 | Gilbert |
| 2010/0187457 | A1 | 7/2010 | Kratzer |
| 2010/0187458 | A1 | 7/2010 | Ueda |
| 2010/0193720 | A1 | 8/2010 | Cripps |
| 2010/0198712 | A1 | 8/2010 | Benisti |
| 2010/0218833 | A1 | 9/2010 | Bush |
| 2010/0251807 | A1 | 10/2010 | Morton |
| 2010/0252760 | A1 | 10/2010 | Hettinger |
| 2010/0252769 | A1 | 10/2010 | Goepfert |
| 2010/0256827 | A1 | 10/2010 | Bragg |
| 2010/0268391 | A1 | 10/2010 | Anderson |
| 2010/0269923 | A1 | 10/2010 | Parsons |
| 2010/0289411 | A1 | 11/2010 | Smits |
| 2010/0294971 | A1 | 11/2010 | Hajjar |
| 2010/0308245 | A1 | 12/2010 | Fink |
| 2010/0313980 | A1 | 12/2010 | Shimizu |
| 2010/0314567 | A1 | 12/2010 | Uechi |
| 2010/0324987 | A1 | 12/2010 | Benisti |
| 2010/0325005 | A1 | 12/2010 | Benisti |
| 2010/0327199 | A1 | 12/2010 | Linortner |
| 2011/0001072 | A1 | 1/2011 | Tagata |
| 2011/0005481 | A1 | 1/2011 | Dinkel |
| 2011/0011783 | A1 | 1/2011 | Lippert |
| 2011/0012041 | A1 | 1/2011 | De Santis |
| 2011/0015794 | A1 | 1/2011 | Lorenz |
| 2011/0024665 | A1 | 2/2011 | Hajjar |
| 2011/0037006 | A1 | 2/2011 | Zurke |
| 2011/0042598 | A1 | 2/2011 | Kozak |
| 2011/0043230 | A1 | 2/2011 | Morton |
| 2011/0049405 | A1 | 3/2011 | Bill |
| 2011/0054642 | A1 | 3/2011 | Bondar |
| 2011/0057133 | A1 | 3/2011 | Nisinosono |
| 2011/0062361 | A1 | 3/2011 | Yoshida |
| 2011/0068286 | A1 | 3/2011 | Nomichi |
| 2011/0073188 | A1 | 3/2011 | Marcus |
| 2011/0073788 | A1 | 3/2011 | Marcus |
| 2011/0073791 | A1 | 3/2011 | Oikawa |
| 2011/0077785 | A1 | 3/2011 | Nickerson |
| 2011/0079740 | A1 | 4/2011 | Bill |
| 2011/0080240 | A1 | 4/2011 | Patino |
| 2011/0111700 | A1 | 5/2011 | Hackett |
| 2011/0121217 | A1 | 5/2011 | Ohmi |
| 2011/0147629 | A1 | 6/2011 | Gruen |
| 2011/0148552 | A1 | 6/2011 | Tomimbang |
| 2011/0148555 | A1 | 6/2011 | Sasao |
| 2011/0155934 | A1 | 6/2011 | Guler |
| 2011/0168813 | A1 | 7/2011 | Bunni |
| 2011/0168929 | A1 | 7/2011 | Buestgens |
| 2011/0180464 | A1 | 7/2011 | Schmitt |
| 2011/0180736 | A1 | 7/2011 | Mangiafico |
| 2011/0186760 | A1 | 8/2011 | Michl |
| 2011/0190947 | A1 | 8/2011 | Savelle |
| 2011/0190948 | A1 | 8/2011 | Fekete |
| 2011/0198522 | A1 | 8/2011 | Ambrosi |
| 2011/0204272 | A1 | 8/2011 | Kratzer |
| 2011/0215271 | A1 | 9/2011 | Voss |
| 2011/0224836 | A1 | 9/2011 | Hern |
| 2011/0227676 | A1 | 9/2011 | Cotic |
| 2011/0248198 | A1 | 10/2011 | Huang |
| 2011/0248805 | A1 | 10/2011 | Hamaoka |
| 2011/0279576 | A1 | 11/2011 | Borra |
| 2011/0279577 | A1 | 11/2011 | Borra |
| 2011/0279579 | A1 | 11/2011 | Borra |
| 2011/0301767 | A1 | 12/2011 | Alexanian |
| 2011/0302708 | A1 | 12/2011 | Parsons |
| 2012/0068096 | A1 | 3/2012 | Herbert |
| 2012/0078425 | A1 | 3/2012 | Gardenswartz |
| 2012/0085950 | A1 | 4/2012 | Lorenz |
| 2012/0089259 | A1 | 4/2012 | Williams |
| 2012/0089373 | A1 | 4/2012 | Hong |
| 2012/0109387 | A1 | 5/2012 | Martin |
| 2012/0132296 | A1 | 5/2012 | Parsons |
| 2012/0205568 | A1 | 8/2012 | Bush |
| 2012/0221718 | A1 | 8/2012 | Imes |
| 2012/0222634 | A1 | 9/2012 | Dinkel |
| 2012/0266095 | A1 | 10/2012 | Killian |
| 2012/0290139 | A1 | 11/2012 | Brundisini |
| 2013/0002012 | A1 | 1/2013 | Korol |
| 2013/0025721 | A1 | 1/2013 | Yun |
| 2013/0035774 | A1 | 2/2013 | Warren |
| 2013/0048746 | A1 | 2/2013 | Littrell |
| 2013/0061380 | A1 | 3/2013 | Parsons |
| 2013/0061381 | A1 | 3/2013 | Parsons |
| 2013/0063231 | A1 | 3/2013 | Tomimbang |
| 2013/0085619 | A1 | 4/2013 | Howard |
| 2013/0110293 | A1 | 5/2013 | Illig |
| 2013/0190934 | A1 | 7/2013 | Holindrake |
| 2013/0264506 | A1 | 10/2013 | Schnelker |
| 2013/0264507 | A1 | 10/2013 | Schnelker |
| 2013/0274932 | A1 | 10/2013 | Curren |
| 2013/0284960 | A1 | 10/2013 | Schnelker |

(56) References Cited

U.S. PATENT DOCUMENTS

| | | | |
|---|---|---|---|
| 2013/0306891 | A1 | 11/2013 | Fietz |
| 2013/0310992 | A1 | 11/2013 | Larsen |
| 2013/0318231 | A1 | 11/2013 | Raji |
| 2014/0005810 | A1 | 1/2014 | Frei |
| 2014/0005843 | A1 | 1/2014 | Thomas |
| 2014/0005851 | A1 | 1/2014 | Frei |
| 2014/0006506 | A1 | 1/2014 | Frei |
| 2014/0018965 | A1 | 1/2014 | Pearson |
| 2014/0020379 | A1 | 1/2014 | Steinman |
| 2014/0020663 | A1 | 1/2014 | Pifer |
| 2014/0081471 | A1 | 3/2014 | Woytowitz |
| 2014/0084194 | A1 | 3/2014 | Kibune |
| 2014/0088770 | A1 | 3/2014 | Masters |
| 2014/0129039 | A1 | 5/2014 | Olive-Chahinian |
| 2014/0143397 | A1 | 5/2014 | Gutt |
| 2014/0172180 | A1 | 6/2014 | Woytowitz |
| 2014/0203200 | A1 | 7/2014 | Da Silva |
| 2014/0222223 | A1 | 8/2014 | Horton |
| 2014/0229024 | A1 | 8/2014 | Wang |
| 2014/0236868 | A1 | 8/2014 | Cook |
| 2014/0239211 | A1 | 8/2014 | Morgan |
| 2014/0245160 | A1 | 8/2014 | Bauer |
| 2014/0264114 | A1 | 9/2014 | Farace |
| 2014/0361206 | A1 | 12/2014 | Holmes |
| 2014/0367595 | A1 | 12/2014 | Miura |
| 2014/0374512 | A1 | 12/2014 | Honjo |
| 2015/0019031 | A1 | 1/2015 | Crist |
| 2015/0047897 | A1 | 2/2015 | Zimet |
| 2015/0088324 | A1 | 3/2015 | Crist |
| 2015/0102243 | A1 | 4/2015 | Timmermans |
| 2015/0279538 | A1 | 10/2015 | Toda |
| 2015/0280541 | A1 | 10/2015 | Ando |
| 2015/0380143 | A1 | 12/2015 | Saiki |
| 2016/0092600 | A1 | 3/2016 | Chan |
| 2016/0123490 | A1 | 5/2016 | Mclauchlan |
| 2016/0157446 | A1 | 6/2016 | Bentwich |
| 2016/0295819 | A1 | 10/2016 | Porter |
| 2017/0081028 | A1 | 3/2017 | Jones |
| 2017/0191580 | A1 | 7/2017 | Pifer |
| 2017/0223911 | A1 | 8/2017 | Lorenz |
| 2017/0234445 | A1 | 8/2017 | Watanabe |
| 2017/0367277 | A1 | 12/2017 | Mohindra |
| 2017/0370495 | A1* | 12/2017 | Markley ..... H01F 7/128 |
| 2018/0231139 | A1 | 8/2018 | Morgan |
| 2018/0279566 | A1 | 10/2018 | Wlassich |
| 2018/0332784 | A1 | 11/2018 | Crist |
| 2018/0338436 | A1 | 11/2018 | Crist |
| 2018/0341764 | A1 | 11/2018 | Chou |
| 2018/0368261 | A1 | 12/2018 | Kwak |
| 2019/0078543 | A1 | 3/2019 | Yamazaki |
| 2019/0195383 | A1 | 6/2019 | Nasser |
| 2020/0055509 | A1 | 2/2020 | Stahr |
| 2020/0056718 | A1 | 2/2020 | Hein |
| 2020/0118736 | A1 | 4/2020 | Rao |
| 2020/0278045 | A1 | 9/2020 | Nishimura |
| 2020/0340598 | A1 | 10/2020 | Saito |
| 2020/0408324 | A1 | 12/2020 | Bonanno |
| 2021/0010612 | A1 | 1/2021 | Marcantonio |
| 2021/0188080 | A1 | 6/2021 | Bhandari |
| 2021/0199045 | A1 | 7/2021 | Bhandari |
| 2021/0239232 | A1 | 8/2021 | Bhandari |
| 2021/0254742 | A1 | 8/2021 | Zhang |
| 2021/0278007 | A1 | 9/2021 | Sasao |
| 2021/0278008 | A1 | 9/2021 | Sasao |
| 2021/0287839 | A1 | 9/2021 | Lee |
| 2021/0317776 | A1 | 10/2021 | Bonanno |
| 2021/0327626 | A1 | 10/2021 | Sasao |
| 2021/0335530 | A1 | 10/2021 | Tresso |
| 2021/0348695 | A1 | 11/2021 | Bonanno |
| 2021/0381616 | A1 | 12/2021 | Thode |

FOREIGN PATENT DOCUMENTS

| | | | |
|---|---|---|---|
| CN | 1511383 | | 7/2004 |
| CN | 101021729 | A | 8/2007 |
| CN | 101849494 | A | 10/2010 |
| CN | 102483628 | A | 5/2012 |
| CN | 101849494 | B | 11/2014 |
| CN | 102483628 | B | 3/2016 |
| DE | 102011055586 | A1 | 5/2013 |
| EP | 0748584 | A1 | 12/1996 |
| EP | 1324166 | A2 | 7/2003 |
| EP | 1763990 | A2 | 3/2007 |
| EP | 1798907 | | 6/2007 |
| EP | 2215906 | A1 | 8/2010 |
| EP | 2281445 | | 2/2011 |
| EP | 2281445 | A2 | 2/2011 |
| EP | 3010027 | A2 | 4/2016 |
| EP | 3301692 | A1 | 4/2018 |
| ES | 2209614 | A1 | 6/2004 |
| GB | 2177582 | A | 1/1987 |
| JP | 2010034223 | A | 2/2010 |
| TR | 200900883 | A2 | 2/2009 |
| TR | 200805998 | A2 | 12/2009 |
| WO | 8606579 | A1 | 11/1986 |
| WO | 9708942 | A1 | 3/1997 |
| WO | 1999039567 | | 8/1999 |
| WO | 2001095277 | | 12/2001 |
| WO | 0235193 | A2 | 5/2002 |
| WO | 02058254 | A1 | 7/2002 |
| WO | 2004040415 | A2 | 5/2004 |
| WO | 2005002321 | A2 | 1/2005 |
| WO | 2007104152 | A2 | 9/2007 |
| WO | 2007131169 | | 11/2007 |
| WO | 2009132425 | A1 | 11/2009 |
| WO | 2010019109 | | 2/2010 |
| WO | 2011017059 | A2 | 2/2011 |
| WO | 2011044289 | | 4/2011 |
| WO | 2012153893 | A1 | 11/2012 |
| WO | 2016007159 | A1 | 1/2016 |
| WO | 2016027506 | A1 | 2/2016 |
| WO | 2019211820 | A1 | 11/2019 |

OTHER PUBLICATIONS

Akyildiz et al., "Wireless sensor networks: a survey," Computer Networks 38 (2002) 393-422.

EPO; App. No. 06018783.8; Extended European Search Report dated Nov. 5, 2012; 14 pages.

EPO; App. No. 10 170 920; Exam Report dated Dec. 19, 2012; 6 pages.

EPO; App. No. 10822643.2; Extended European Search Report dated Nov. 17, 2014.

EPO; App. No. EP 06018783; Supplementary Partial European Search Report dated Dec. 15, 2011; 7 pages.

EPO; App. No. EP 10170920.2; European Search Report dated Mar. 8, 2012; 7 pages.

EPO; App. No. EP09180196; Extended European Search Report dated Apr. 9, 2010; 7 pages.

European Patent Office, Extended European Search Report for European Application No. 17177629.7 dated Nov. 8, 2017, 8 pages.

Intel, "Instrumenting the World: An Introduction to Wireless Sensor Networks," Version 1, Feb. 2004.

Li, "Study on Precision Agriculture Monitoring Framework Based on WSN," Anti-counterfeiting, Security, and Identification, 2nd International Conference, 2008, 182-185.

Microchip Technology Inc.; PIC/16F631/677/685/687,689/690 Data Sheet; 20-Pin Flash-Based, 8-Bit CMOS Microcontrollers with Nano Watt Technology; 2006; 294 pages.

Nokia, "Machine-to-Machine," White Paper (2004).

PCT; App. No. PCT/TR2009/000103; International Report on Patentability dated Feb. 24, 2011.

PCT; App. No. PCT/TR2009/000103; International Search Report dated Feb. 1, 2010.

PCT; App. No. PCT/TR2009/000103; Written Opinion dated Feb. 12, 2011.

PCT; App. No. PCT/US2010/043273; International Search Report dated Mar. 2, 2011; 3 pages.

PCT; App. No. PCT/US2010/043273; Written Opinion of the International Searching Authority dated Mar. 2, 2011; 3 pages.

(56) References Cited

OTHER PUBLICATIONS

PCT; International Search Report corresponding to International Application No. PCT/US2007/068242; dated Jul. 28, 2008; 4 Pages.
PCT; International Search Report corresponding to International Application No. PCT/US2010/051699; dated Nov. 30, 2010; 2 Pages.
PCT; Written Opinion of the International Searching Authority corresponding to International Application No. PCT/US2010/051699; dated Nov. 30, 2010; 8 Pages.
Rain Bird Corporation IC System Design Guide v2.3, updated Aug. 2016, 21 pages.
Rain Bird Corporation IC System Operation and Troubleshooting Guide, Jul. 2009, 27 pages.
Rain Bird Corporation, IC System Installation Guide, Jul. 2009, 19 pages.
Rain Bird, 'FD Field Decoders: Rain Bird Decoders', Feb. 17, 2005, pp. 1-4, printed from www.rainbird.com/golf/products/centralcontrol/decoders.htm, Rain Bird Corporation, Glendora, CA.
Rain Bird, 'Full/Part Circle Roters', Oct. 2004, pp. 1-4, Catalog No. 438, Rain Bird Corporation, Glendora, CA.
Rain Bird, 'Tech Specs: Rain Bird Decoders', Oct. 2004, Rain Bird Corporation Golf Division, Tucson, AZ; 2 pages.
Rain Bird, "Master Parts Book 2008-2009", Jan. 2008, pp. 129-130, 140, Rain Bird Corporation, Parts and Service Center, Azusa, CA.
Rain Bird, "Maxicom2 Decoders: SENSOR-PULSE", Sep. 2002, pp. 1-2, Rain Bird Corporation, Azusa, CA.
Rain Bird, "Rain Bird Latching Solenoid: Part No. 231831", 1999, Rain Bird Corporation, Tucson, AZ, 1 page.
Rain Bird, "Rain Bird MDC Decoder-based Control System", Jan. 2006, pp. 1-4, Rain Bird Corporation, Azusa, CA.
SIPO; App. No 200911000193.6; Office Action dated Nov. 5, 2012; 23 pages.
SIPO; App. No. 201080037966.2; Office Action and partial summary translation provided by Chinese Associate dated Jan. 6, 2014; 6 pages.
SIPO; App. No. 201080037966.2; Office Action dated Sep. 3, 2014; 14 pages.
The Toro Company; "Golf Decoder Control System (GDC)"; http://web.archive.org/web/20070625035525/www.toro.com/irrigation/golf/lgturffield/gdc/index.html; Available at least as early as Jun. 25, 2007, pp. 66.
U.S. Appl. No. 16/992,962, filed Aug. 13, 2020, Michael James Tennyson et al., entitled Wireless Irrigation Control.
USPTO, U.S. Appl. No. 09/592,907, filed Jun. 13, 2000, entitled "Canister Purge Valve For High Regeneration Airflow," abandoned.
USPTO; U.S. Appl. No. 13/844,304; Office Action dated Oct. 16, 2015.
USPTO; U.S. Appl. No. 13/500,882 ; Office Action dated Dec. 18, 2014.
USPTO; U.S. Appl. No. 11/228,413; Examiner Interview Summary dated Apr. 22, 2009; 2 pages.
USPTO; U.S. Appl. No. 11/228,413; Examiner Interview Summary dated Dec. 7, 2009; 2 pages.
USPTO; U.S. Appl. No. 11/228,413; Notice of Allowance dated Jun. 18, 2010; 8 pages.
USPTO; U.S. Appl. No. 11/228,413; Notice of Panel Decision from Pre-Appeal Brief Review dated Apr. 28, 2010; 2 pages.
USPTO; U.S. Appl. No. 11/228,413; Office Action dated Apr. 2, 2008; 12 pages.
USPTO; U.S. Appl. No. 11/228,413; Office Action dated May 20, 2009; 10 pages.
USPTO; U.S. Appl. No. 11/228,413; Office Action dated Dec. 2, 2008; 9 pages.
USPTO; U.S. Appl. No. 11/228,413; Office Action dated Dec. 7, 2009; 12 pages.
USPTO; U.S. Appl. No. 11/228,413; Supplemental Notice of Allowance dated Aug. 5, 2010; 4 pages.
USPTO; U.S. Appl. No. 11/228,413; Supplemental Notice of Allowance dated Sep. 2, 2010; 4 pages.
USPTO; U.S. Appl. No. 12/505,397; Office Action dated Feb. 13, 2013; 16 pages.
USPTO; U.S. Appl. No. 12/505,401; Notice of Allowance dated May 7, 2012; 5 pages.
USPTO; U.S. Appl. No. 12/505,401; Office Action dated Oct. 31, 2011; 14 pages.
USPTO; U.S. Appl. No. 12/510,111; Notice of Allowance dated Apr. 2, 2014; 12 pages.
USPTO; U.S. Appl. No. 12/510,111; Notice of Allowance dated May 16, 2014; 9 pages.
USPTO; U.S. Appl. No. 12/510,111; Office Action dated Jun. 4, 2013; 22 pages.
USPTO; U.S. Appl. No. 12/510,111; Office Action dated Oct. 16, 2012; 12 pages.
USPTO; U.S. Appl. No. 12/510,111; Office Action dated Dec. 27, 2013; 18 pages.
USPTO; U.S. Appl. No. 12/510,111; Office Action dated Feb. 29, 2012; 21 pages.
USPTO; U.S. Appl. No. 12/510,118; Notice of Allowance dated Apr. 2, 2014; 5 pages.
USPTO; U.S. Appl. No. 12/510,118; Notice of Allowance dated May 16, 2014; 9 pages.
USPTO; U.S. Appl. No. 12/510,118; Office Action dated Jun. 5, 2013; 20 pages.
USPTO; U.S. Appl. No. 12/510,118; Office Action dated Oct. 16, 2012; 15 pages.
USPTO; U.S. Appl. No. 12/510,118; Office Action dated Dec. 30, 2013; 17 pages.
USPTO; U.S. Appl. No. 12/510,118; Office Action dated Feb. 29, 2012; 21 pages.
USPTO; U.S. Appl. No. 12/537,772; Office Action dated Mar. 21, 2013.
USPTO; U.S. Appl. No. 12/537,772; Office Action dated Dec. 29, 2011.
USPTO; U.S. Appl. No. 12/849,488; Notice of Allowance dated Feb. 22, 2013.
USPTO; U.S. Appl. No. 12/849,488; Notice of Allowance dated Jul. 3, 2013.
USPTO; U.S. Appl. No. 12/849,488; Notice of Allowance dated Oct. 28, 2013.
USPTO; U.S. Appl. No. 12/849,488; Office Action dated Jun. 22, 2012.
USPTO; U.S. Appl. No. 12/866,471; Office Action dated Mar. 17, 2011; 18 pages.
USPTO; U.S. Appl. No. 12/886,471; Notice of Allowance dated Sep. 20, 2011; 7 pages.
USPTO; U.S. Appl. No. 12/886,471; Supplemental Notice of Allowance dated Oct. 19, 2011; 3 pages.
USPTO; U.S. Appl. No. 13/151,269; Office Action dated Jan. 18, 2012.
USPTO; U.S. Appl. No. 13/332,337; Notice of Allowance dated Mar. 13, 2014; 11 pages.
USPTO; U.S. Appl. No. 13/332,337; Notice of Allowance dated Dec. 6, 2013; 11 pages.
USPTO; U.S. Appl. No. 13/500,882; Notice of Allowance dated Oct. 5, 2015.
USPTO; U.S. Appl. No. 13/500,882; Office Action dated Apr. 3, 2015.
USPTO; U.S. Appl. No. 13/532,557; Notice of Allowance dated Apr. 4, 2017.
USPTO; U.S. Appl. No. 13/532,557; Notice of Allowance dated Jul. 31, 2017; (pp. 1-8).
USPTO; U.S. Appl. No. 13/532,557; Office Action dated Sep. 9, 2016.
USPTO; U.S. Appl. No. 13/532,557; Office Action dated Jan. 2, 2015.
USPTO; U.S. Appl. No. 13/532,557; Office Action dated Oct. 15, 2015.
USPTO; U.S. Appl. No. 13/570,139; Notice of Allowance dated May 9, 2013; 15 pages.
USPTO; U.S. Appl. No. 13/570,139; Office Action dated Dec. 26, 2012; 8 pages.

(56) References Cited

OTHER PUBLICATIONS

USPTO; U.S. Appl. No. 13/844,248; Notice of Allowance dated May 22, 2014, 2014.
USPTO; U.S. Appl. No. 13/844,304; Notice of Allowance dated Mar. 6, 2017.
USPTO; U.S. Appl. No. 13/844,304; Office Action dated Oct. 3, 2016.
USPTO; U.S. Appl. No. 13/844,304; Office Action dated Dec. 30, 2014.
USPTO; U.S. Appl. No. 13/963,966; Notice of Allowance dated Aug. 6, 2014; 7 pages.
USPTO; U.S. Appl. No. 13/963,966; Office Action dated Feb. 6, 2014; 16 pages.
USPTO; U.S. Appl. No. 14/304,502; Notice of Allowance dated Jan. 27, 2017; 8 pages.
USPTO; U.S. Appl. No. 14/304,502; Office Action dated Jul. 12, 2016; 12 pages.
USPTO; U.S. Appl. No. 14/466,469; Notice of Allowance dated Sep. 11, 2015.
USPTO; U.S. Appl. No. 14/466,469; Office Action dated Dec. 29, 2014.
USPTO; U.S. Appl. No. 14/493,106, filed Sep. 22, 2014, entitled "Integrated Control Circuitry And Coil Assembly For Irrigation Control," (57 pages).
USPTO; U.S. Appl. No. 14/493,106; Notice of Allowance dated Apr. 30, 2018.
USPTO; U.S. Appl. No. 14/493,106; Office Action dated Apr. 21, 2016; 14 pages.
USPTO; U.S. Appl. No. 14/493,106; Office Action dated Sep. 22, 2017.
USPTO; U.S. Appl. No. 14/493,106; Office Action dated Oct. 11, 2016; 9 pages.
USPTO; U.S. Appl. No. 14/507,751, filed Oct. 6, 2014, entitled "Integrated Control Circuitry And Coil Assembly For Irrigation Control," (57 pages).
USPTO; U.S. Appl. No. 14/507,751; Notice of Allowance dated Feb. 21, 2017; 8 pages.
USPTO; U.S. Appl. No. 14/507,751; Notice of Allowance dated Oct. 12, 2016; 6 pages.
USPTO; U.S. Appl. No. 14/507,751; Office Action dated Apr. 19, 2016; 14 pages.
USPTO; U.S. Appl. No. 14/970,349; Notice of Allowance dated Mar. 25, 2019; (pp. 1-10).
USPTO; U.S. Appl. No. 14/970,349; Notice of Allowance dated Oct. 2, 2018; (pp. 1-9).
USPTO; U.S. Appl. No. 14/970,349; Office Action dated Feb. 8, 2018; (pp. 1-10).
USPTO; U.S. Appl. No. 14/989,771; Notice of Allowance dated Sep. 13, 2018.
USPTO; U.S. Appl. No. 14/989,771; Office Action dated Feb. 22, 2018.
USPTO; U.S. Appl. No. 15/380,816; Notice of Allowance dated May 18, 2018.
USPTO; U.S. Appl. No. 15/380,816; Office Action dated Dec. 5, 2017.
USPTO; U.S. Appl. No. 15/499,620; Notice of Allowance dated Apr. 9, 2019; 7 pages.
USPTO; U.S. Appl. No. 15/499,620; Office Action dated Dec. 13, 2018; 7 pages.
USPTO; U.S. Appl. No. 15/616,736, filed Jun. 7, 2017, entitled "Methods And Systems For Irrigation And Climate Control," (77 pages).
USPTO; U.S. Appl. No. 15/616,736; Office Action dated Feb. 20, 2020; (pp. 1-15).
USPTO; U.S. Appl. No. 15/631,191; Notice of Allowance dated Jul. 16, 2020, (pp. 1-8).
USPTO; U.S. Appl. No. 15/631,191; Notice of Allowance dated Oct. 27, 2020; (pp. 1-7).
USPTO; U.S. Appl. No. 15/631,191; Office Action dated Jan. 29, 2020; (pp. 1-9).
USPTO; U.S. Appl. No. 15/631,191; Office Action dated May 7, 2020, (pp. 1-10).
USPTO; U.S. Appl. No. 15/631,191; Office Action dated Jun. 11, 2020, (pp. 1-8).
USPTO; U.S. Appl. No. 15/631,191; Office Action dated Oct. 22, 2019; (pp. 1-13).
USPTO; U.S. Appl. No. 15/937,267; Office Action dated Jul. 6, 2020, (pp. 1-18).
USPTO; U.S. Appl. No. 15/937,267; Office Action dated Nov. 1, 2019; (pp. 1-17).
USPTO; U.S. Appl. No. 16/049,568; Office Action dated Jan. 13, 2020; (pp. 1-15).
USPTO; U.S. Appl. No. 16/052,471; Office Action dated Jan. 13, 2020; (pp. 1-15).
USPTO; U.S. Appl. No. 16/452,397; Notice of Allowance dated Mar. 11, 2020.
USPTO: U.S. Appl. No. 15/616,736; Office Action dated May 29, 2019 (pp. 1-16).
USTPO; U.S. Appl. No. 14/493,106; Office Action dated Apr. 11, 2017; 11 pages.
Williamson; U.S. Appl. No. 60/797,540, filed May 4, 2006; 13 Pages.
Zigbee, 'Zigbee Resource Guide—Spring 2008,' 2008, pp. 28-31, Fourier Systems Ltd., New Albany, IN.
Zigbee; 'Zigbee Resource Guide—Spring 2008;' 2008; pp. 1-32; Fourier Systems Ltd.; New Albany, IN.

* cited by examiner

SOLENOID APPARATUS AND METHODS OF ASSEMBLY

CROSS-REFERENCE TO RELATED APPLICATIONS

This application claims benefit of and priority to U.S. Provisional Application No. 63/015,300, filed Apr. 24, 2020.

FIELD

The present application relates to solenoids and, in particular, to solenoids with improved assembly efficiency.

BACKGROUND

Solenoids convert electrical energy into linear mechanical motion. Solenoids have been used for many years to control a variety of devices. For example, solenoids can be used in irrigation systems to control the function of a variety of devices, such as valves, rotors, and the like. In this regard, solenoids can be used in diaphragm valves, such as found in U.S. Pat. Nos. 7,694,934 and 8,740,177, to control the flow of water through the valves.

However, solenoids can be difficult and costly to manufacture. For example, the components of the solenoid are prone to shifting and movement when the housing of the solenoid is molded. As a result, prior solenoids required that the power supply wires be attached after the housing was molded since the power supply wires moved during molding.

Additionally, there is a desire to further improve the performance and efficiency of solenoids. For instance, conversion of electrical current into the magnetic field in a solenoid may vary depending on the placement and assembly of the core and windings in the solenoid. The overall magnetic field may vary depending on the configuration of the internal components of the solenoid.

DETAILED DESCRIPTION

Solenoids can be used to control valves, such as diaphragm valves shown in U.S. Pat. No. 8,740,177, and sprinklers where the valves are integrated into a sprinkler. Solenoids are disclosed herein which may be used to control a pilot valve associated with a main valve, e.g., a diaphragm valve. In one form, the solenoids can be used to control and relieve pressure in a control chamber of a diaphragm valve. The solenoids function by opening a flow path between the control chamber and an outlet of the diaphragm valve, thereby reducing pressure in the control chamber of the diaphragm valve. As the pressure is reduced in the control chamber, the diaphragm valve opens to permit flow through the valve. The solenoids can then close, preventing flow out of the control chamber, thereby increasing the pressure in the control chamber until the valve closes. The solenoids thus control the main valve such that the main valve opens as a result of the solenoid opening the pilot valve. However, it should be appreciated that the solenoids described herein may be used for other purposes and with other components.

Figure 1:
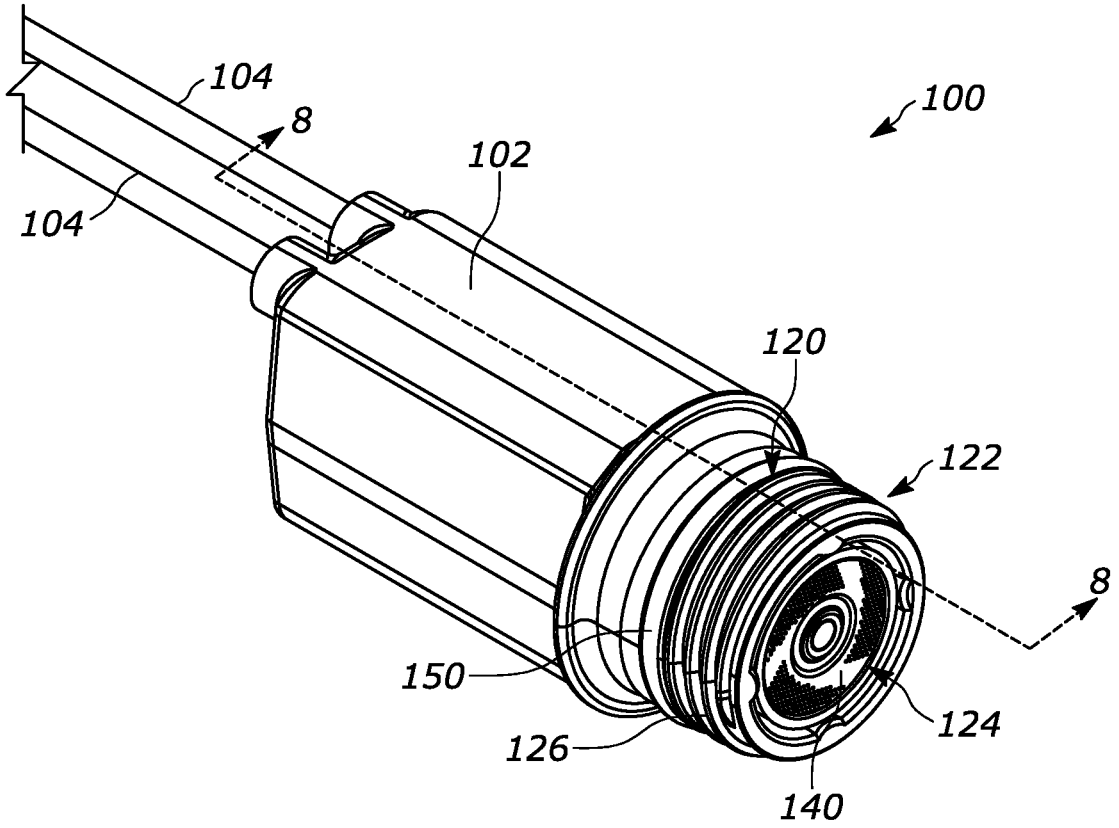
FIG. 1 is a perspective view of a solenoid.

Referring to FIG. 1, a solenoid 100 is shown. The solenoid 100 includes a housing 102 containing the internal components of the solenoid 100. Two wires 104 extend from the housing 102. The wires 104 may be connected to a power supply to provide power to the solenoid 100. The attachment portion 122 of the bobbin 120 extends from the housing 102. The attachment portion 122 defines a valve cavity 124 where a filter 140 is inserted. The attachment portion 122 includes threads 126 disposed on a surface thereof for attachment to a main valve (not shown). A gasket 150 is positioned on the attachment portion 122 of the bobbin 120. The gasket 150 may prevent fluid from flowing or leaking out of the main valve when the solenoid 100 is attached to the main valve.

Figure 2:
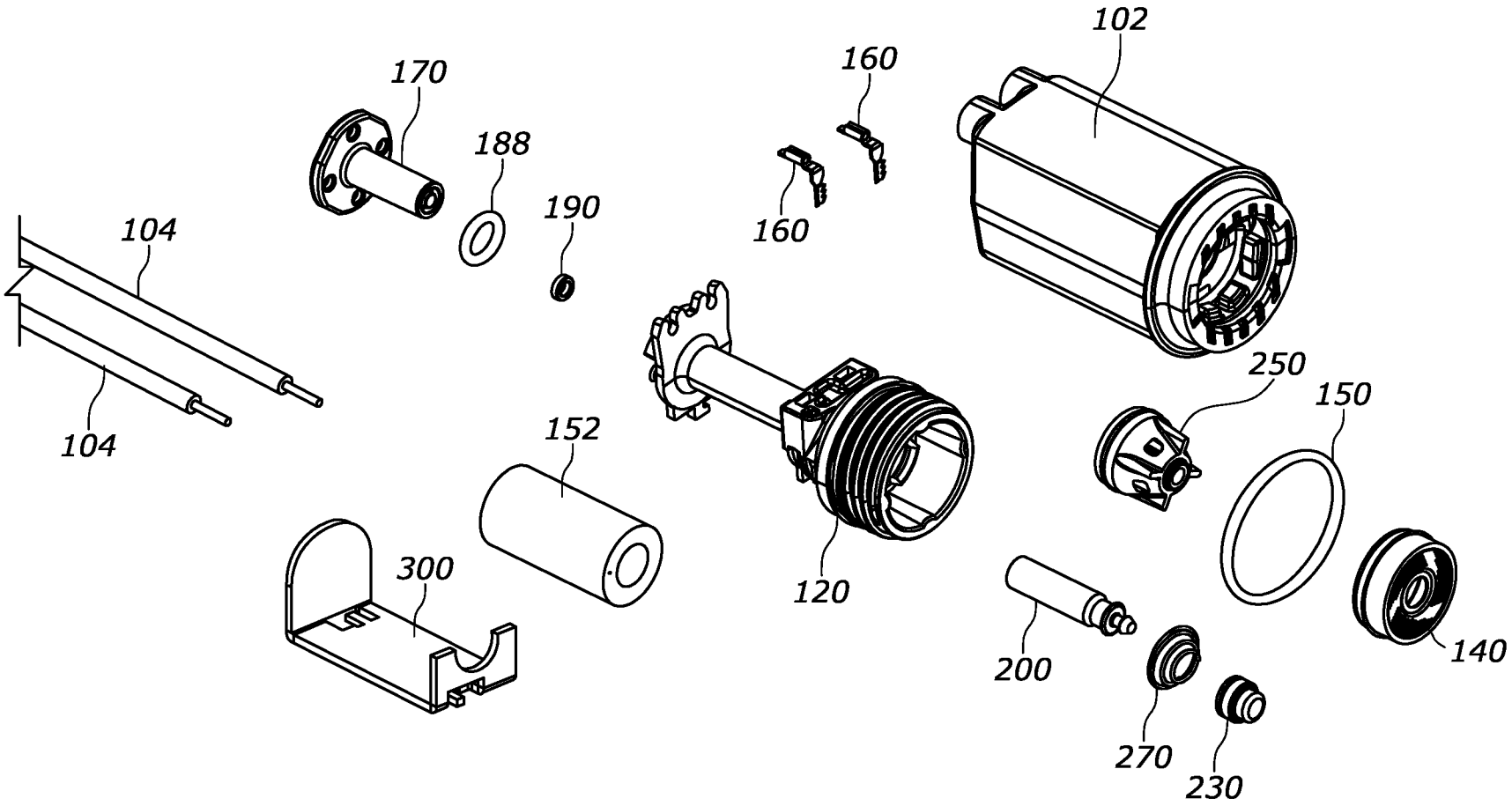
FIG. 2 is an exploded view of the solenoid of FIG. 1.

Regarding FIG. 2, an exploded view of the solenoid 100 and its components are shown. Regarding FIG. 3, a partially assembled solenoid 106 is shown. The solenoid 100 includes a bobbin 120 including a tube portion 128 (see FIGS. 5A-5C) about which a coil of wire 152 is wound. The ends of the coil of wire 152 may be connected to terminals 160. Wires 104 may also be connected to the terminals 160. A core 170 includes a portion which is inserted into the tube portion 128 of the bobbin 120 at the end opposite the valve cavity 124 of the bobbin 120. A gasket 188 may be positioned between the portion of the core 170 remaining outside of the bobbin 120 and the bobbin 120. A shading ring 190 is positioned on an end of the core 170 inserted into the bobbin 120. A plunger 200 may be inserted into the interior of the tube portion 128 of the bobbin 120. An end of the plunger 200 may be adjacent the core 170 and/or shading ring 190 within the tube portion 128 when retracted to an open position. A sealing cap 230 may be positioned over an end of the plunger 200 extending into the valve cavity 124. A retainer 250 defining a fluid flow path may be inserted into the valve cavity 124 to retain the plunger 200 within the bobbin 120. A spring 270 may extend from an internal surface of the bobbin 120 within the valve cavity 124 to the plunger 200 to bias the plunger 200 against the retainer 250. The filter 140 may be inserted in the valve cavity 124 after the retainer 250 has been inserted.

Figure 3:
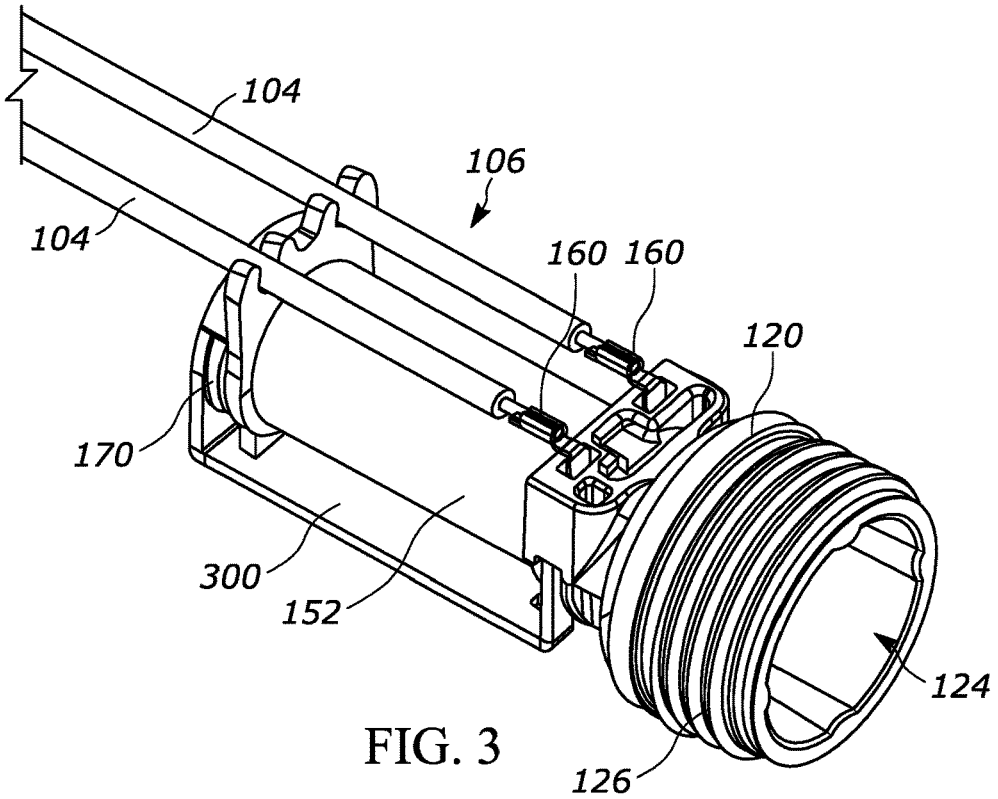
FIG. 3 is a perspective view of the solenoid of FIG. 1 partially assembled.
Figure 4A:
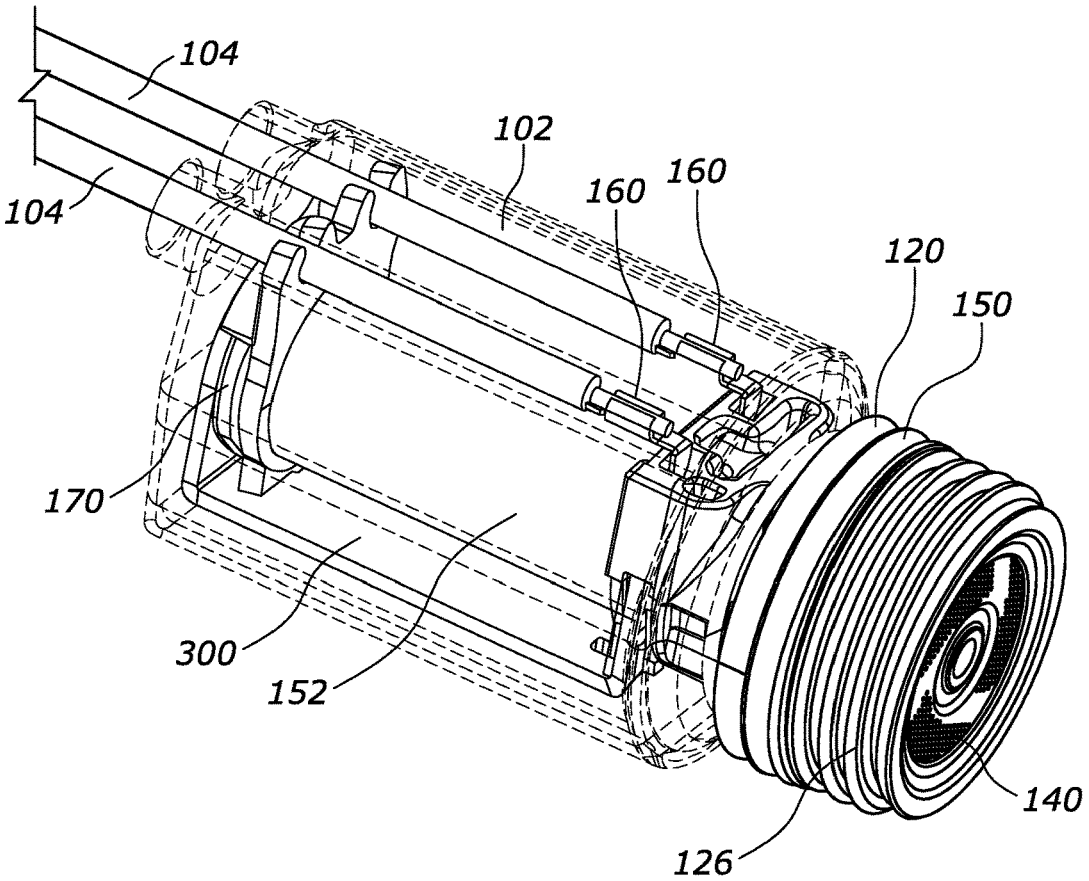
FIG. 4A is a top perspective view of the solenoid of FIG. 1 shown with a transparent housing.
Figure 4B:
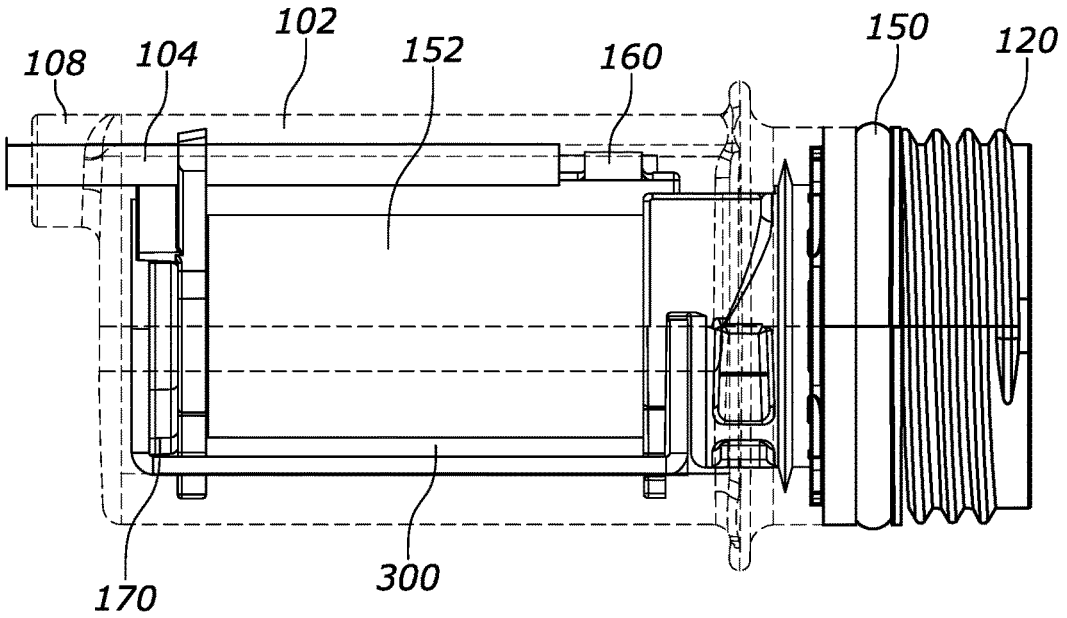
FIG. 4B is a side elevational view of the solenoid of FIG. 1 shown with a transparent housing.
Figure 4C:
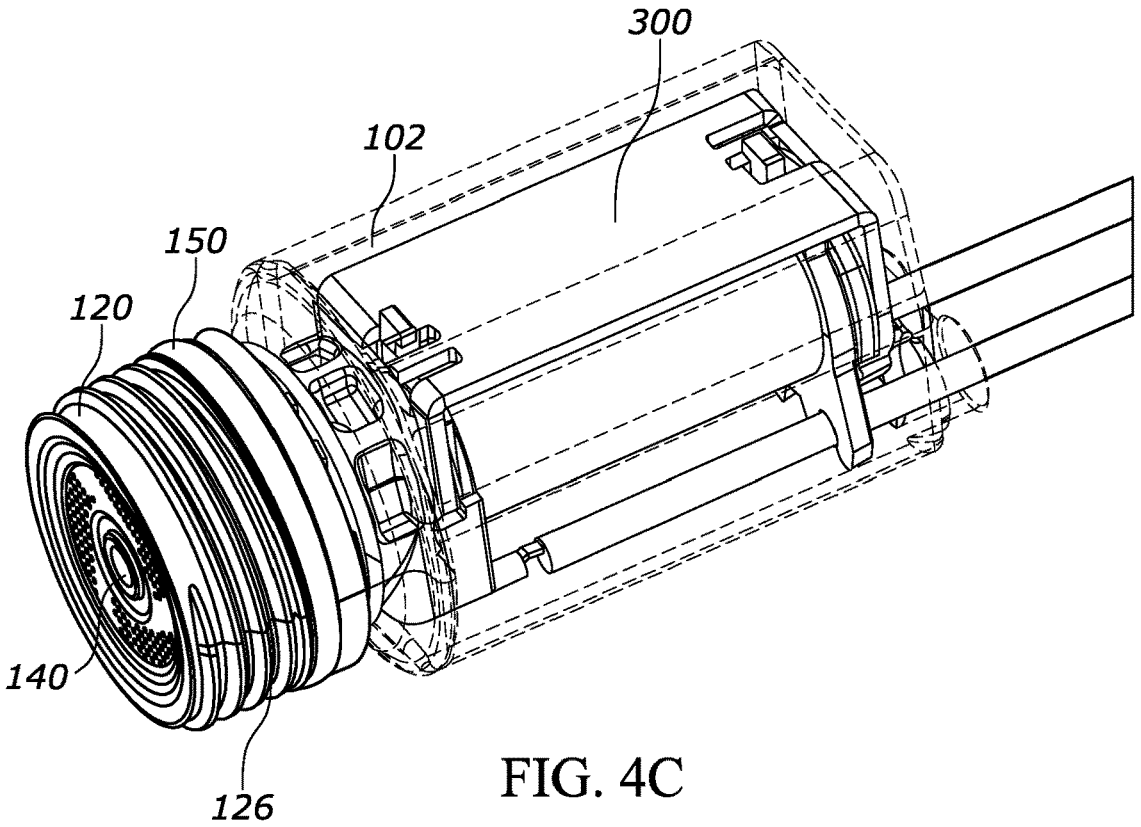
FIG. 4C is a bottom perspective view of the solenoid of FIG. 1 shown with a transparent housing.

With reference to FIG. 4A-4C, the housing 102 is shown as see-through or transparent. As shown, the housing 102 surrounds and/or envelopes many of the internal components of the solenoid 100 including the C-frame or carrier 300, the core 170, the coil of wire 152, the terminals 160, a portion of the bobbin 120, a portion of the wires 104, and a portion of gasket 188. The housing 102 may be an overmold that is molded after the internal components of the solenoid 100 are partially assembled, for example, like partially assembled solenoid 106 of FIG. 3. For instance, the partially assembled solenoid 106 may be inserted into a cavity with an overmold dispersed about the solenoid 100. The attachment portion 122 of the bobbin 120 may be inserted into a cavity such that the attachment portion 122 is not enveloped by the overmold. The overmold may be a variety of materials such as plastics, polybutylene terephthalate (PBT), nylon, other polymers, and the like. As shown in FIGS. 4A-4C, the wires are overmolded after being attached to the terminals 160. The overmold may form wire support knobs 108 which protrude from the surface of the housing 102 opposite the attachment portion 122 of the bobbin 120. The knobs 108 may aid to prevent water from entering the housing 102 and reaching the coil 152.

Figure 5A:
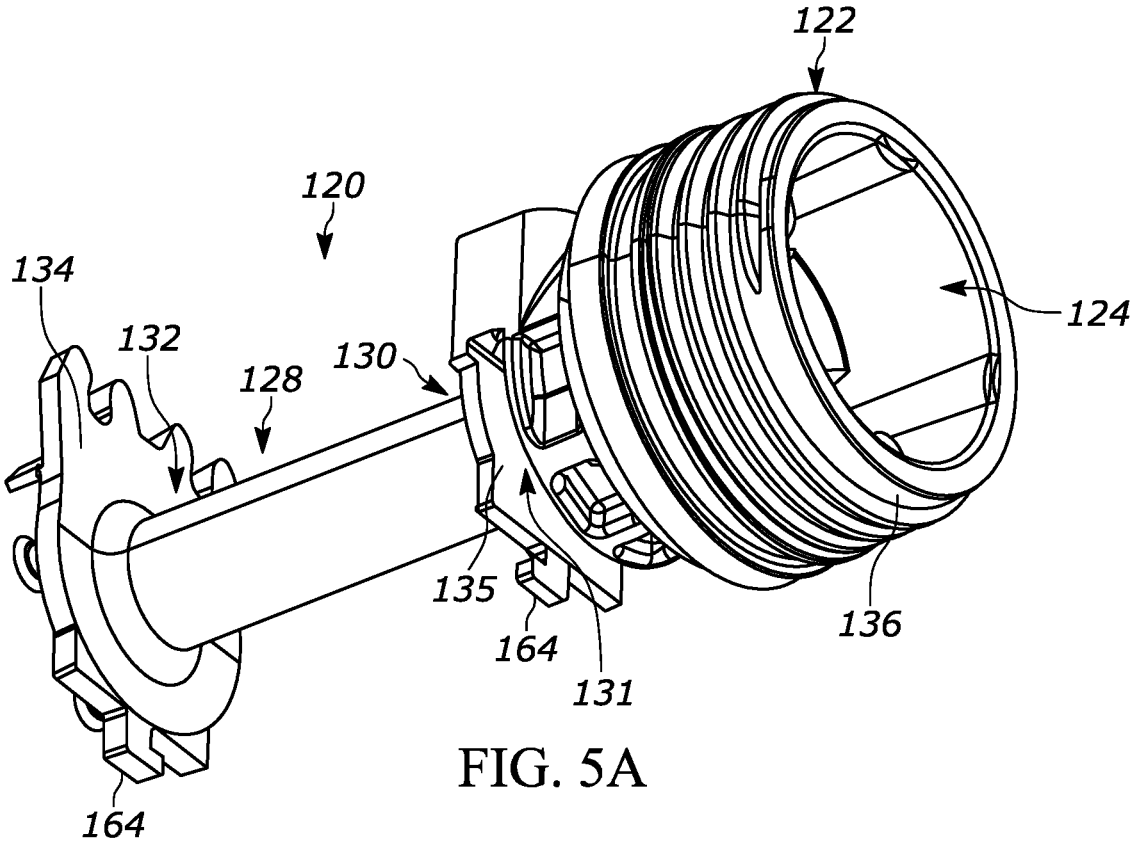
FIG. 5A is a bottom perspective view of a bobbin of the solenoid of FIG. 1.
Figure 5B:
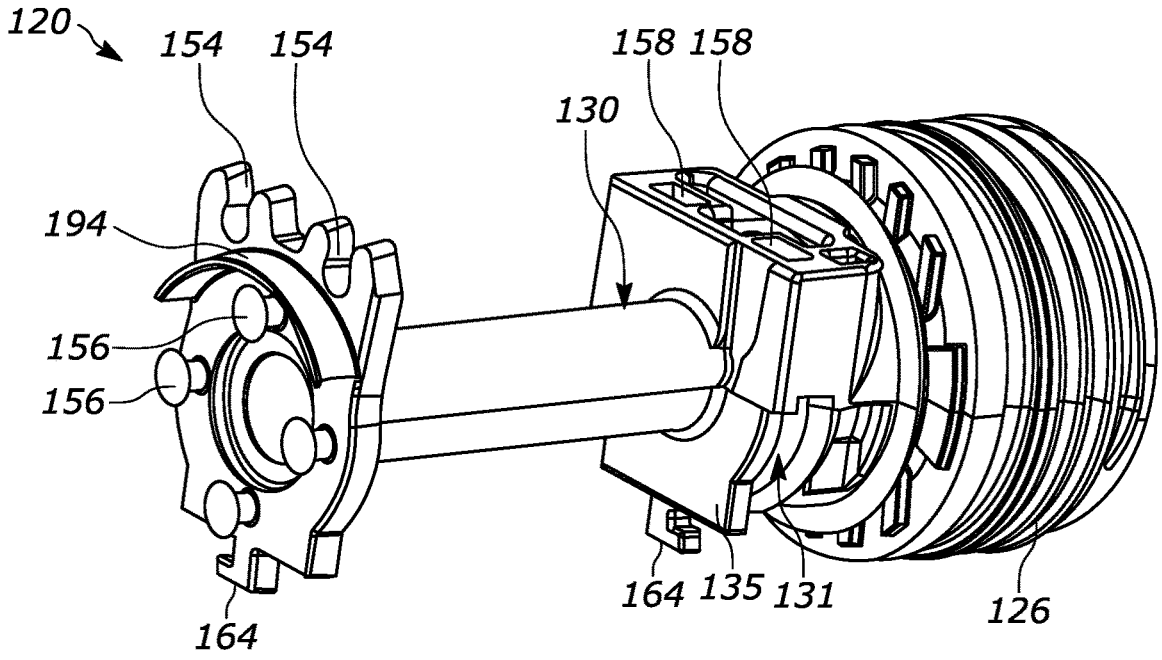
FIG. 5B is a top perspective view of the bobbin of FIG. 5A.
Figure 5C:
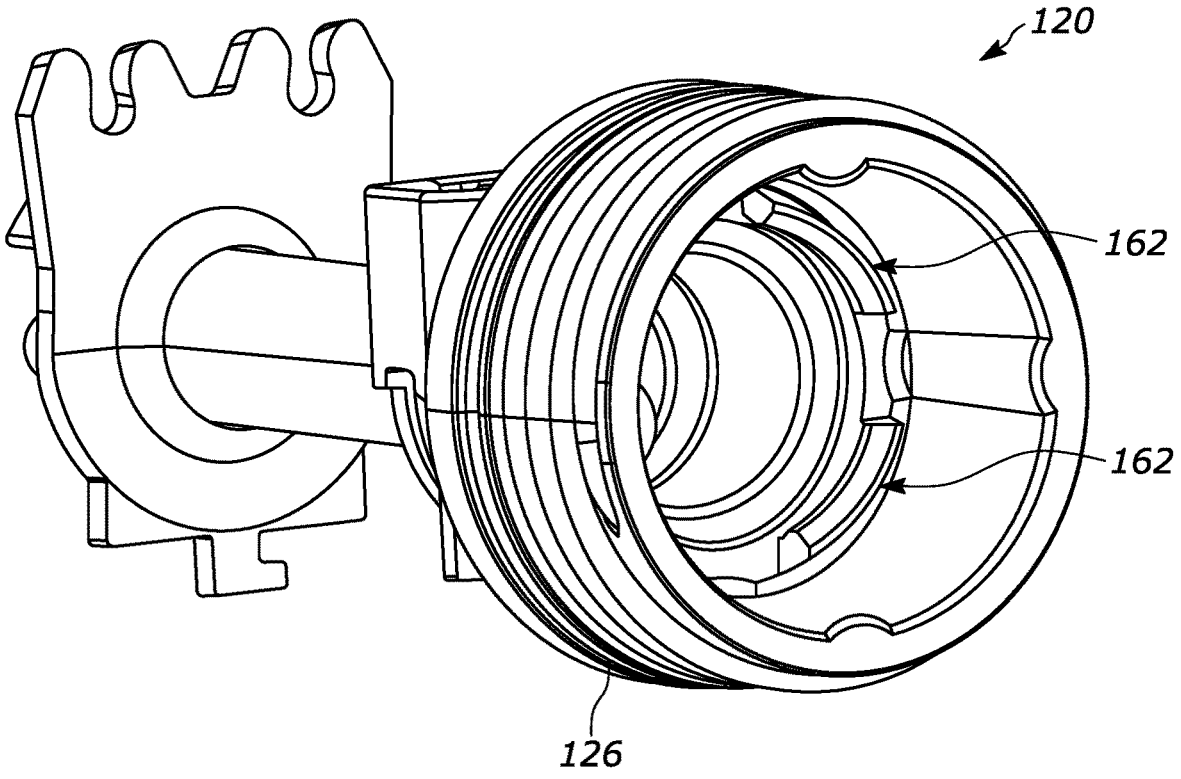
FIG. 5C is a front perspective view of the bobbin of FIG. 5A.

With reference to FIGS. 5A-5C, the bobbin 120 of the solenoid 100 includes a tube portion 128 and the attachment portion 122. The tube portion 128 has a first end 130 that terminates at the valve cavity 124 and a second end 132 that terminates at an end surface 134 that is substantially perpendicular to the tube portion 128. The attachment portion 122 includes a cylindrical skirt 136 defining the valve cavity 124. The cylindrical skirt 136 includes threads 126 disposed on an outer surface thereof for attachment within a cavity including complementary threads 126, such as an opening of a diaphragm valve. In another embodiment, the threads 126 may be disposed on an inner surface of the cylindrical skirt 136. Other methods of attaching the solenoids may also be used, such as snap fit, extended protrusions, and the like. The cylindrical skirt 136 includes an annular recess 138 that receives a gasket 150. The gasket 150 may be as an example, an O-ring. The gasket 150 aids in forming fluid tight connection between the solenoid 100 and the object the solenoid 100 is connected to, for example, a main valve that the solenoid 100 is threaded into. The end surface 134 includes wire guides 154 for guiding and supporting wires 104 extending from the terminals 160 to the power source. In one form, the wire guides 154 may be horseshoe-shaped recesses in the end surface 134 that the wires 104 may snap or be pressed into. The wire guides 154 may be sized to receive a specific gauge wire. The wire guides 154 may retain the wires 104 in the position they are inserted at, requiring force to dislodge the wires 104 to mitigate unintentional removal of the wires. The wire guides 154 aid in manufacturing of the solenoid 100 by maintaining the wires 104 in a fixed location, for example, when the partially assembled solenoid 106 is overmolded to form housing 102.

The bobbin 120 further includes protrusions 156 that extend longitudinally from the end surface 134. These protrusions 156 are positioned and arranged to be received through complementary apertures 172 of the core 170. The ends of the protrusions 156 may be deformable, such as through heat staking. The ends of the protrusions 156 may be deformed after the protrusions 156 have been inserted through the apertures 172 of the core 170 to couple the core 170 to the bobbin 120. The protrusions 156 may be formed to include a specific volume of plastic such that when deformed, the plastic remains within the apertures 172 of the core 170. Further, the apertures 172 may be shaped to accept the deformed protrusions 156 and otherwise prevent the protrusions 156 from extending beyond the apertures 172. Coupling the core 170 to the bobbin 120 aids in managing the partially assembled solenoid 106 during manufacturing, particularly when the partially assembled solenoid 106 is transferred for overmolding.

A shroud 194 may protrude longitudinally from the end surface 134. In one form, the shroud 194 may be rounded and shaped to extend over the portion of the carrier 300 and core 170 at the end surface 134. The shroud 194 may be included on the bobbin 120 to prevent and/or redirect the overmold from flowing between the core 170 and the carrier 300 during the molding process to preserve the magnetic circuit interface between the core 170 and the carrier 300.

At the first end 130 of the tube portion 128 of the bobbin 120, the bobbin 120 includes another end surface 135. The coil 152 may be wound about the tube portion 128 between the end surfaces 134, 135. The bobbin 120 may further include sockets 158 formed between the end surface 135 and the attachment portion 122 that receive the terminals 160. An end of the terminals 160 may be inserted into each of the sockets 158. The sockets 158 may be sized to retain the terminals 160 to prevent the terminals 160 from becoming unintentionally dislodged after being inserted into the socket 158, for example, by a friction fit. The bobbin 120 may further define a cavity or slot 131 between the end surface 135 and the attachment portion 122 of the bobbin 120 that receives the second end surface 304 of the carrier 300.

Within the valve cavity 124 of the bobbin 120, the bobbin 120 includes retention members 162 to connect retainer 250. The retention members 162 may be deflectable snap-in hooks that snap over a complementary ridge 252 of the retainer 250. The retention members 162 may be in an annular arrangement with a gap in between each retention member 162. Including a gap in between the retention members 162 may be desired in embodiments where the bobbin 120 is formed of a material that resists outward deflection when the retainer 250 is inserted. While the retention members 162 are shown in FIG. 5C as being spaced apart by gaps, in alternative embodiments, there may be a single annular retention member 162 that does not include any gaps. In other embodiments, there may be a single annular retention member 162 that includes a single gap to allow the retention member 162 to deflect outward to receive the retainer 250.

Figure 11:
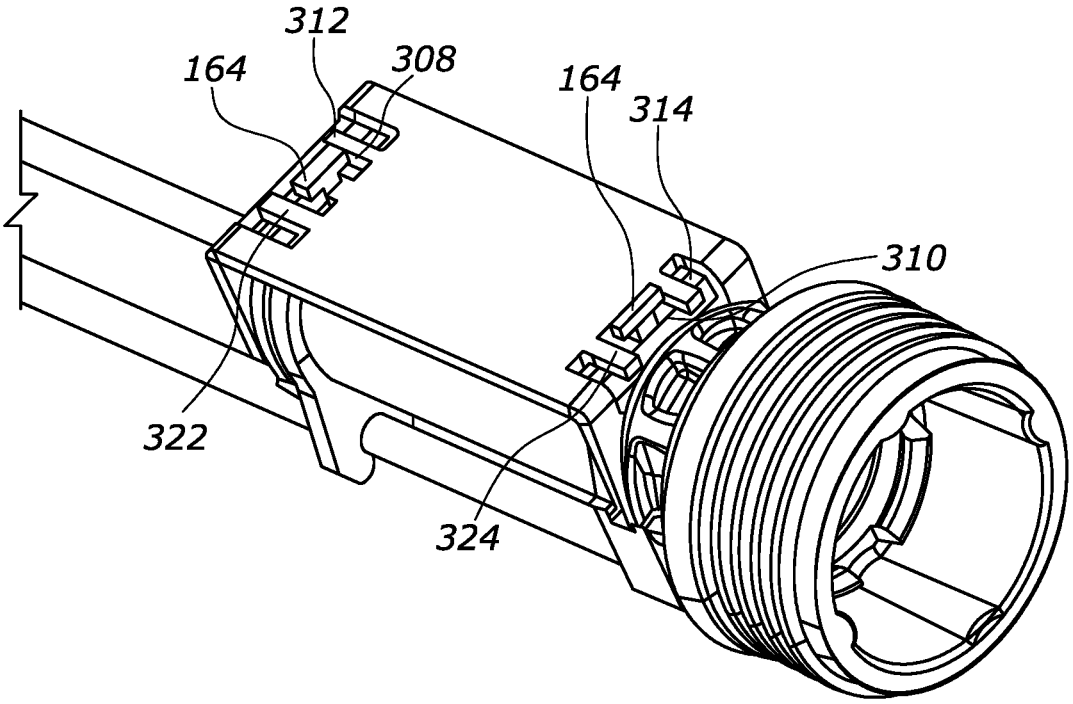
FIG. 11 is a bottom perspective view of a partially assembled solenoid according to a second embodiment.

The bobbin 120 also includes hooks 164 extending from the bottom portion of the bobbin 120. As shown in FIGS. 5A-5C, the hooks 164 have a half-T formation. The hooks 164 may have a full T-shape formation, as seen in FIG. 11. In other embodiments, the bobbin 120 may include one full T-shape hook 164 and one half-T shape hook. The hooks 164 engage a portion of the carrier 300 to connect the carrier 300 to the bobbin 120, which is described in more detail below with regard to the carrier 300.

Figure 6A:
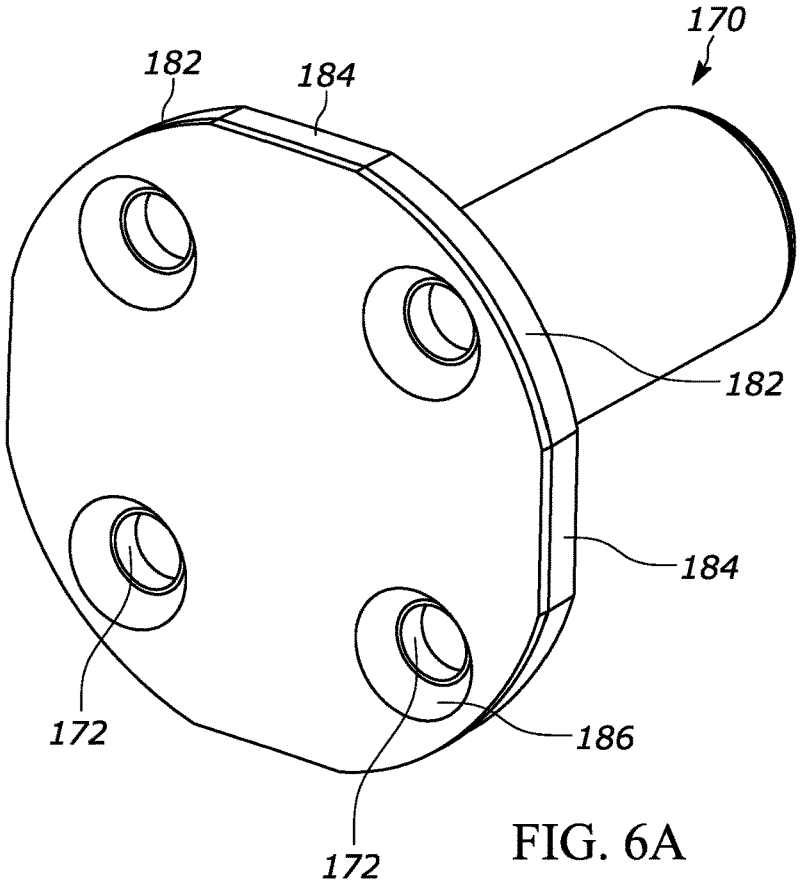
FIG. 6A is a rear perspective view of a core of the solenoid of FIG. 1.
Figure 6B:
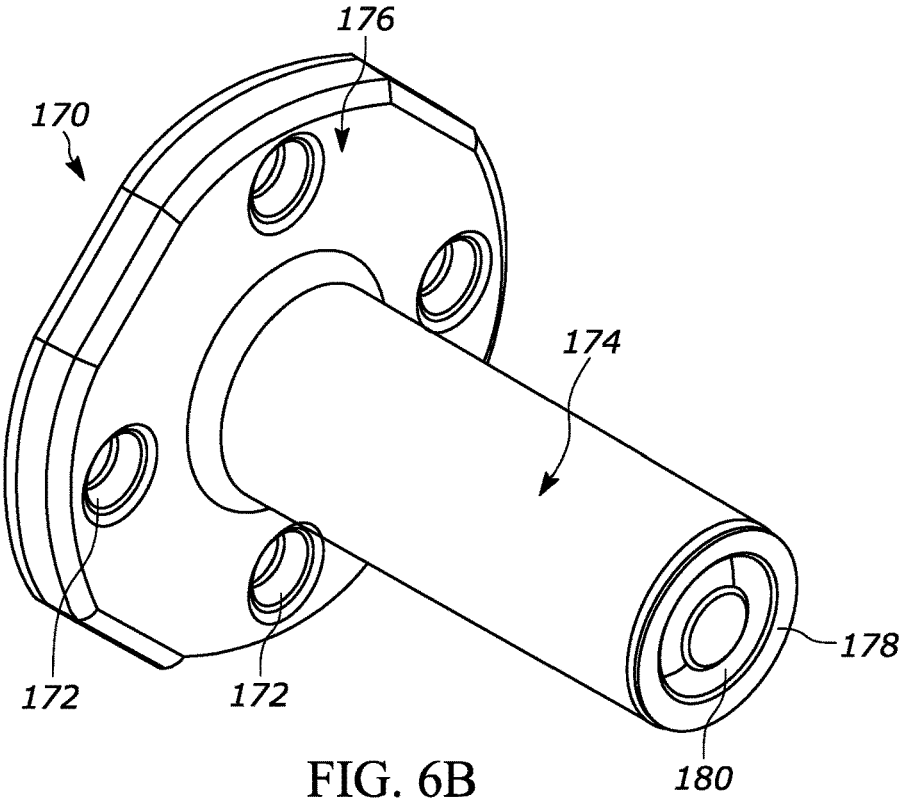
FIG. 6B is a front perspective view of the core of FIG. 6A.
Figure 7:
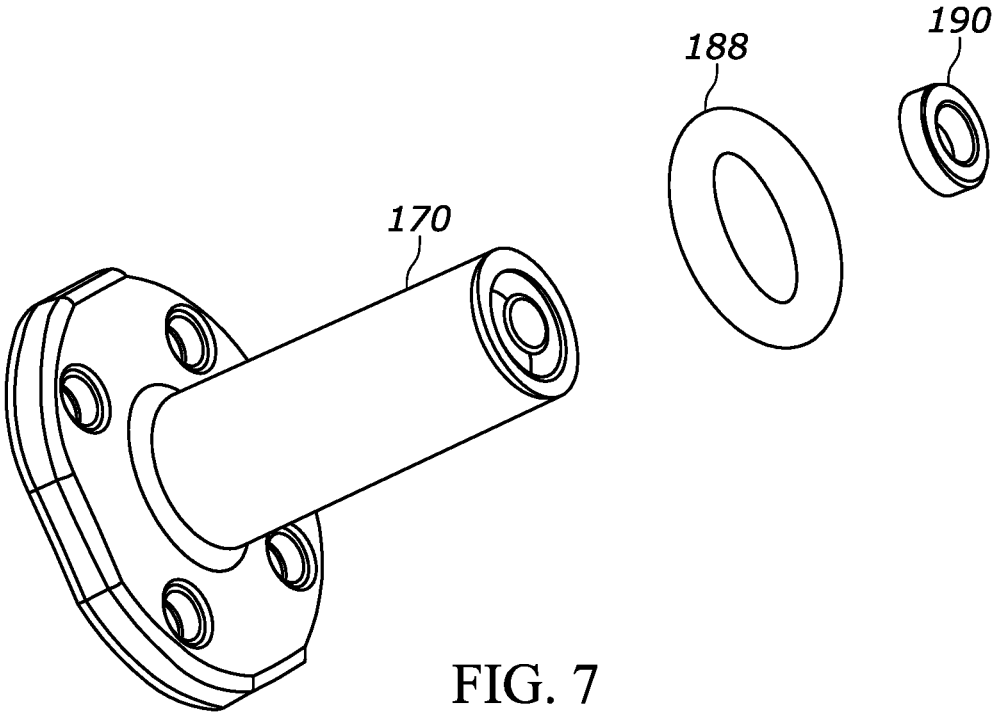
FIG. 7 is an exploded view of the core, a gasket, and a shading ring of the solenoid of FIG. 1.
Figure 8:
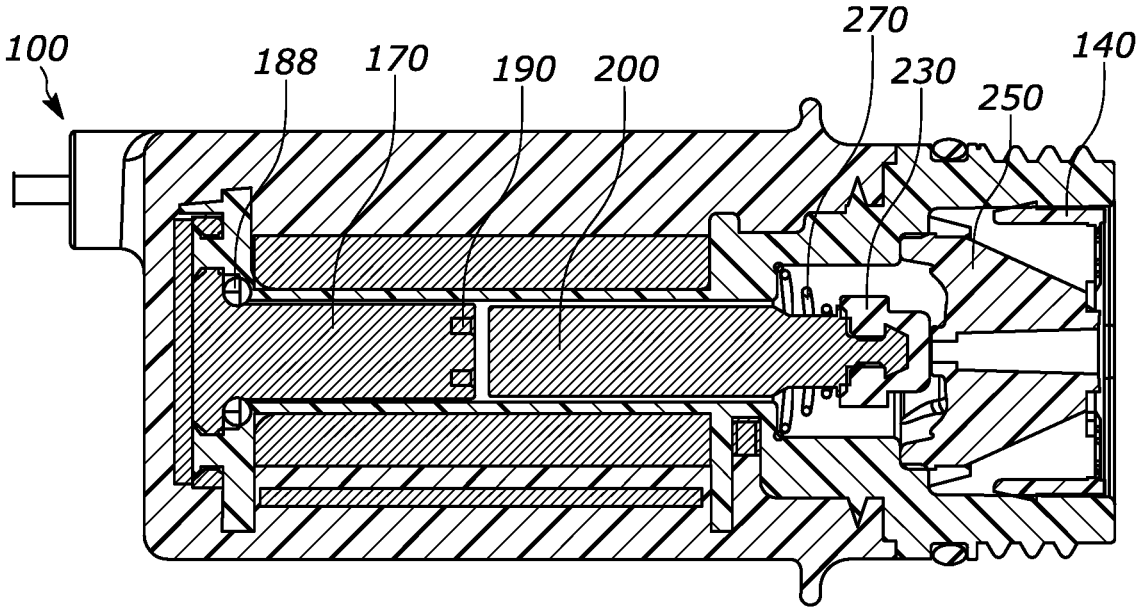
FIG. 8 is a cross-section view of the solenoid of FIG. 1 taken along line 8-8 of FIG. 1.

With reference to FIGS. 6A-6B and FIG. 7 the core 170 includes a rod portion 174 and a disc portion 176. The rod portion 174 extends into the second end 132 of the tube portion 128 of the bobbin 120, for example as shown in FIG. 8. The end surface 178 of the rod portion 174 includes an annular recess 180 sized to receive a shading ring 190. The shading ring 190 may be made of a metal, for example, copper. The shading ring 190 may be pressed into the annular recess 180 and held in place by a friction fit. The shading ring 190 may extend longitudinally beyond the end surface 178 of the core 170 and may reduce vibration and chatter between the core 170 and the plunger 200 when the plunger 200 is drawn to the core 170 during energization of the solenoid 100. In another embodiment, the shading ring 190 may be melted into the annular recess 180 of the core 170 to affix the shading ring 190 to the core 170. For example, during assembly of the solenoid 100, the shading ring 190 may be positioned within the annular recess 180 of the core 170 and then melted. Once melted, the metal (e.g., copper) of the shading ring 190 fills the annular recess 180 of the core 170. As the metal of the shading ring 190 cools, the shading ring 190 shrinks within the annular recess 180 to form an interference fit with an inner wall of the annular recess 180 of the core 170. To achieve this interference fit, the shading ring 190 may be formed of a metal having a different coefficient of thermal expansion than the core 170 so that the shading ring 190 shrinks about the core 170 to secure the shading ring 190 to the core 170. By affixing the shading ring 190 to the core 170 in this manner, the tolerances of both the shading ring 190 and the annular recess 180 of the core may be less precise. In yet another embodiment, a metal (e.g., copper) is melted or impregnated into the end of the rod portion 174 of the core 170.

The disc portion 176 of the core 170 has a diameter larger than the inner diameter of the tube portion 128 of the bobbin 120 and thus remains outside the tube portion 128 of the bobbin 120 when the rod portion 174 is inserted into the tube portion 128. A back surface 187 of the core 170 engages the carrier 300. The core 170 may be formed of a powdered metal having high magnetic permeability characteristics to confine and guide the magnetic field induced by the coil of wire 152 during energization of the solenoid 100. Using a material with high magnetic permeability characteristics may reduce the magnetic reluctance of the magnetic circuit of the solenoid 100 thereby increasing the overall efficiency of the solenoid 100.

As shown in FIGS. 6A-6C, the disc portion 176 includes rounded edges 182 and straight edges 184 connecting the rounded edges 182. Including flattened or straight edges 184 on the disc portion 176 may improve the fit between the core 170, the bobbin 120, and the carrier 300. Specifically, including a straight edge 184 on the disc portion 176 of the core 170 allows the carrier 300 to be bent more sharply and have a smaller bend radius. This may improve the connection between the back surface 187 of the core 170 and the carrier 300 which may improve the magnetic circuit interface. In alternative embodiments, the disc portion 176 of the core 170 is circular such that there are no straight edges.

The disc portion 176 of the core 170 includes four apertures 172 extending therethrough. While four apertures 172 are shown, in alternative embodiments, the disc portion 176 may include any number of apertures 172, for example, three or five apertures. These apertures 172 may align with protrusions 156 extending from the end surface 134 of the bobbin 120 such that the protrusions 156 extend through the apertures 172 of the core 170. Once the protrusions 156 are positioned within the apertures 172, the ends of the protrusion 156 may be deformed, for example, by heat staking, to prevent the protrusions 156 from being withdrawn from the apertures 172. The apertures 172 may include a chamfered edge 186 about the circumference of the apertures 172. The chamfered edges 186 about the apertures 172 thus provide the core 170 with countersunk holes. When the protrusions 156 of the bobbin 120 are deformed, the material of the deformed (e.g., melted) protrusion 156 may be contained within the void formed by the aperture 172 and chamfer 186 such that it does not extend beyond the back surface 187 of the core 170. This ensures that the carrier 300 abuts the back surface 187 of the core 170 thereby improving the efficiency of the magnetic circuit of the solenoid 100.

As shown in FIG. 8, a gasket 188 may be positioned between the disc portion 176 of the core 170 and the end surface 134 of the bobbin 120. As an example, the gasket 188 may be an O-ring. The gasket 188 may prevent the plastic of the overmold housing 102 from flowing into the tube portion 128 of the bobbin 120 during manufacturing of the solenoid 100.

Figure 9A:
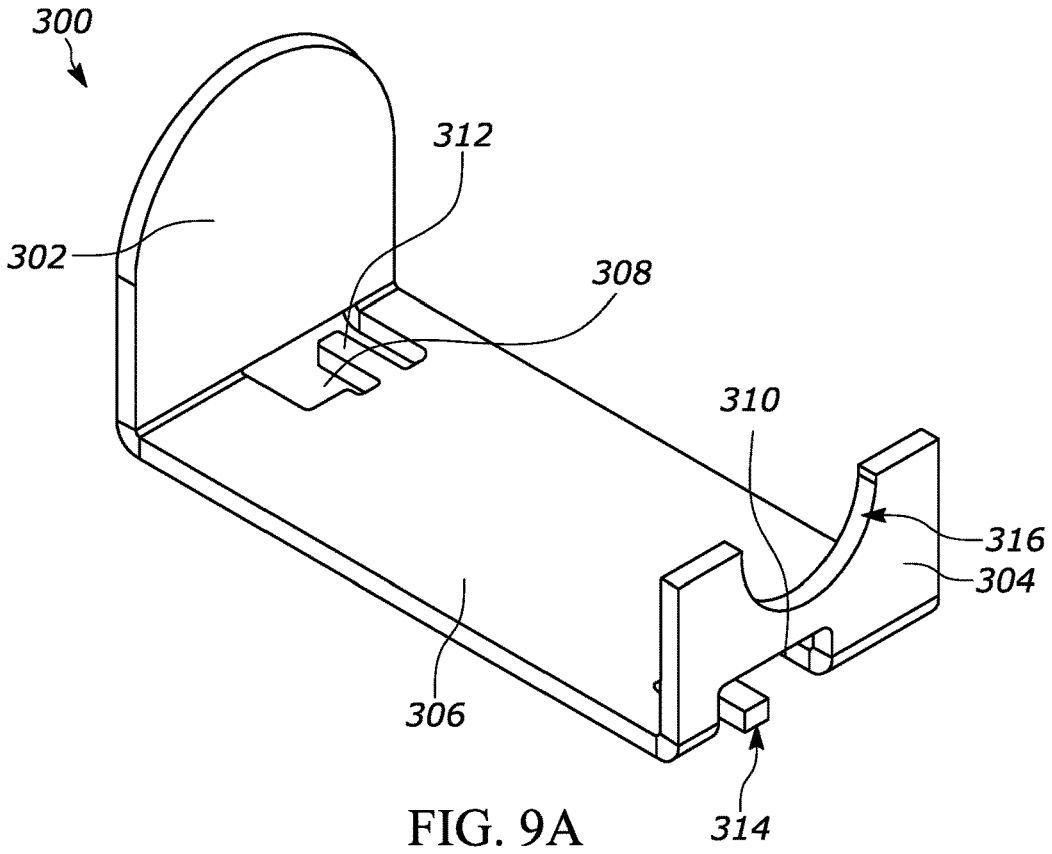
FIG. 9A is a front perspective view of a frame or carrier of the solenoid of FIG. 1.
Figure 9B:
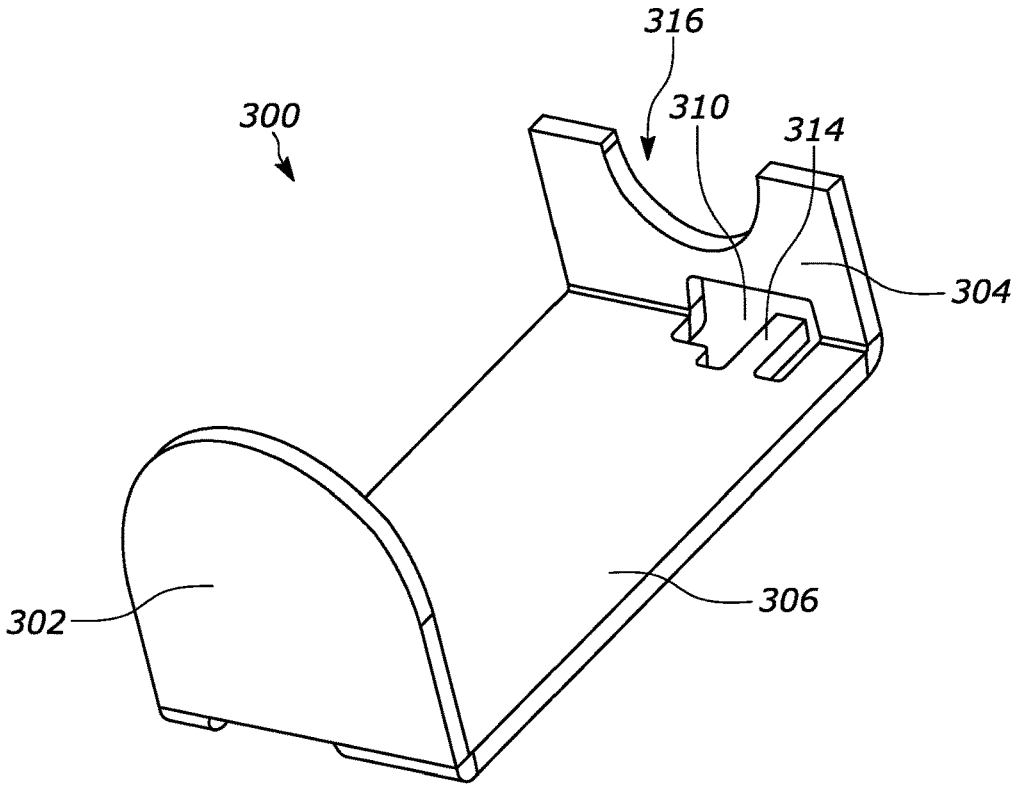
FIG. 9B is a rear perspective view of the carrier of FIG. 9A.
Figure 9C:
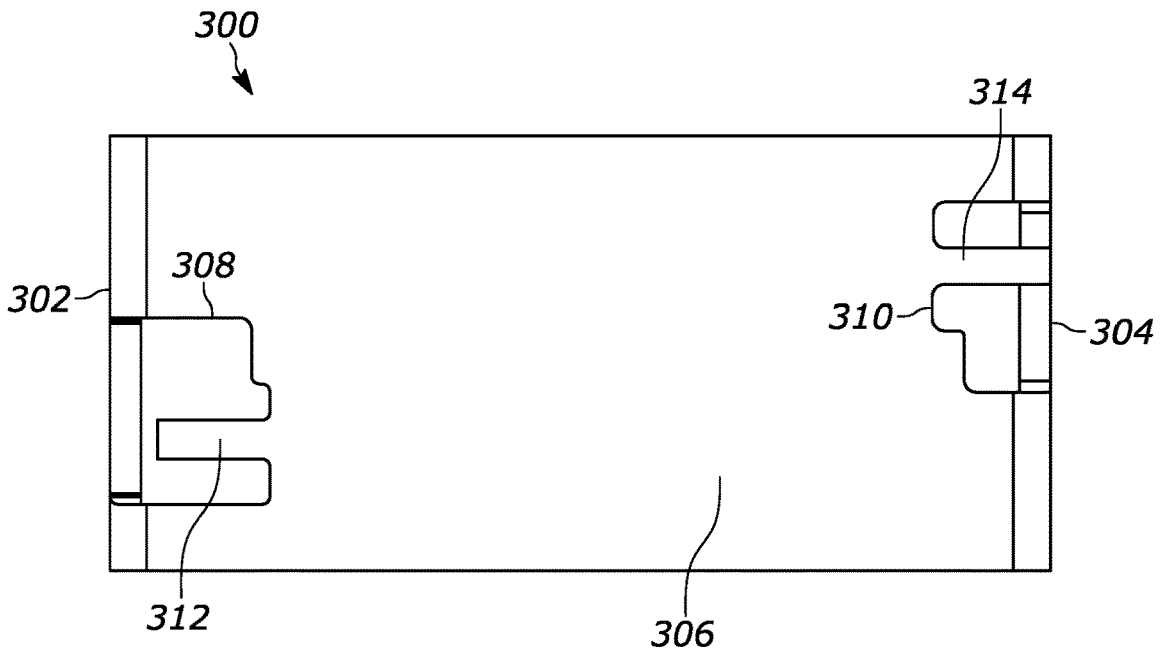
FIG. 9C is a bottom plan view of the carrier of FIG. 9A.

With reference to FIGS. 9A-9C, the carrier 300 includes a first end surface 302 connected to a second end surface 304 by a longitudinal portion 306. In one form, the first and second end surfaces 302, 304 of the carrier 300 are bent at about a 90 degree angle from the longitudinal portion 306 thus giving the carrier a C-shape. When assembled, the first end surface 302 of the carrier 300 contacts the back surface 187 of the disc portion 176 of the core 170. The second end surface 304 of the carrier 300 extends to the first end 134 of the tube portion 128 of the bobbin 120 opposite the core 170. The second end surface 304 of the carrier 300 defines a semi-circular cutout 316 that has a radius similar to the radius of the exterior surface of the tube portion 138 of the bobbin 120. The semi-circular cutout 316 abuts the exterior surface of the tube portion 128 of the bobbin 120.

Figure 10A:
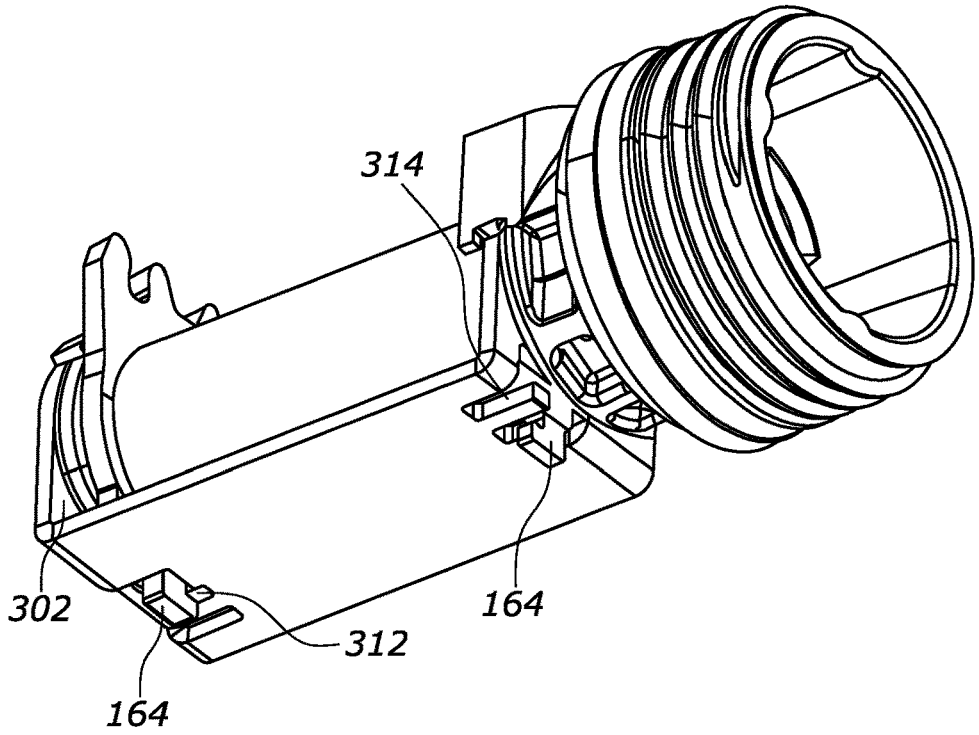
FIG. 10A is a bottom perspective view of the solenoid of FIG. 1 partially assembled.
Figure 10B:
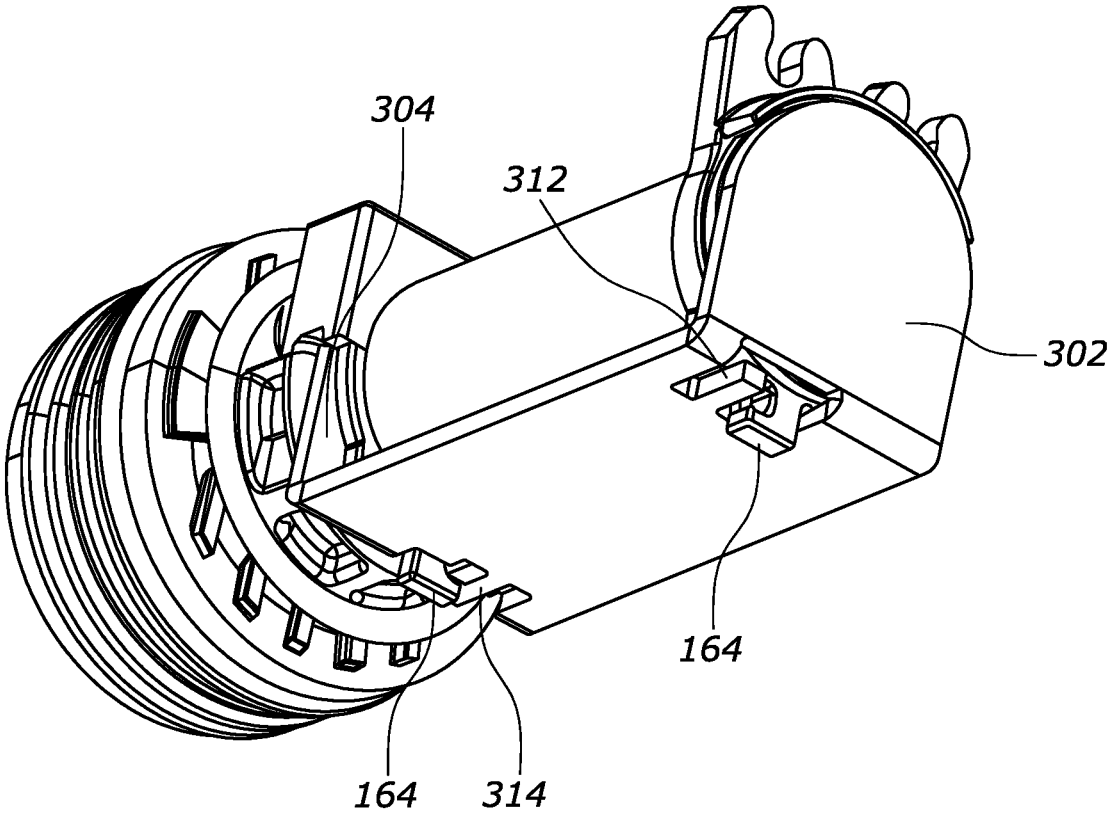
FIG. 10B is a rear perspective view of the partially assembled solenoid of FIG. 10A.
Figure 10C:
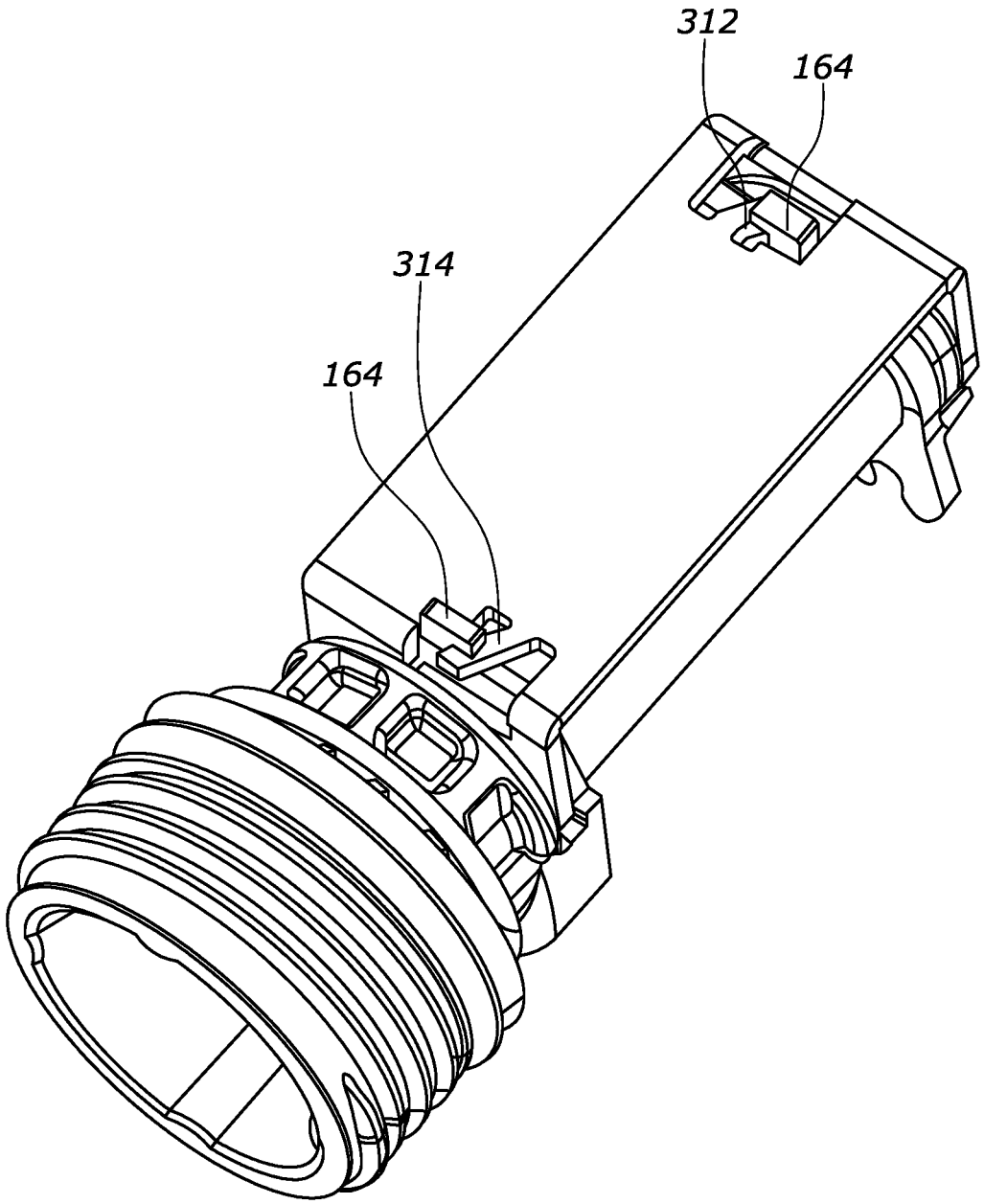
FIGS. 10C-10D are a bottom perspective views of the partially assembled solenoid of FIG. 10A shown with the carrier of FIG. 9A attached.
Figure 10D:
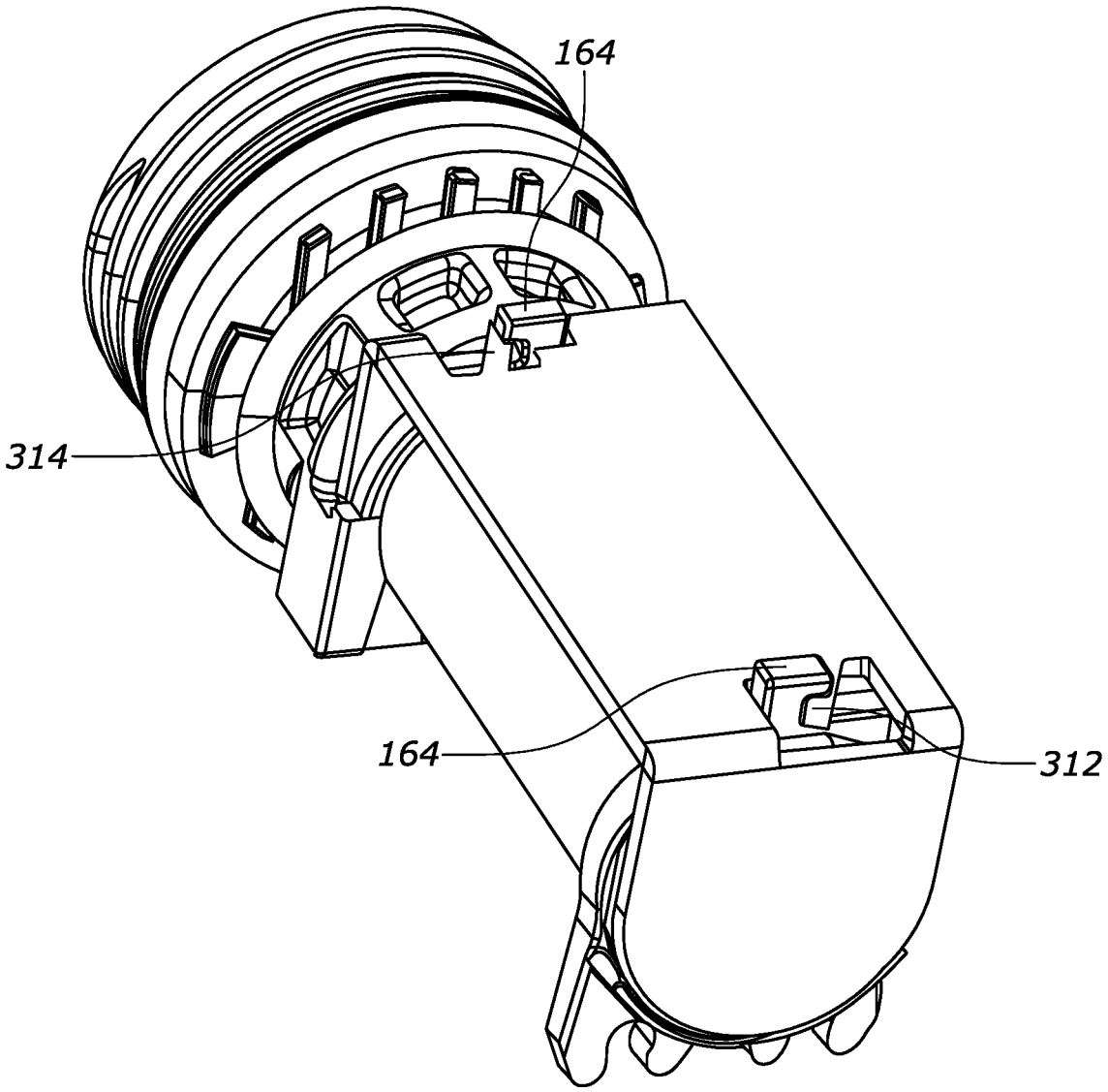

The carrier 300 further defines two attachment cutout portions 308, 310. Extending into each attachment cutout portion 308, 310 is an attachment finger 312, 314. The attachment fingers 312, 314 are used to attach the carrier 300 to the bobbin 120 via the hooks 164 of the bobbin 120 having a half-T configuration. With reference to FIGS. 10A-10C, the carrier 300 is attached to the bobbin 120 by engagement of the hooks 164 with the attachment fingers 312, 314. In attaching the bobbin 120 to the carrier 300, the hooks 164 are extended through the attachment cutout portions 308, 310 of the carrier 300. The fingers 312, 314 are then deformed or bent under the hooks 164 as shown in FIGS. 10C-10D. With the fingers 312, 314 between the hooks 164 and the main portion of the bobbin 120, the carrier 300 is mechanically attached to the bobbin 120.

With reference to FIG. 11, the carrier 300 is attached to a bobbin 120 having hooks 164 with a T-shape configuration. According to this embodiment, the carrier 300 defines two attachment cutout portions 308, 310. Extending into attachment cutout portion 308 are two attachment fingers 312, 322. Extending into attachment cutout portion 310 are two attachment fingers 314, 324. To attach the carrier 300 to the bobbin 120. the T-shaped hooks 164 of the bobbin 120 are extended through the attachment cutout portions 308, 310. Fingers 312, 322 and fingers 314, 324 are bent inward and under the hooks 164. With the fingers 312, 314, 322, 324 being between the hooks 164 and the main portion of the bobbin 120, the carrier 300 is mechanically attached to the bobbin 120.

In both embodiments, the attachment of the carrier 300 to the bobbin 120 aids in handling and moving the partially assembled solenoid 106, for example, when moving or positioning the partially assembled solenoid 106 for overmolding. The attachment of the carrier 300 to the bobbin 120 also aids in holding the carrier 300 in place during overmolding, such that the first end surface 302 of the carrier 300 remains in contact with the back surface 187 of the core 170. In other embodiments, the bobbin 120 may have one hook 164 that has a half-T configuration and one hook 164 that has a full-T configuration. The carrier 300 may also have one attachment cutout portion with one finger and another attachment cutout portion with two fingers to connect to the bobbin 120.

The carrier 300 may be made of a metal material, such as a metal having a high magnetic permeability to confine and guide magnetic fields induced by the coil of wire 152 during operation of the solenoid 100. Using a material for the carrier 300 with a high magnetic permeability results in a magnetic circuit with a reduced magnetic reluctance which may increase the overall efficiency of the solenoid 100. Using the embodiment where the bobbin 120 includes half-T hooks 164 and a carrier 300 having one finger for each attachment cutout portion may improve the efficiency of the magnetic circuit of the solenoid 100. This may be due in part to the carrier 300 having a greater cross-sectional width of the carrier 300 that the magnetic flux travels through when the solenoid 100 is in operation.

The C-shaped carrier 300 may be used in place of cylindrical frames and yokes that surround the bobbin found in other solenoids. The C-shaped carrier 300 improves the moldability of the solenoid 100 compared to cylindrical frames. For instance, the C-shape geometry of the carrier 300 provides less flow disturbances and resistance in the molding process, thereby creating fewer areas that are prone to circulation, stagnation, gas entrapment, and voids within the mold.

Figure 12:
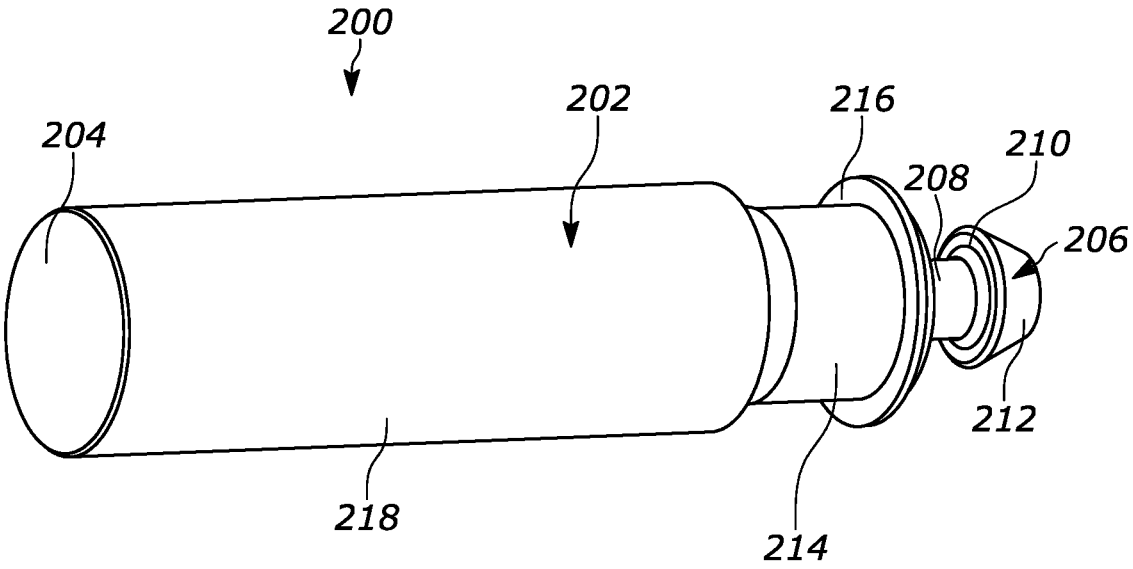
FIG. 12 is a perspective view of a plunger.
Figure 13A:
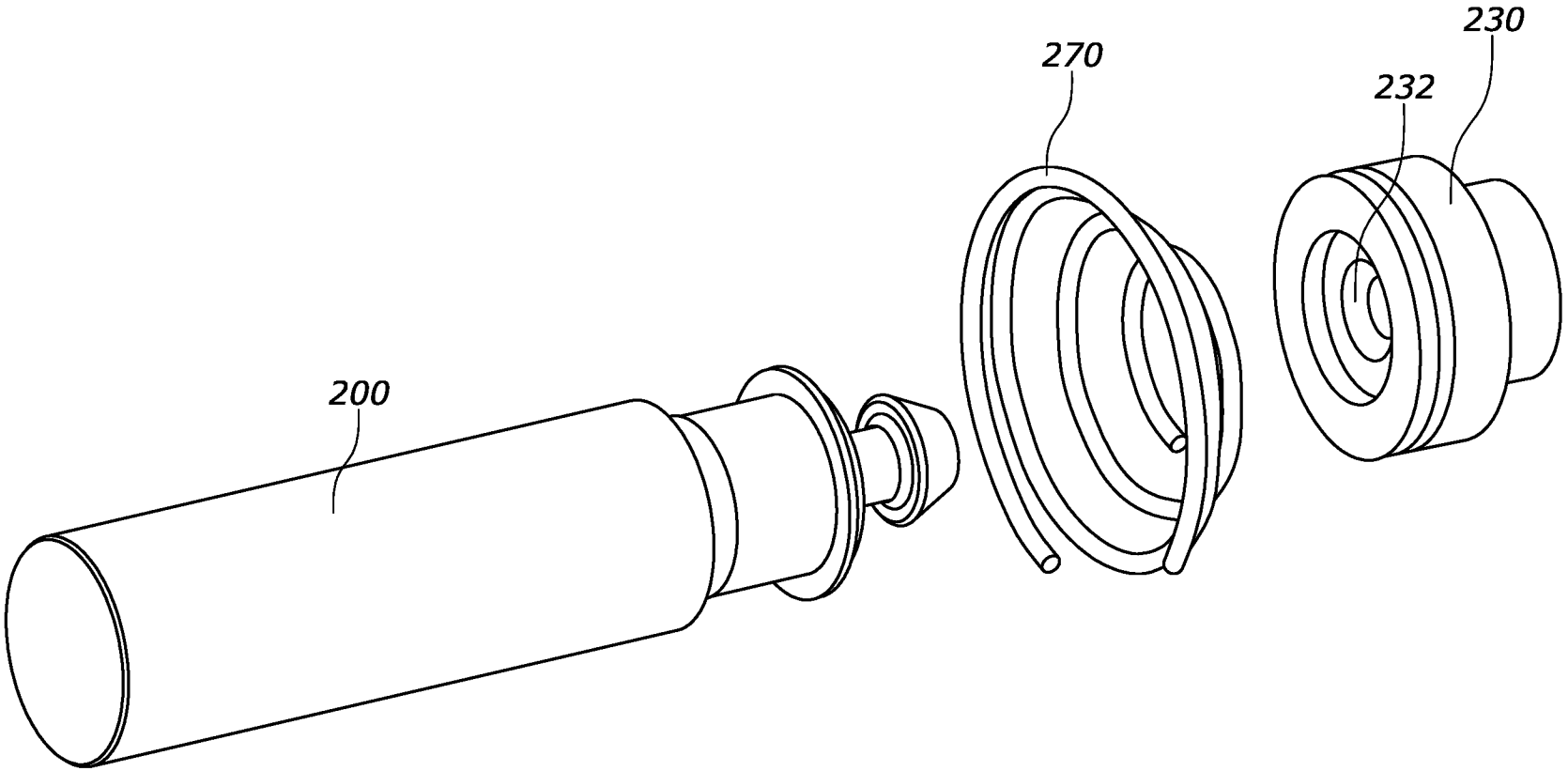
FIG. 13A is an exploded view of the plunger, a spring, and a sealing cap.
Figure 13B:
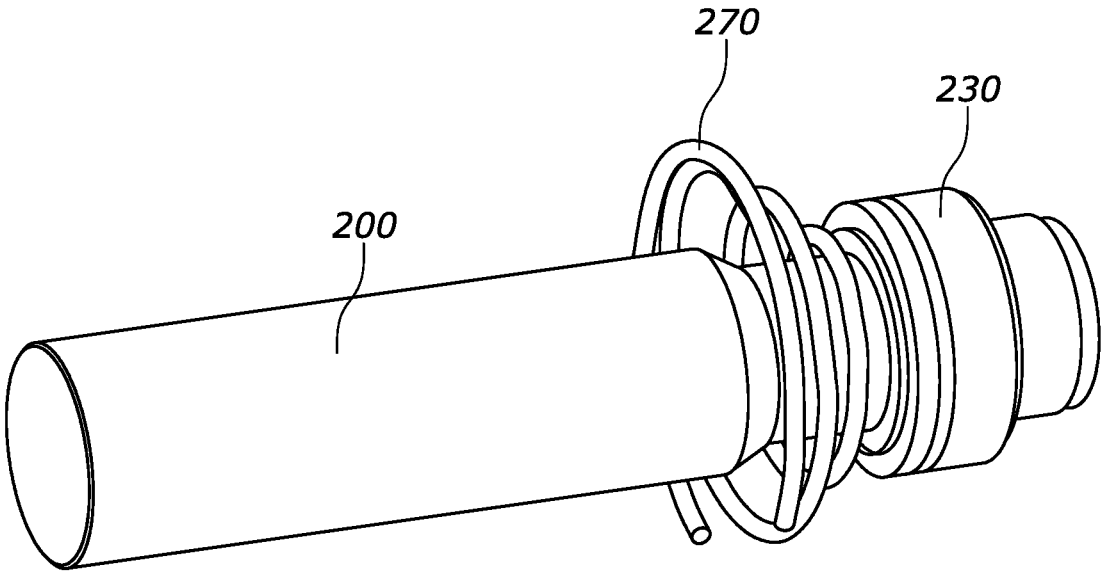
FIG. 13B is a perspective view of the plunger, spring, and sealing cap of FIG. 13A shown in an assembled arrangement.

With reference to FIG. 12 and FIGS. 13A-13B, the plunger 200 includes a substantially cylindrical body 202 extending longitudinally from an end surface 204 to a head 206. The head 206 is connected to the body 202 by a neck 208 having a diameter small than that of the body 202 and the head 206 forming shoulder 210. The sealing cap 230 may include a recess 232 sized and shaped to receive the head 206 of the plunger 200 and hook the shoulder 210. The head 206 includes an angled surface 212 extending from the shoulder 210 which may aid in inserting the head 206 into the recess 232 of the sealing cap 230, but resist becoming unintentionally dislodged. The body 202 further includes a small diameter portion 214, a flange 216, and a large diameter portion 218. Once assembled, as shown in FIG. 13B, the spring 270 is wrapped around the small diameter portion 214 and engages the flange 216, biasing the plunger 200 longitudinally away from the core 170. The diameter of the spring 270 at the end wrapped around the plunger 200 is substantially the same as the small diameter portion 214. The spring 270 is unable to slide off the plunger 200 because the diameter of the spring 270 connected to the plunger 200 is too small to slide over the large diameter portion 218 or the flange 216.

Figure 14A:
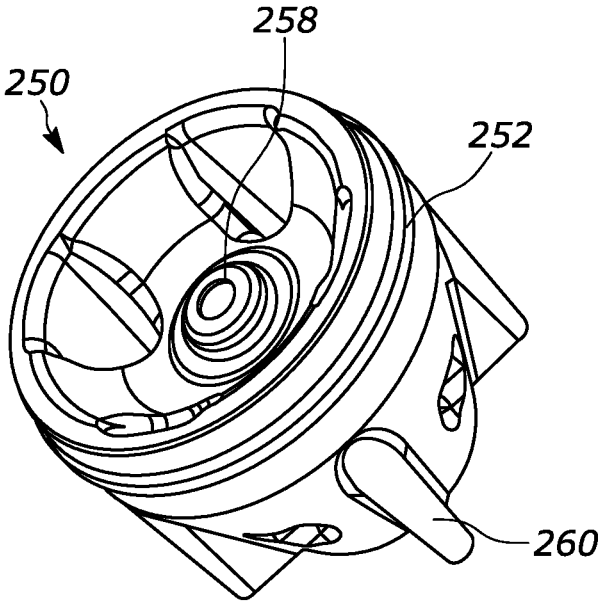
FIG. 14A is a perspective view of a retainer.
Figure 14B:
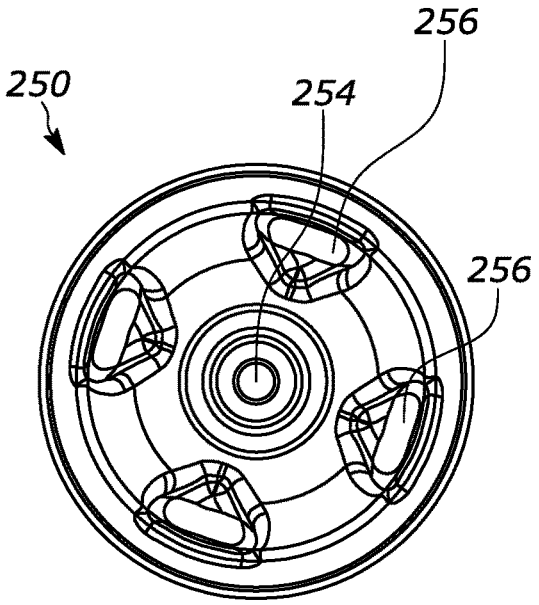
FIG. 14B is a rear view of the retainer of FIG. 14A.
Figure 15:
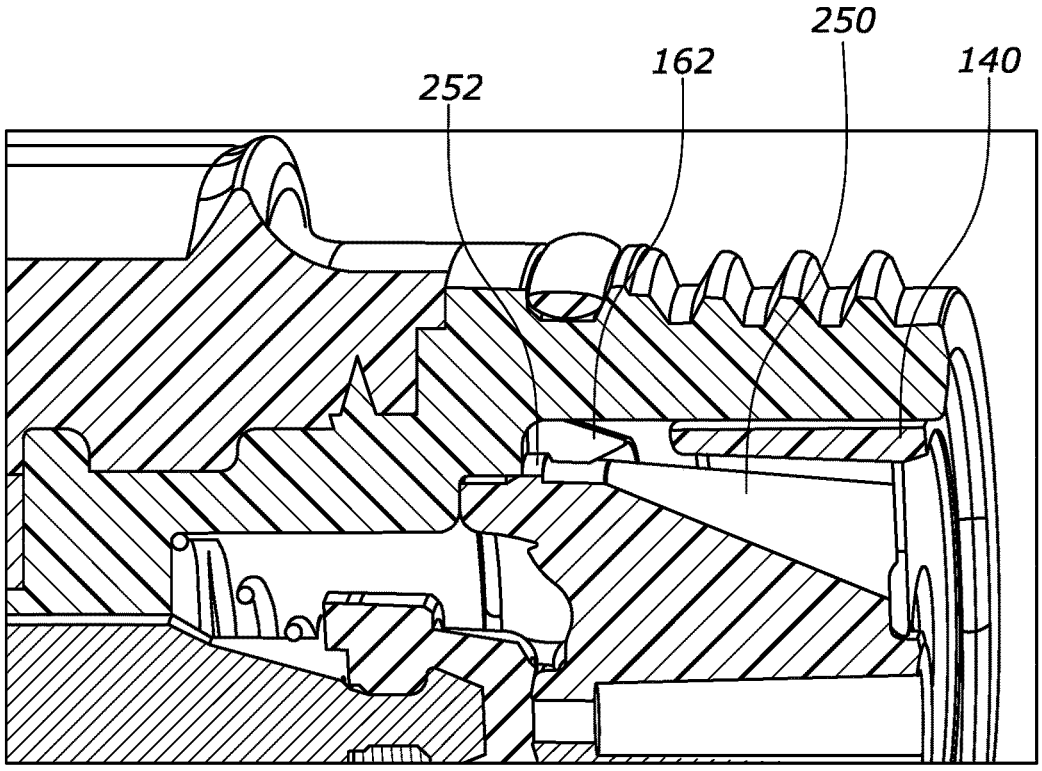
FIG. 15 is a perspective view of a cross-section of a portion the solenoid of FIG. 1 showing the interconnection of the retainer and bobbin.

With reference to FIGS. 14A-14B and 15, the solenoid includes a retainer 250 that may be inserted into the valve cavity 124 of the bobbin. The radial outer surface of the retainer 250 includes a ridge 252 that the retention members 162 of the bobbin 102 engage to hold the retainer 250 in place. When inserting the retainer 250 into the bobbin 102, the ridge 252 may engage and deflect the retention members 162 radially outward as the retainer 250 is moved longitudinally into the valve cavity 124. After the ridge 252 passes beyond a hook portion of the retention members 162, the retention members 162 may snap over the ridge 252 and back to their original position thereby holding the retainer 250 in place. The retainer 250 keeps the plunger 200 at least partially within the tube portion 128 of the bobbin 120.

The retainer 250 defines the fluid flow path to and from the main valve. The retainer 250 includes an outlet passageway 254 extending longitudinally through a center portion of the retainer 250. The retainer 250 further includes inlet passageways 256 extending longitudinally through portions of the retainer 250 radially outward from the outlet passageway 254. It will be understood by those having skill in the art that the direction of fluid flow may also be reversed. As explained above, the plunger 200 is biased by the spring 270 to bring the sealing cap 230 into contact with the retainer 250. The sealing cap 230 is brought into contact with a seat 258 of the retainer 250 surrounding the outlet passageway 254. When the sealing cap 230 is in contact with the seat 258, the outlet passageway 254 is covered, thereby prohibiting fluid communication between the inlet and outlet passageways 254, 256 of the retainer 250. Such a configuration results in the solenoid 100 maintaining the valve in a normally closed position. The retainer 250 may further include a plurality of fins 260 disposed longitudinally along the outer surface of the retainer 250.

Figure 16A:
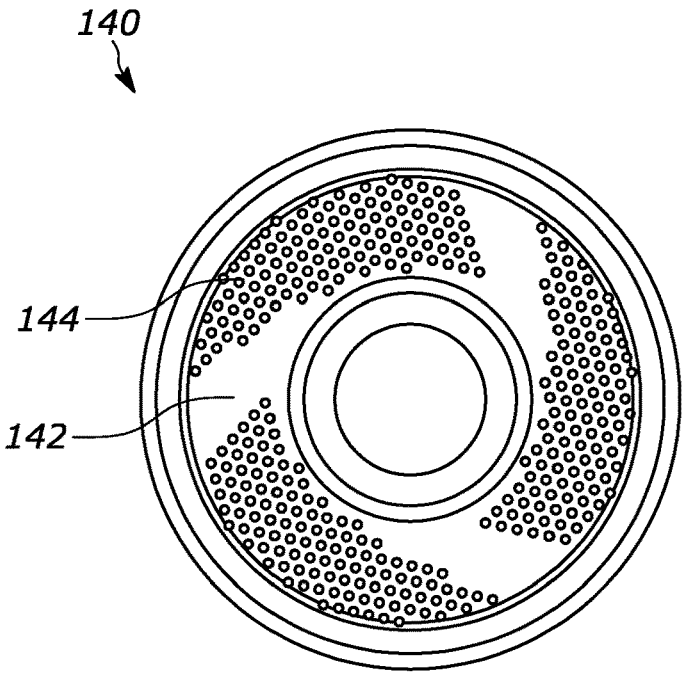
FIG. 16A is a front view of a filter of the solenoid of FIG. 1.
Figure 16B:
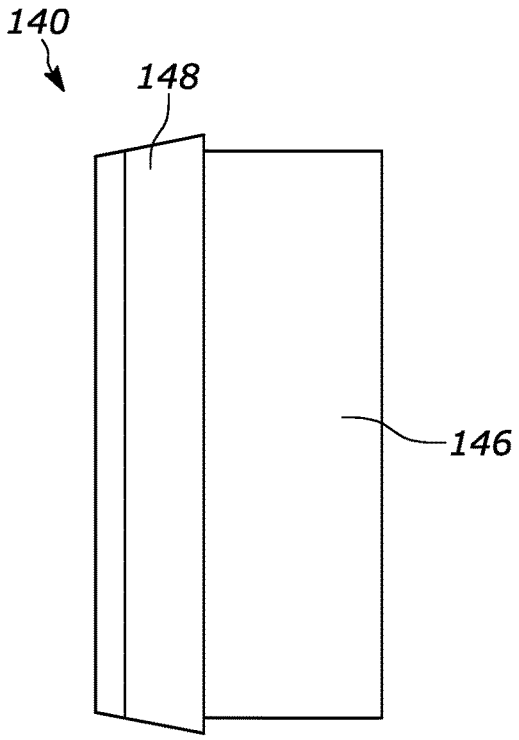
FIG. 16B is a side view of the filter of FIG. 16A.

With reference to FIG. 16A-16B, the solenoid 100 includes a circular filter 140. The filter 140 is sized to be positioned within the cylindrical valve cavity 124 of the bobbin 120. The filter 140 includes a filter screen 142 having a plurality of apertures 144 therethrough sized to prevent particles in the fluid from passing further into the valve cavity 124. The filter 140 includes a sidewall 146 extending longitudinally from the filter screen 142. The sidewall 146 includes a protrusion 148 extending radially outward from the sidewall. The protrusion 148 holds the filter 140 in place within the valve cavity 124 of the bobbin 120 by a friction fit between the radial outer surface of the protrusion 148 and the inner surface of the valve cavity 124 of the bobbin 120.

Figure 17:
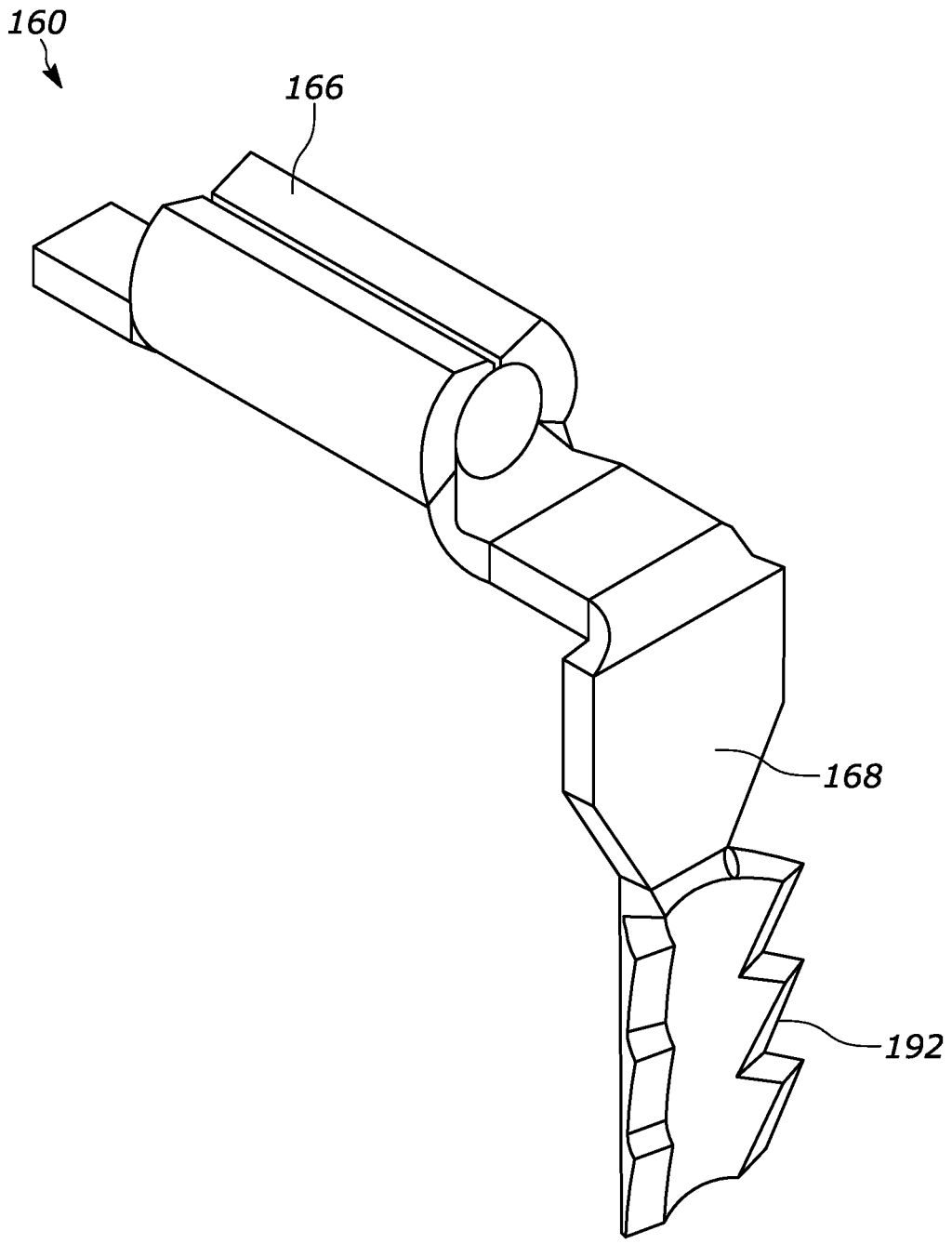
FIG. 17 is a perspective view of a terminal.

With reference to FIG. 3, a coil of wire 152 is wound around the tube portion 128 of the bobbin 120. The ends of the coil of wire 152 connect to terminals 160 inserted into the bobbin 120 near the attachment portion 122. As shown in FIG. 17, the terminals 160 include a first portion 166 for receiving the wires 104 from a power source and a second portion 168 for insertion into the sockets 158 of the bobbin 120 and contacting the ends of the wire of the coil 152. The first portion 166 may include a partial tube that the ends of wires 104 are inserted into. Once inserted, the first portion 166 may be crimped or clamped about the wires 104 to hold the wires 104 in place. In other embodiments, the wires 104 may be soldered to the first portion 166. In one form, the terminals 160 are bent such that the first portion 166 of the terminal 160 forms an approximate right angle with the second portion 168 of the terminal 160. The first portion 166 of the terminal 160 extends in the longitudinal direction away from the attachment portion 122 of the bobbin 120 and the second portion 168 of the terminal 160 is inserted toward an inner portion of the bobbin 120. The second portion 168 may include barbs 192 that allow for insertion into the socket 158 but resist removal. In another embodiment, the second portion 168 of the terminals 160 may be sized to be retained within the socket 158 by a friction fit. The ends of the coil 152 may be brought into contact with the second portion 168 of the terminals 160 to form an electrical connection between the power source and the coil 152. As examples, the ends of the coil of wire 152 may wrapped around and/or soldered to the second portion 168 of the terminals 160. The ends of the coil 152 may also be connected to contacts within the sockets 158 that the terminals 160 contact upon insertion into the sockets 158. The wires 104 from the power source extend through the wire guides 154 of the bobbin 120.

In operation, electrical power is supplied to the terminals 160 via the wires 104 extending from a power source. Current flows through the coil of wire 152 wrapped about the bobbin 120. The flow of current through the coil 152 induces a magnetic field that forms a loop extending through the inner diameter of the coil and returning around the exterior of the coil 152 thereby forming a magnetic circuit. The magnetic circuit carrying the magnetic field about the loop include the core 170, the plunger 200, and the carrier 300. The magnetic field also may pass through the other components of the solenoid 100 and environment surrounding the solenoid. The magnetic field acts on the plunger 200 which is partially disposed within the inner diameter of the coil 152. The magnetic attractive force on the plunger 200 overcomes the biasing force of the spring 270 and draws the plunger 200 toward the core 170. This moves the sealing cap 230 from the seat 258 of the retainer 250, allowing fluid to flow from the inlet passageways 256 and through the outlet passageway 254 of the retainer 250.

The solenoid 100 may be manufactured according to the following steps, although it will be understood to those having skill in the art that the steps and order of the steps may be modified. A wire may be wound about the tube portion 128 of the bobbin 120 to form the coil of wire 152. The ends of the coil of wire may be electrically connected to the second portion 168 of the terminals 160, with the second portion 168 of the terminals 160 being inserted into the sockets 158 of the bobbin 120. The power supply wires 104 may be connected to the first portion 166 of the terminals 160. The first portion 166 may be crimped or clamped about the wires 104. The wires 104 may be snapped into the wire guides 154 of the bobbin 120.

The shading ring 190 may be inserted into the annular recess 180 of the core 170. The shading ring 190 may be held in the annular recess by an adhesive or be sized to be retained within the annular recess 180 by a friction fit. A gasket 188 may be placed over the rod portion 174 of the core 170. The rod portion 174 of the core 170 may then be inserted into the second end 132 of the tube portion 128 of the bobbin 120. The protrusions 156 extending from the end surface 134 of the bobbin 120 may be aligned with and inserted through the apertures 172 of the core 170. The ends of the protrusions 156 extending through the end surface 134 may then be deformed to prevent the ends of the protrusions 156 from being able to pass back through the apertures 172. The protrusions 156 may be deformed, for example, by applying heat to the protrusions 156.

The carrier 300 may then be attached to the bobbin 120. The first end surface 302 is positioned behind the core 170 such that the core 170 is between the first end surface 302 of the carrier 300 and the bobbin 120. The second end surface 304 abuts the tube portion 128 of the bobbin 120 with the semi-circular cutout 316. The second end surface 304 is positioned within the cavity or slot 131 formed between the end surface 135 of the bobbin 120 and the attachment portion 122 of the bobbin 120. As the carrier 300 is brought into contact with the bobbin 120, the hooks 164 of the bobbin 120 are guided through the attachment cutout portions 308, 310 of the carrier 300. Once the hooks 164 have passed beyond the attachment fingers 312, 314 of the carrier 300, the fingers 312, 314 are bent inward and under the hooks 164. The fingers 312, 314 may be bent or deformed using servo motors configured to bend the fingers 312, 314 to a certain angle relative to their initial, unbent position.

The partially assembled solenoid 106 may then be placed in a mold and overmolded with a plastic to form the housing 102 covering the components on the outside of the tube portion 128 of the bobbin 120. The overmold extends from the attachment portion 122 of the bobbin 120 and covers the tube portion 128 of the bobbin 120, the terminals 160, the coil 152, the carrier 300, a portion of the wires 104, a portion of the core 170, and a portion of the gasket 188 in between the core 170 and the bobbin 120. In one embodiment, the overmold is dispersed over the partially assembled solenoid 106 from the side of the partially assembled solenoid 106 including the wires 104 and sockets 158. As the plastic flows into the mold and over the partially assembled solenoid 106, the shroud 194 redirects the flow around the interface of the first end surface 302 of the carrier and the back surface 187 of the core 170. This aids to prevent the plastic from flowing in between the carrier 300 and the core 170 to preserve the magnetic circuit interface between the components. In another embodiment, the plastic flows over the partially assembled solenoid 106 from the first end surface 302 of the carrier 300 toward the attachment portion 122 of the bobbin 120. In this embodiment, the plastic forces the first end surface 300 of the carrier against the core 170 as the plastic flows into the mold and over the partially assembled solenoid 106.

The plunger 200, retainer 250, gasket 150, spring 270, sealing cap 230, and filter 140 may be installed after the overmolding process, however, in some forms one or more of these components may be installed before the overmolding process. In this regard, the plunger 200 is positioned within the tube portion 128 of the bobbin 120 such that the end surface 204 of the plunger 200 is near the core 170. The spring 270 is attached to the small diameter portion 214 of the plunger 200 and the internal surface of the bobbin 120. The sealing cap 230 may be snapped onto the head 206 of the plunger 200. Once the plunger 200 is positioned within the bobbin 120, the retainer 250 is snapped into the valve cavity 124. To do this the ridge 252 of the retainer 250 is brought into contact with the retention members 162 of the bobbin 120. A longitudinal force is applied to the retainer 250, urging the retention members 162 apart to allow the ridge 252 of the retainer 250 to pass beyond the retention members 162. The retention members 162 then elastically move toward their original position hooking the ridge 252 and thereby securing the retainer 250 to the bobbin 120. The filter 140 may then inserted into the valve cavity 124 of the bobbin 120. An outer surface or protrusion 148 of the filter may be marginally larger than an inner surface of the valve cavity 124 such that the filter 140 is held in place by the friction between the outer surface of the filter 140 and the inner surface of the valve cavity 124. The filter 140 is forced to move longitudinally within the valve cavity 124 until it abuts the retainer 250.

Figure 18:
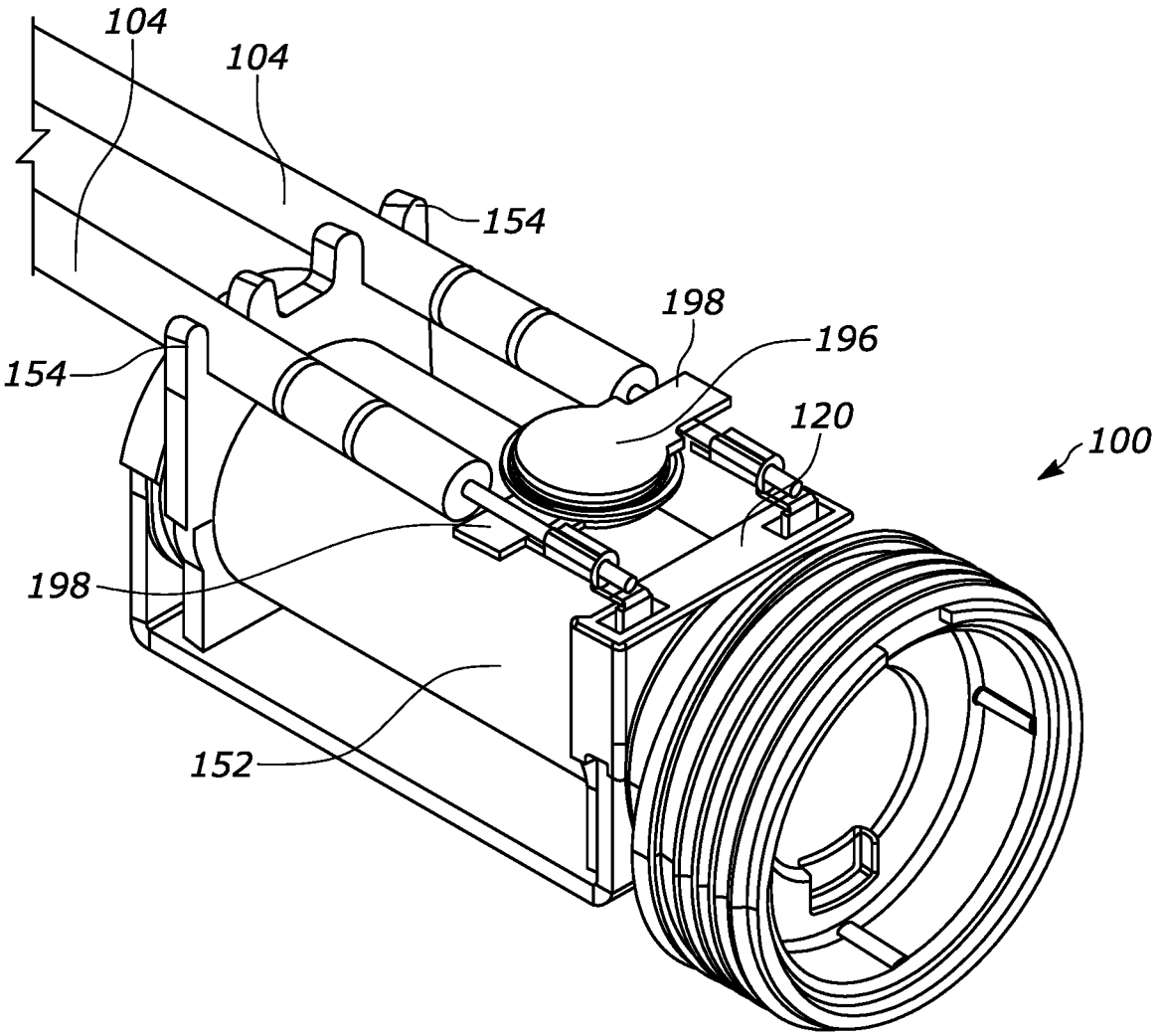
FIG. 18 is a perspective view of another form of solenoid.

In another embodiment shown in FIG. 18, a solenoid 100 is shown having a gas discharge tube wire harness 196 attached across the wires 104 extending to the power source. The gas discharge tube wire harness 196 provides surge protection during high voltage events, such as a lightning strike, to protect the solenoid 100. The gas discharge tube wire harness 196 may be connected across wires 104 at pads 198. Pads 198 may be attached to the wires 104 by resistance welding or soldering as examples. As shown, the bobbin 120 of the solenoid 100 includes wire guides 154. The wire guides 154 are sized to receive the wires 104 attached to the terminals 160. The wires 104 of the solenoid 100 including a gas discharge tube may be thicker to withstand power surges, for example, 18-gauge wire. The wires 104 may be pressed into the wire guides 154. The wires may snap into the wire guides where they are held in place to prevent unintentional movement. The wire guides may hold the wires 104 and gas discharge tube wire harness 196 in place when they are being overmolded. The wire guides 154 may aid to prevent the wires and gas discharge tube wire harness 196 from coming into contact with the coil 152, which may cause the solenoid to fail prematurely.

Figure 19A:
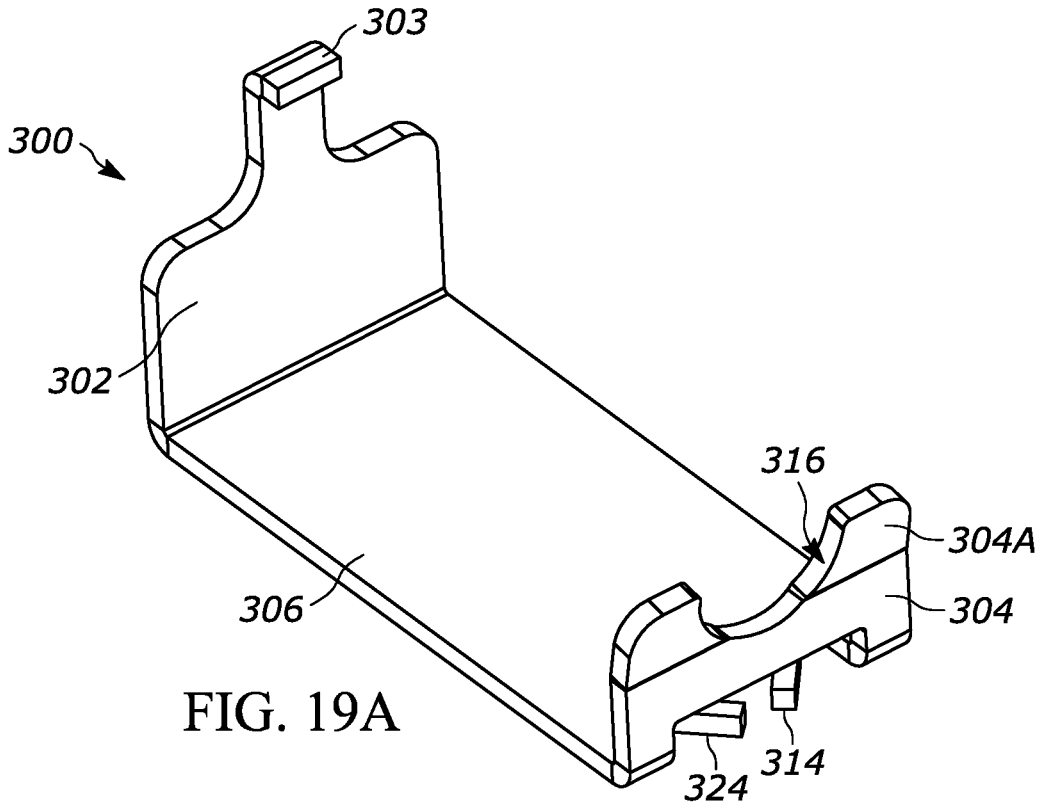
FIG. 19A is a front perspective view of a frame or carrier according to another embodiment.
Figure 19B:
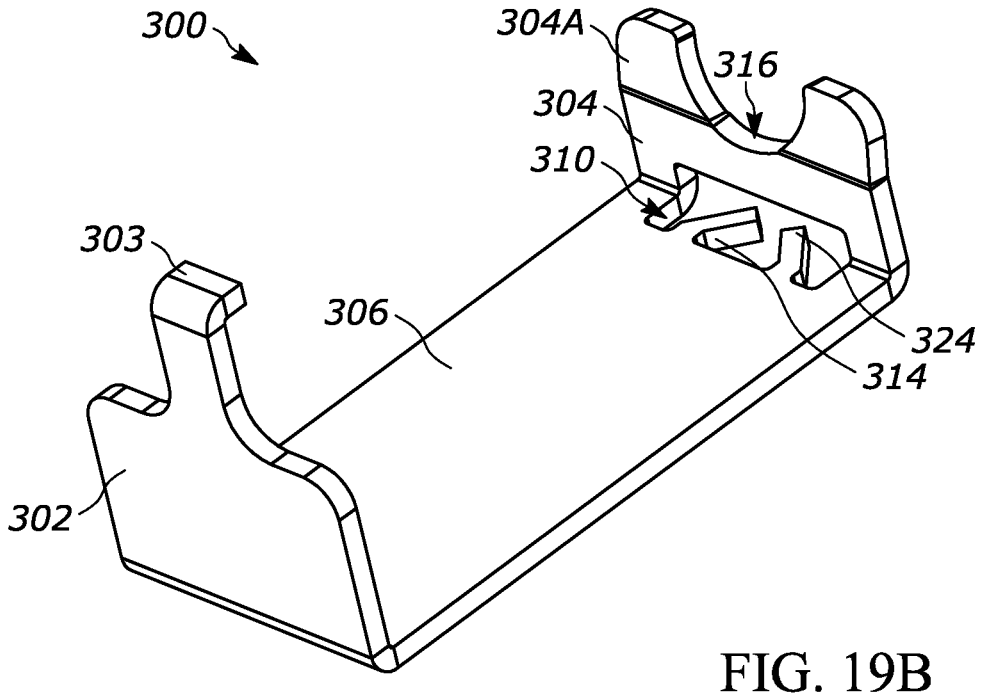
FIG. 19B is a rear perspective view of the carrier of FIG. 19A.
Figure 20:
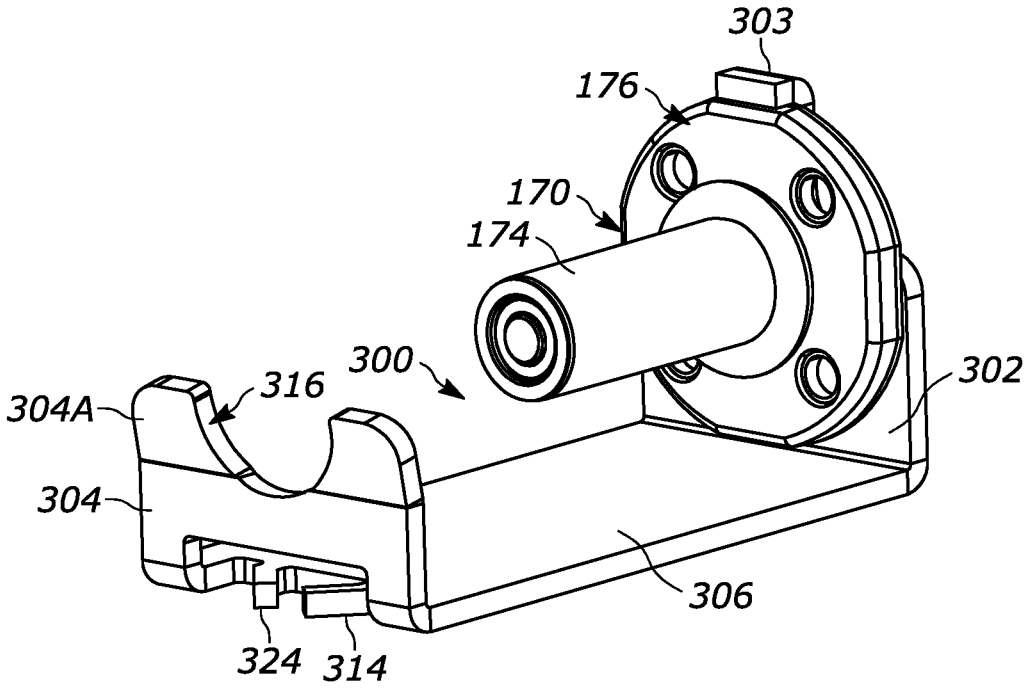
FIG. 20 is a front perspective view of the carrier of FIG. 19A with the core of FIG. 7.
Figure 21:
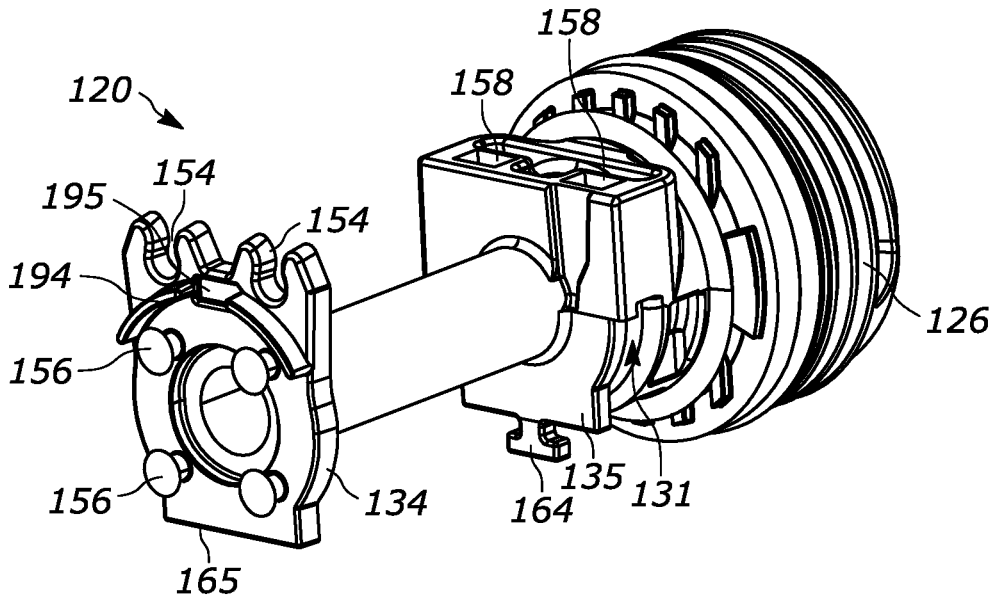
FIG. 21 is a rear perspective view of a bobbin according to another embodiment.

With respect to FIGS. 19-23B, additional embodiments of the various components of the solenoid 100 are shown that are similar in many respects to the embodiments of the solenoid 100 discussed above, the differences of which are highlighted in the following discussion. For conciseness and clarity, the reference numerals of the embodiments of the components described above will be used to indicate similar features in the additional embodiments described below. With reference to FIGS. 19A-19B, the first end surface 302 of the carrier 300 includes a bent tab 303 extending away from the longitudinal portion 306. The bent tab 303 is positioned to extend over a straight edge 184 of the core 170. The bent tab 303 may be spaced apart from the longitudinal portion 306 such that the core 170 may be attached to the carrier 300 and firmly held in place between the bent tab 303 and the longitudinal portion 306 as shown in FIG. 20, for example, during assembly of the solenoid 100. The bent tab 303 thus aids to hook the core 170 to secure the core 170 to the carrier 300. As shown in FIG. 21, the bobbin 120 may include a notch or recess 195 into which an end of the bent tab 303 may extend. The bent tab 303 thus aids to hook the bobbin 120 to secure the carrier 300 to the bobbin 120.

Figure 22A:
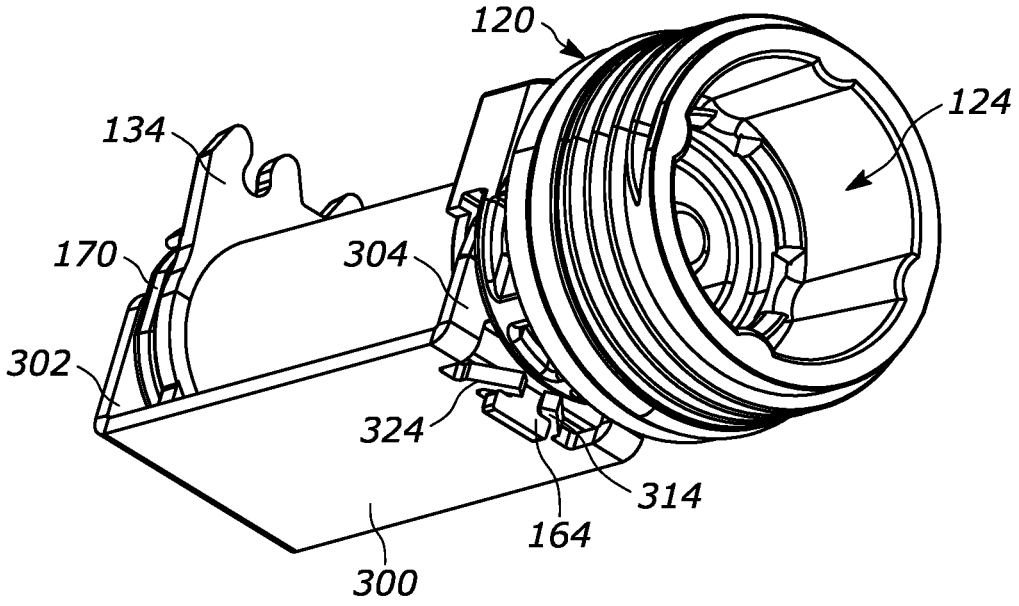
FIG. 22A is a front perspective view of a partially assembled solenoid including the carrier of FIG. 19A and the bobbin of FIG. 21.

The carrier 300 further includes only one cutout portion 310 on the longitudinal portion 306 at the second end surface 304, rather than two cutout portions at each end as in the previous embodiments. The carrier 300 includes two fingers 314, 324 extending out into the cutout portion similar to the carrier shown and described in regard to FIG. 11 above. The fingers 314, 324 may be bent about the hook 164 of the bobbin 120 as shown in FIG. 22A to affix the carrier 300 to the bobbin 120. The second end surface 304 may further include a portion 304A that is bent longitudinally away from the first end surface 302. The bent portion 304A may include the semi-circular cutout 316 to enable the second end surface 304 to be positioned to abut the tube portion 128 of the bobbin 120. While the embodiment shown includes a full T-shaped hook 164, in other embodiments, the bobbin 120 may include a half T-shaped hook as shown, for example, in FIG. 10A. In these embodiments, the carrier 300 may include a single finger 314 that is deformed or bent about the half T-shaped hook 164.

Figure 22B:
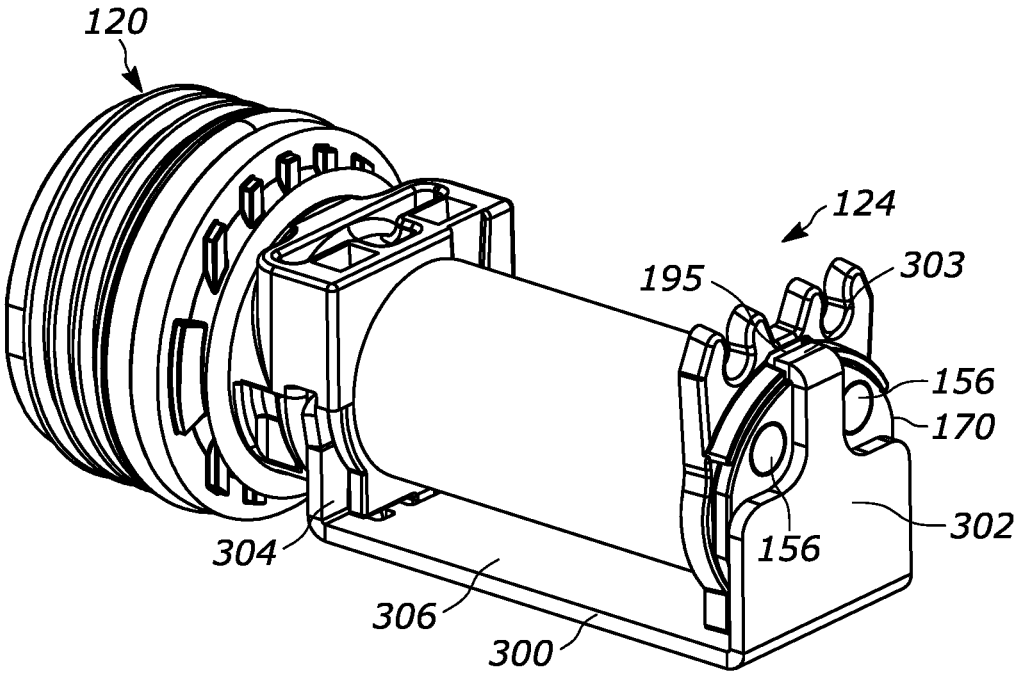
FIG. 22B is a rear perspective view of the partially assembled solenoid of FIG. 22A.

With respect to FIG. 21, the end surface 134 of the bobbin 120 does not include a second hook 164, but instead includes a flat surface 165 to engage a top surface of the longitudinal portion 306 of the carrier 300 when attached thereto. The flat surface 165 may aid to prevent the carrier 300 from twisting or moving relative to the bobbin 120 when secured thereto. The end surface 134 of the bobbin 120 further includes the notch or recess 195 in the shroud 194 that may receive the bent tab 303 of the carrier 300 when the carrier 300 is attached to the bobbin 120. When the carrier 300 is attached to the bobbin 120 as shown in FIGS. 22A-B, the bent tab 303 is inserted into the recess 195 of the end surface 134. The bent tab 303 thus hooks the bobbin 120 which aids in affixing the carrier 300 to the bobbin 120. The carrier 300 may thus be secured to the bobbin 120 for assembly by hooking the bent tab 303 into the recess 195 of the bobbin 120 and bending the fingers 314, 324 about the hook 164 of the bobbin 120.

In some forms, to attach the carrier 300 to the bobbin 120, the second end surface 304 is inserted within the cavity 131 of the bobbin 120. The carrier 300 is pivoted to bring the bent tab 303 toward the recess 195 of the bobbin 120. The bent tab 303 may be slid along the core 170 until the bent tab 303 snaps over the top edge 184 of the core 170. In some forms, the bent tab 303 may snap into the recess 195 of the bobbin 120. As the carrier 300 is pivoted, the bent portion 304A of the second end surface 304 of the carrier 300 may be forced against the attachment portion 122 of the bobbin 120. The bent portion 304A may be elastically deflected such that the bent portion 304A provides an increased frictional engagement between the second end surface 304 and the attachment portion 122 of the bobbin 120, which aids to prevent the carrier 300 from moving relative to the bobbin 120. Once the bent tab 303 is within the recess 195, the fingers 314, 324 may be bent about the hook 164 of the bobbin 120 extending through the attachment opening or cutout portion 310.

Figure 23A:
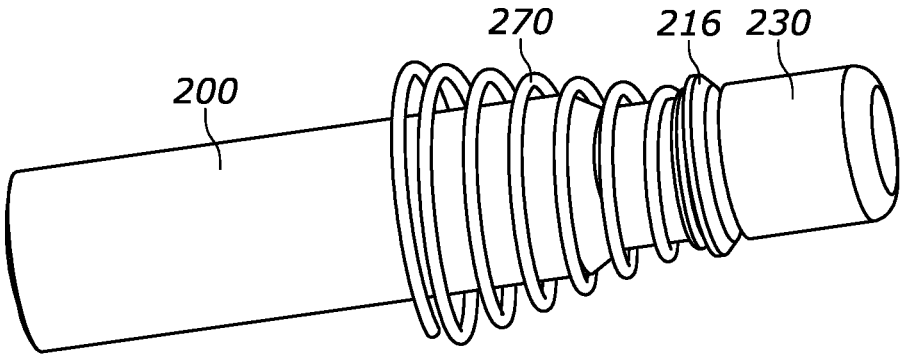
FIG. 23A is a perspective view of a plunger, a spring, and sealing cap according to another embodiment in an assembled arrangement.
Figure 23B:
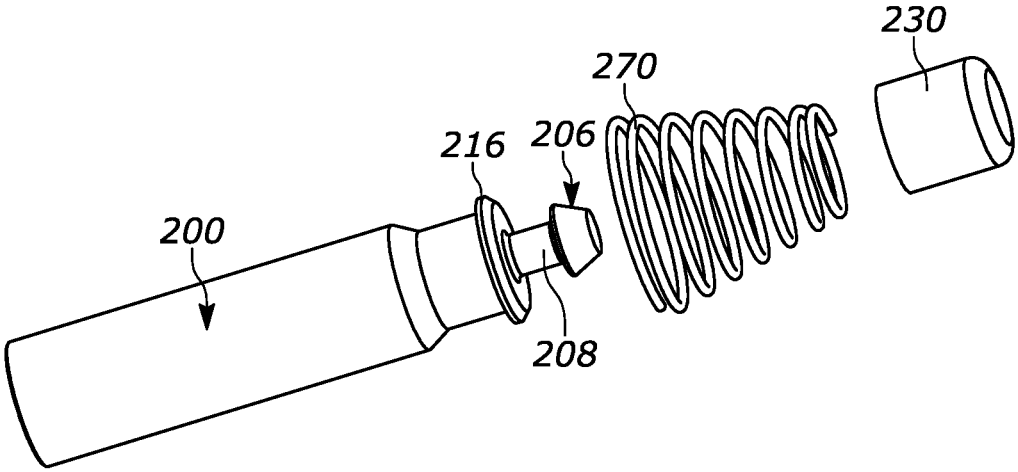
FIG. 23B is an exploded view of the plunger, spring, and sealing cap of FIG. 23A.

With respect to FIGS. 23A-B, the plunger 200, spring 270, and sealing cap 230 are shown. As shown, the spring 270 extends further longitudinally in its uncompressed state than the spring in the previous embodiments. The spring 270 of this embodiment may apply a greater force to the flange 216 of the plunger 200 to force or bias the plunger 200 into engagement with the seat 258 of the retainer 250. The sealing cap 230 of this new embodiment has a substantially cylindrical shape with an outer diameter that is not greater than the outer diameter of the flange 216.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the technological contribution. The actual scope of the protection sought is intended to be defined in the following claims.

What is claimed is:

1. A solenoid comprising:

a bobbin;

a core wire forming a coil about at least a portion of the bobbin;

a power supply wire electrically coupled to an end of the core wire;

a frame secured to the bobbin, the frame including a first end portion extending adjacent a first end of the coil, a second end portion extending adjacent a second end of the coil, and a longitudinal portion extending from the first end portion to the second end portion, the frame having the first end portion and the second end portion extending substantially perpendicularly from the longitudinal portion; and an overmolded housing surrounding the core wire, the frame, and a portion of the power supply wire.

2. The solenoid of claim 1 wherein the bobbin includes a wire guide to support the power supply wire and restrict movement of the power supply wire relative to the bobbin when the housing is overmolded over the portion of the power supply wire.

3. The solenoid of claim 1 wherein the bobbin includes an attachment hook and the frame is connected to the bobbin by the attachment hook.

4. The solenoid of claim 3 wherein the frame includes an attachment opening and a tab extending into the attachment opening, the tab engaging the attachment hook of the bobbin to secure the frame to the bobbin.

5. The solenoid of claim 1 wherein the attachment hook has at least one of a half-T or a T-shaped configuration.

6. The solenoid of claim 1 wherein the first end portion of the frame includes a tab protruding therefrom that extends into a recess of the bobbin.

7. The solenoid of claim 1 further including a gas discharge tube connected to the power supply wire and surrounded by the overmolded housing.

8. The solenoid of claim 1 further comprising a core positioned at least partially within an end portion of the bobbin, wherein the bobbin includes a shroud extending longitudinally from the end portion of the bobbin and over at least a portion of the core and the frame outside the bobbin.

9. The solenoid of claim 8 wherein the core includes a base portion defining a plurality of countersunk holes and the end portion of the bobbin includes a plurality of protrusions extending through the attachment openings, the plurality of protrusions being deformed to prevent the plurality of protrusions from being withdrawn from the core.

10. The solenoid of claim 9 wherein the base portion is disc shaped having a radial outer surface of the base portion including a flat edge, an end surface of the base portion of the core contacting the first end portion of the frame and the flat edge of the core contacting the longitudinal portion of the frame.

11. The solenoid of claim 8 wherein the core includes a rod portion having an end defining an annular recess and further comprising a metallic ring positioned within the annular recess and attached to the core via an interference fit.

12. A solenoid comprising:

a bobbin having a securing protrusion;

a core having a back surface;

a core wire forming a coil about at least a portion of the bobbin; and a frame secured to the bobbin, the frame including a first end portion extending adjacent a first end of the coil, a second end portion extending adjacent a second end of the coil, and a longitudinal portion extending from the first end portion to the second end portion, the longitudinal portion including a slot for receiving the securing protrusion to couple the bobbin to the frame, the first and second end portions of the frame extending outwardly from the longitudinal portion, and the back surface of the core is positioned between the first end portion of the frame and the bobbin.

* * * * *